US008186446B2

(12) United States Patent
Ingram et al.

(10) Patent No.: US 8,186,446 B2
(45) Date of Patent: May 29, 2012

(54) METHOD AND APPARATUS FOR A PACKER ASSEMBLY

(75) Inventors: Gary D. Ingram, Richmond, TX (US); Jacob K. Bramwell, Houston, TX (US); Walter Stone Thomas Fagley, IV, Katy, TX (US); Robert S. Beeman, Houston, TX (US); Carol Ann LaPlante Beeman, legal representative, Bossier City, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 391 days.

(21) Appl. No.: 12/411,245

(22) Filed: Mar. 25, 2009

(65) Prior Publication Data

US 2010/0243270 A1 Sep. 30, 2010

(51) Int. Cl.
*E21B 33/12* (2006.01)
*E21B 33/128* (2006.01)
*E21B 33/129* (2006.01)

(52) U.S. Cl. ..... 166/387; 166/191; 166/125

(58) Field of Classification Search ..... 166/191, 166/125, 387

See application file for complete search history.

(56) References Cited

U.S. PATENT DOCUMENTS 4,485,876 A 12/1984 Speller
4,582,135 A * 4/1986 Akkerman ..... 166/134
4,605,062 A 8/1986 Klumpyan et al.
5,692,564 A * 12/1997 Brooks ..... 166/127
5,782,306 A 7/1998 Serafin
6,253,856 B1 7/2001 Ingram et al.
6,257,339 B1 7/2001 Haugen et al.
6,655,461 B2 12/2003 Eslinger et al.
6,695,057 B2 2/2004 Ingram et al.
6,782,954 B2 8/2004 Serafin et al.
6,823,945 B2 11/2004 Eslinger et al.
6,832,654 B2 12/2004 Ravensbergen et al.
6,883,610 B2 4/2005 Depiak
7,011,157 B2 3/2006 Costley et al.
7,032,675 B2 4/2006 Steele et al.
7,051,812 B2 5/2006 McKee et al.
7,165,611 B2 * 1/2007 Jones ..... 166/191
7,472,746 B2 1/2009 Maier
7,478,676 B2 1/2009 East, Jr. et al.
7,484,565 B2 2/2009 van Batenburg et al.
7,516,791 B2 4/2009 Bryant et al.
2004/0129421 A1 7/2004 Hoffman et al.
2007/0068676 A1 3/2007 Shkurti
2010/0243254 A1 9/2010 Murphy et al.

OTHER PUBLICATIONS

RoboPacker—New Solution for Coiled Tubing Fracturing and Other Applications Requiring Zonal Isolation, Depiak Indutrial Technology, Product Report, Jun. 2005.
Australian Office Action for Patent Application No. 2010201174 dated Nov. 22, 2011.
Canadian Office Action for Application No. 2,697,395 dated Aug. 23, 2011.

* cited by examiner

*Primary Examiner* — Giovanna Wright
(74) *Attorney, Agent, or Firm* — Patterson & Sheridan, LLP

(57) ABSTRACT

A method and apparatus for setting a packer assembly having an upper packer and a lower packer in a wellbore in a single trip into a wellbore is provided. The packer assembly is configured to be retrieved from the wellbore using a retrieval tool in a single trip into the wellbore. The retrieval tool is configured to be released from the packer assembly while in the wellbore during a retrieval process in the event that the packer assembly will not release from the wellbore or is otherwise prevented from removal from the wellbore.

22 Claims, 58 Drawing Sheets

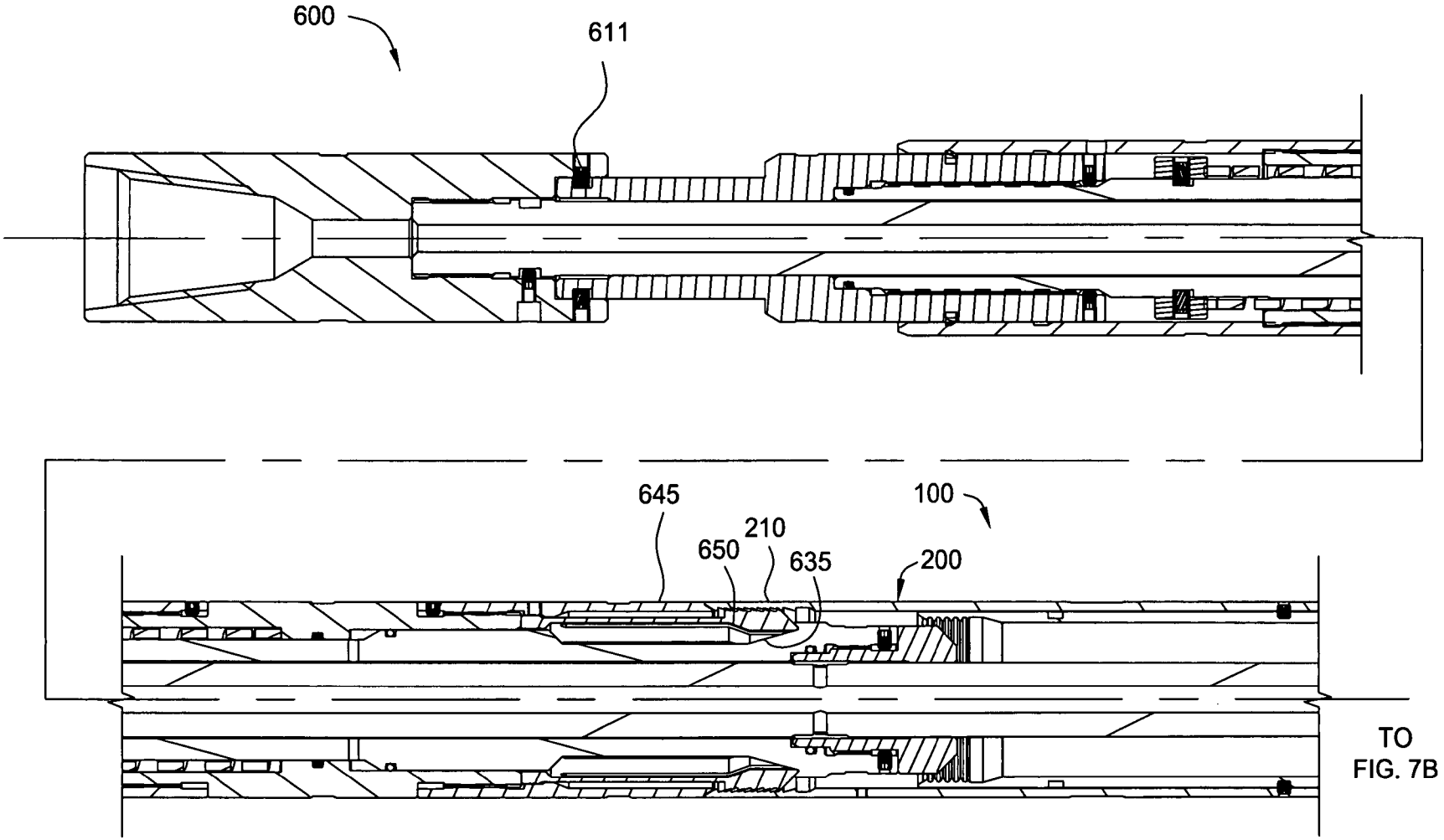
FIG. 7A
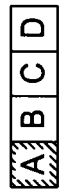

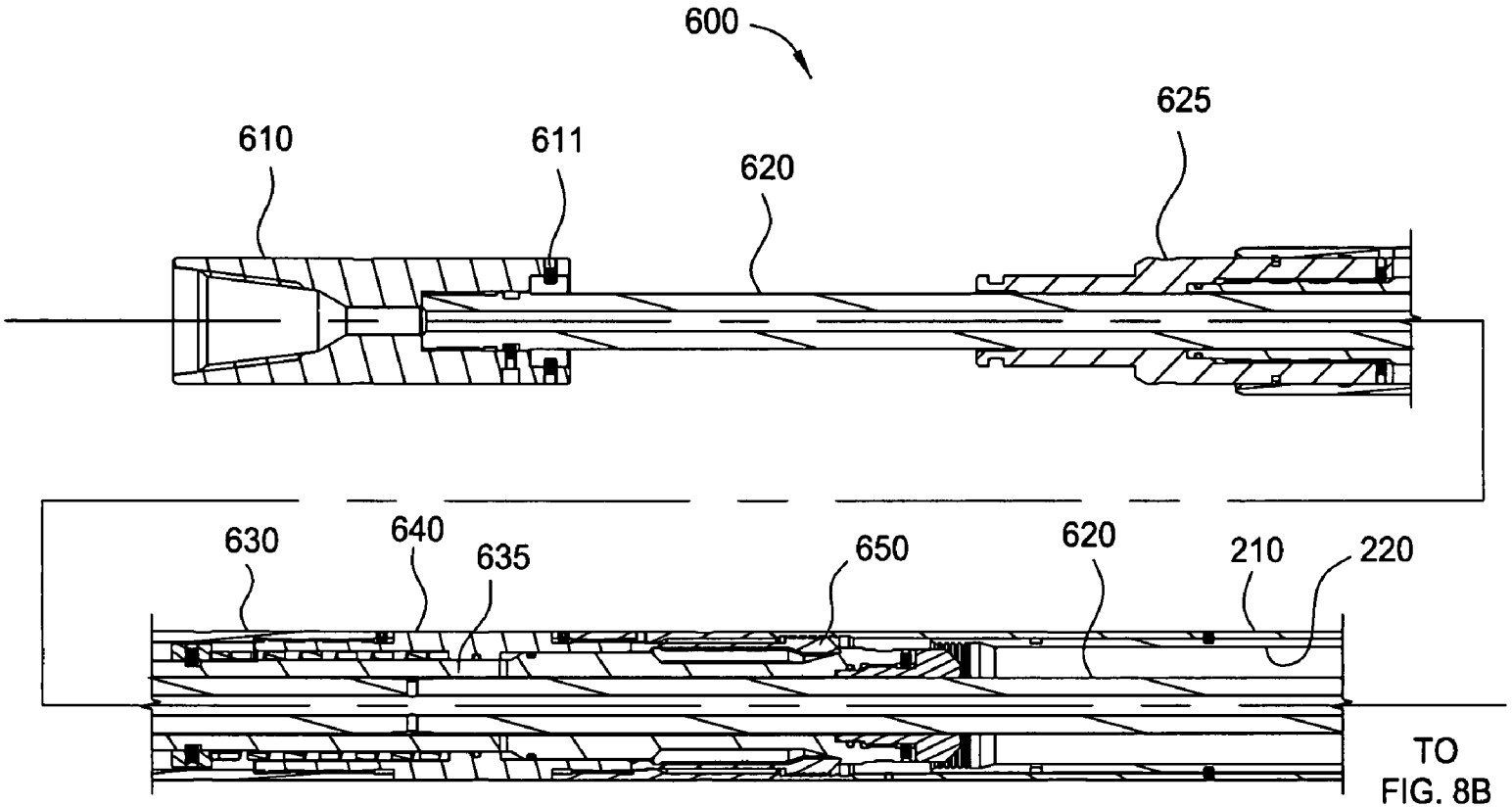
FIG. 8A
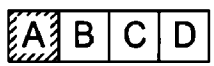

A B C D

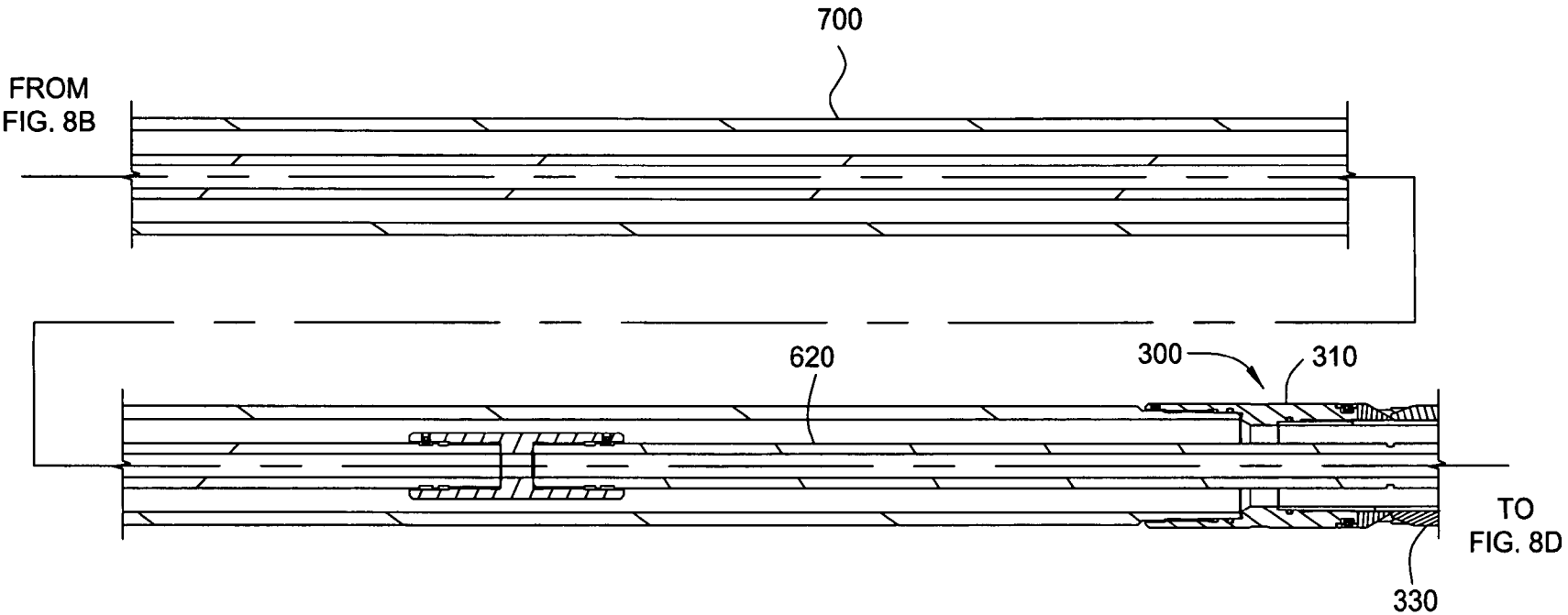
FIG. 8C
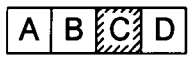

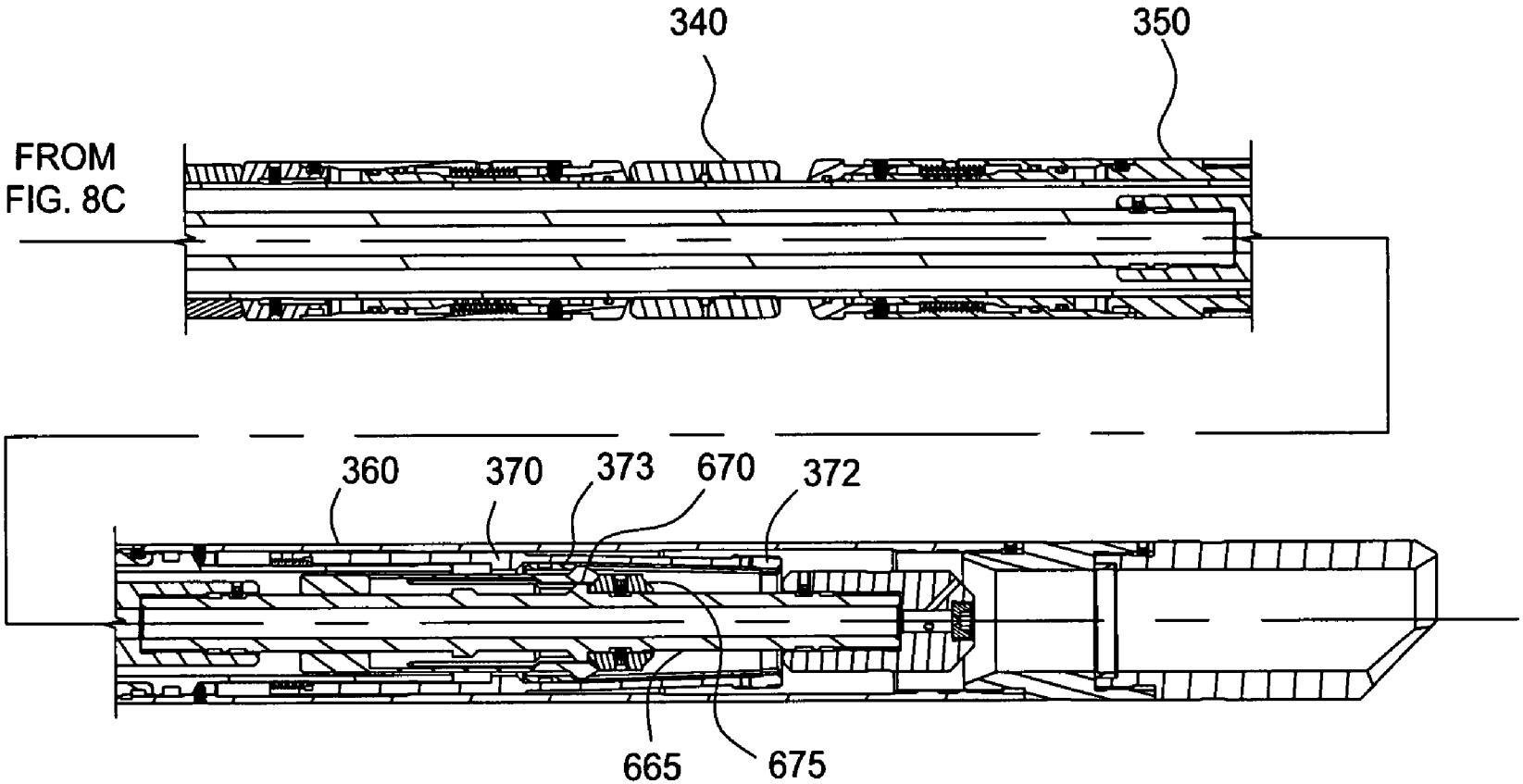
FIG. 8D
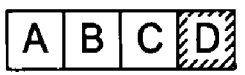

A B C D

A B C D

A B C D

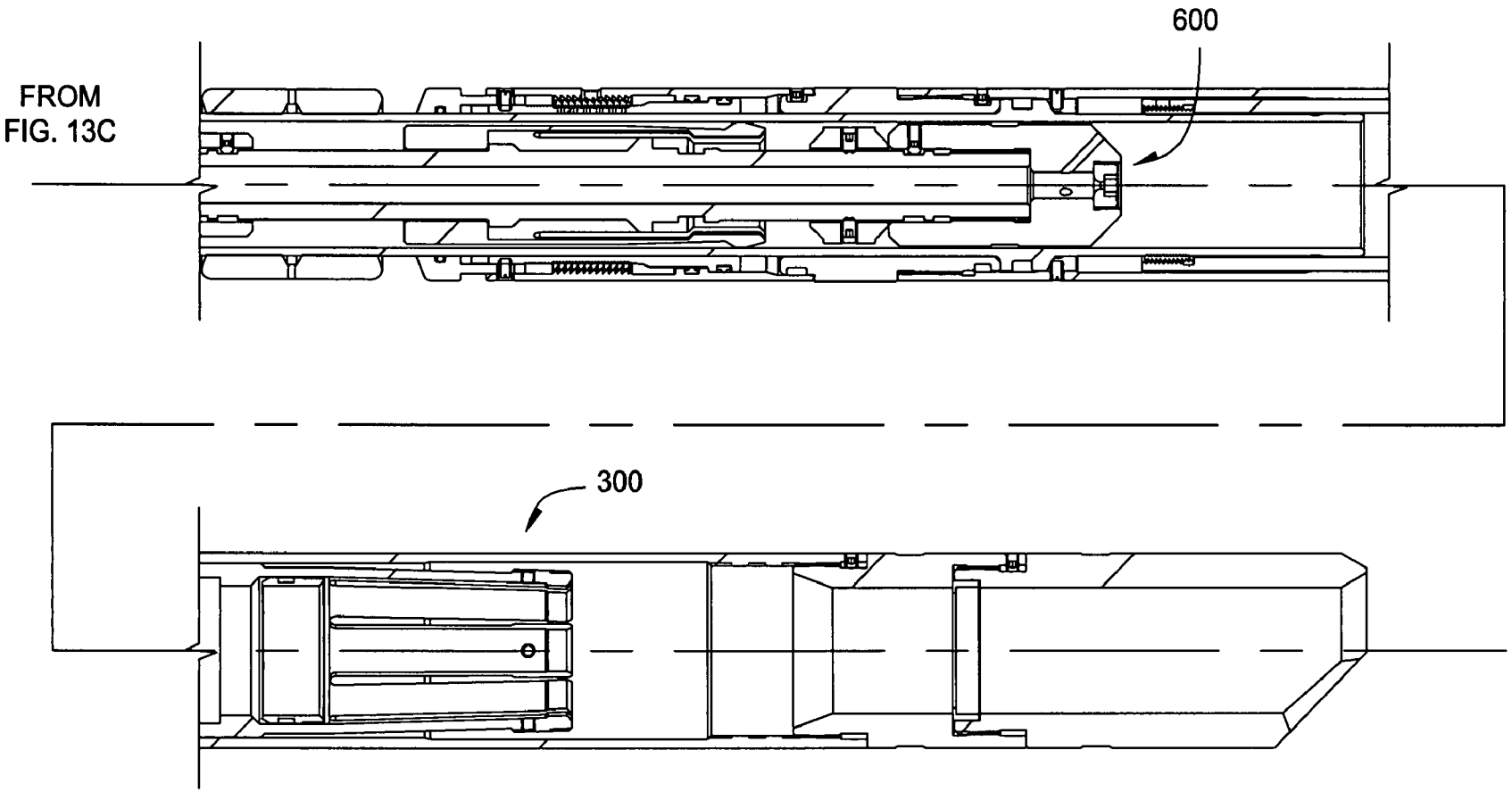
FIG. 13D
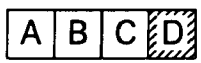

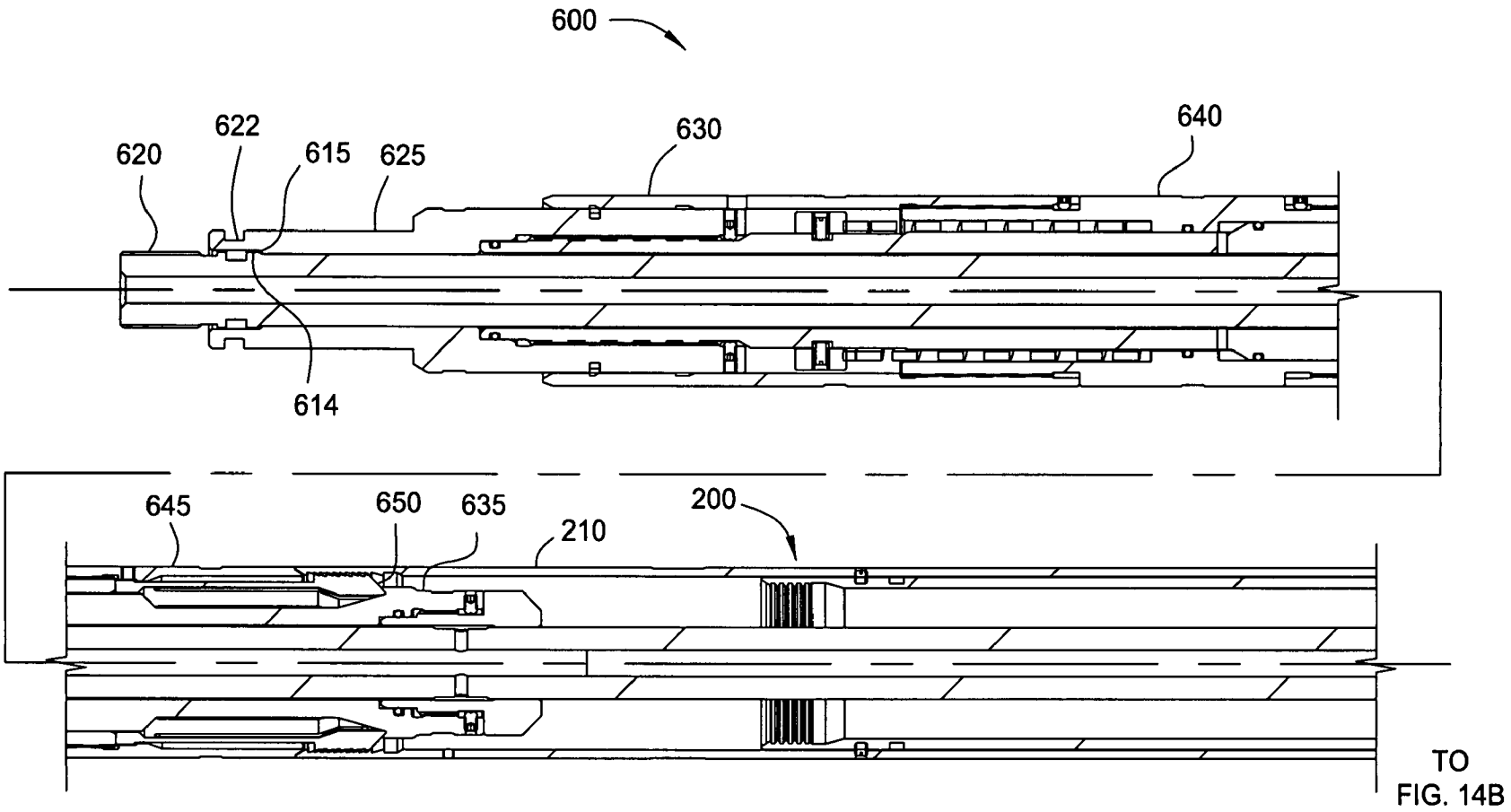
FIG. 14A
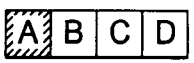

A B C D

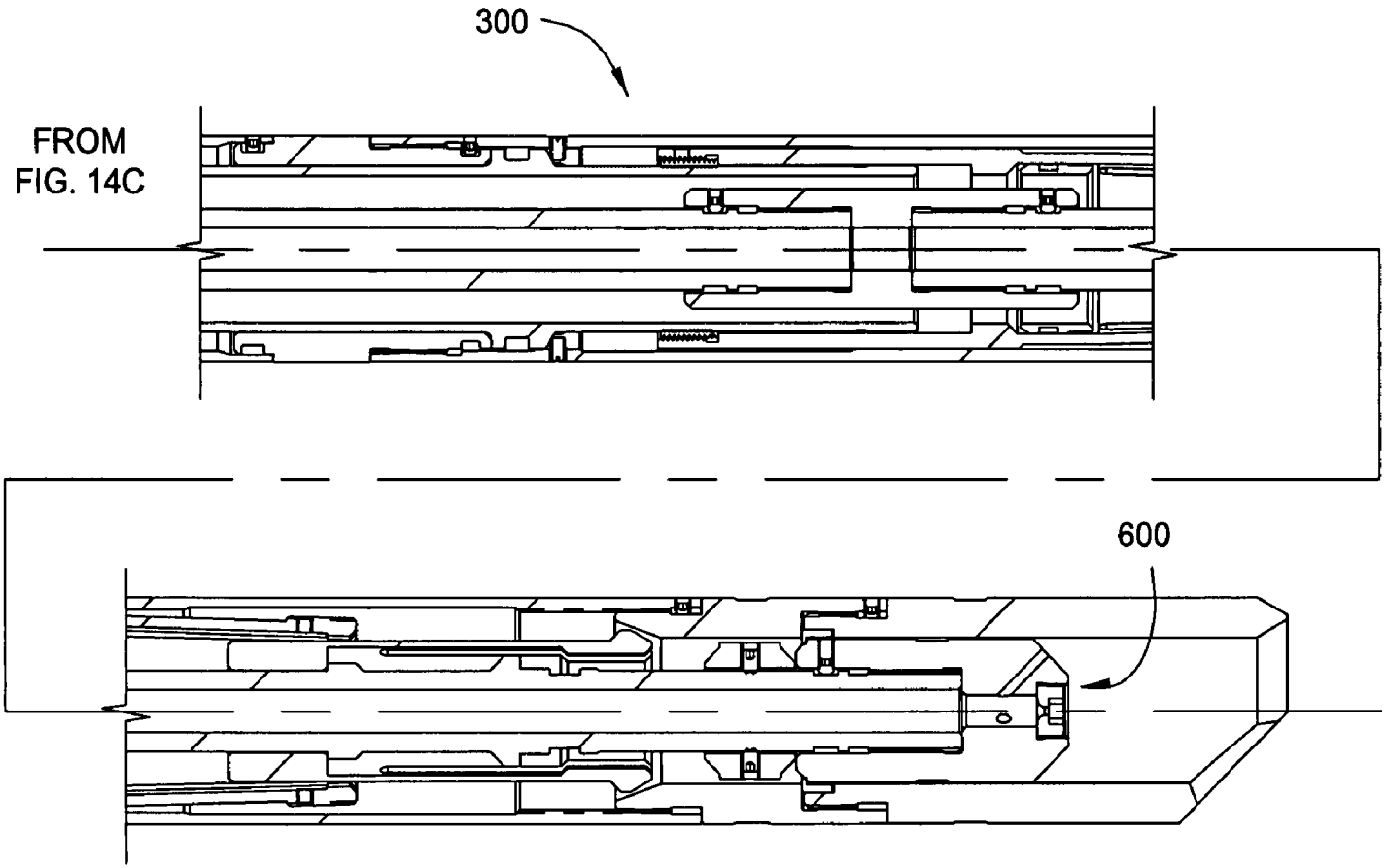
FIG. 14D
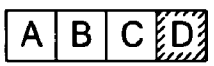

METHOD AND APPARATUS FOR A PACKER ASSEMBLY

BACKGROUND OF THE INVENTION

1. Field of the Invention

Embodiments of the invention are related to setting a packer assembly in a wellbore in a single trip into a wellbore. Embodiments of the invention are also related to retrieving the packer assembly from the wellbore using a retrieval tool in a single trip into the wellbore. Embodiments of the invention are further related to releasing the retrieval tool from the packer assembly while in the wellbore during a retrieval process in the event that the packer assembly will not release from the wellbore or otherwise becomes wedged in the wellbore and is prevented from removal.

2. Description of the Related Art

A packer assembly, such as a straddle system, has typically been used to isolate an area of interest in a wellbore formation to conduct various downhole operations, such as fracturing operations or other wellbore treatment operations. In one example, the packer assembly is located adjacent the area of interest, an upper packer is actuated into sealing engagement with the surrounding wellbore above the area of interest, and then a lower packer is actuated into sealing engagement with the surrounding wellbore below the area of interest, thereby "straddling" the area of interest. In another example, the packer assembly may include only one packer that is used to isolate the area of interest in the formation. A downhole operation may be conducted with the isolated formation.

The entire packer assembly, however, is located in the wellbore in multiple sections, requiring (costly and time consuming) multiple trips into the wellbore. For example, the lower packer may be located in the wellbore in one trip, and then the upper packer may be located in the wellbore in a second subsequent trip. Some packer assemblies may be lowered into a wellbore in a single trip, but these packer assemblies require concentric mandrel configurations to operate the upper and lower packers downhole. Such concentric mandrel configurations prevent the use of other fluid flow devices, such as a sliding sleeve, a safety valve, a side pocket mandrel, etc., between the upper and lower packers that may be utilized in certain downhole operations, limiting the flexibility of the packer assembly.

Retrieving the packer assemblies described above has also proven difficult. A retrieval tool is generally lowered into the wellbore and attached to the packer assembly to release and retrieve the packer assembly from the wellbore. Multiple trips into the wellbore may be necessary to remove the entire packer assembly from the wellbore. During the retrieval process, sometimes the packer assembly will not release from the wellbore or becomes jammed in the wellbore as it is being removed. In such situations, since the retrieval tool is generally incapable of releasing from the packer assembly, both the retrieval tool and the packer assembly require subsequent emergency recovery trips into the wellbore.

Therefore, there is a need for a packer assembly that can be located in and retrieved from a wellbore in a minimal number of trips into the wellbore. Therefore, there is also a packer assembly that can be integrated with other flow devices to enhance the flexibility of the assembly. There is a further need for a retrieval tool that can release from a packer assembly during a retrieval process in the event that the packer assembly is prevented from removal from the wellbore.

SUMMARY OF THE INVENTION

In one embodiment, an assembly for isolating an area of interest in a wellbore includes an upper packer assembly, a lower packer assembly, and a tubular member coupled to the upper and lower packer assemblies to space apart the upper and lower packer assemblies. The upper packer assembly is operable to sealingly engage the wellbore using a mechanical force that is transferred from the lower packer assembly and the tubular member.

In one embodiment, a method of isolating an area of interest in a wellbore includes positioning a straddle assembly adjacent the area of interest using a conveyance member in a single trip into the wellbore. The straddle assembly includes an upper packer assembly, a lower packer assembly, and a setting assembly coupled to the upper and lower packer assemblies. The method may further include applying a first mechanical force to the straddle assembly using the setting assembly to actuate a gripping member into engagement with the wellbore and applying a second mechanical force to the upper packer assembly using the setting assembly to actuate a packing element of the upper packer assembly into engagement with the wellbore. The first mechanical force is applied to the upper packer assembly in a direction opposite from the second mechanical force. The method may further include applying a third mechanical force to the lower packer assembly using the setting assembly to actuate a packing element of the lower packer assembly into engagement with the wellbore.

In one embodiment, a method of retrieving a packer assembly having an upper packer and a lower packer from a wellbore using a retrieval tool includes lowering the retrieval tool in the wellbore using a conveyance member, engaging the upper packer with the retrieval tool, thereby forming a first connection, engaging the lower packer with the retrieval tool, thereby forming a second connection, applying a first mechanical force from the retrieval tool to the second connection to release the lower packer from engagement with the wellbore, applying a second mechanical force from the retrieval tool to the first connection to release the upper packer from engagement with the wellbore, and retrieving the packer assembly in a single trip into the wellbore.

In one embodiment, an apparatus for retrieving a packer assembly from a wellbore includes a body, a first latch member coupled to the body and adapted to disengage a first portion of the packer assembly from the wellbore, and a second latch member coupled to the body and adapted to disengage a second portion of the packer assembly from the wellbore. The apparatus is configured to retrieve the packer assembly from the wellbore in a single trip into the wellbore.

In one embodiment, an apparatus for retrieving a packer assembly from a wellbore includes a body and a latch member coupled to the body and adapted to engage the packer assembly from the wellbore. The latch member is operable to release the packer assembly from the wellbore. The apparatus may further include a support member coupled to the body and adapted to bias the latch member into engagement with the packer assembly. The support member is operable to disengage the latch member from the packer assembly.

In one embodiment, a method of unsetting a packer assembly from a wellbore includes engaging the packer assembly with a retrieval tool, wherein the packer assembly includes a connection providing a load path for operating the packer assembly, applying a force to a support member configured to maintain the connection, wherein the support member is isolated from the load path, and releasing the support member from the engagement, thereby unsetting the packer assembly.

In one embodiment, a packer assembly includes a body, a latch member coupled to the body, a sleeve coupled to the latch member, thereby forming an engagement for transmitting a force to operate the packer assembly, and a support member configured to couple the latch member to the sleeve, wherein the support member is coupled to the latch member using a releasable connection independent from the sleeve and isolated from the force, wherein release of the support member allows the latch member to disengage from the sleeve, thereby allowing unsetting of the packer assembly.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 7A-D is a cross-sectional view of the retrieval tool engaged with the packer assembly according to one embodiment of the invention.

FIGS. 8A-D is a cross-sectional view of the retrieval tool and the packer assembly in a first unset position according to one embodiment of the invention.

FIGS. 13A-D is a cross-sectional view of the retrieval tool engaged with the packer assembly according to one embodiment of the invention.

FIGS. 14A-D is a cross-sectional view of the retrieval tool and the packer assembly in a third release position according to one embodiment of the invention.

DETAILED DESCRIPTION

Figure 1A:
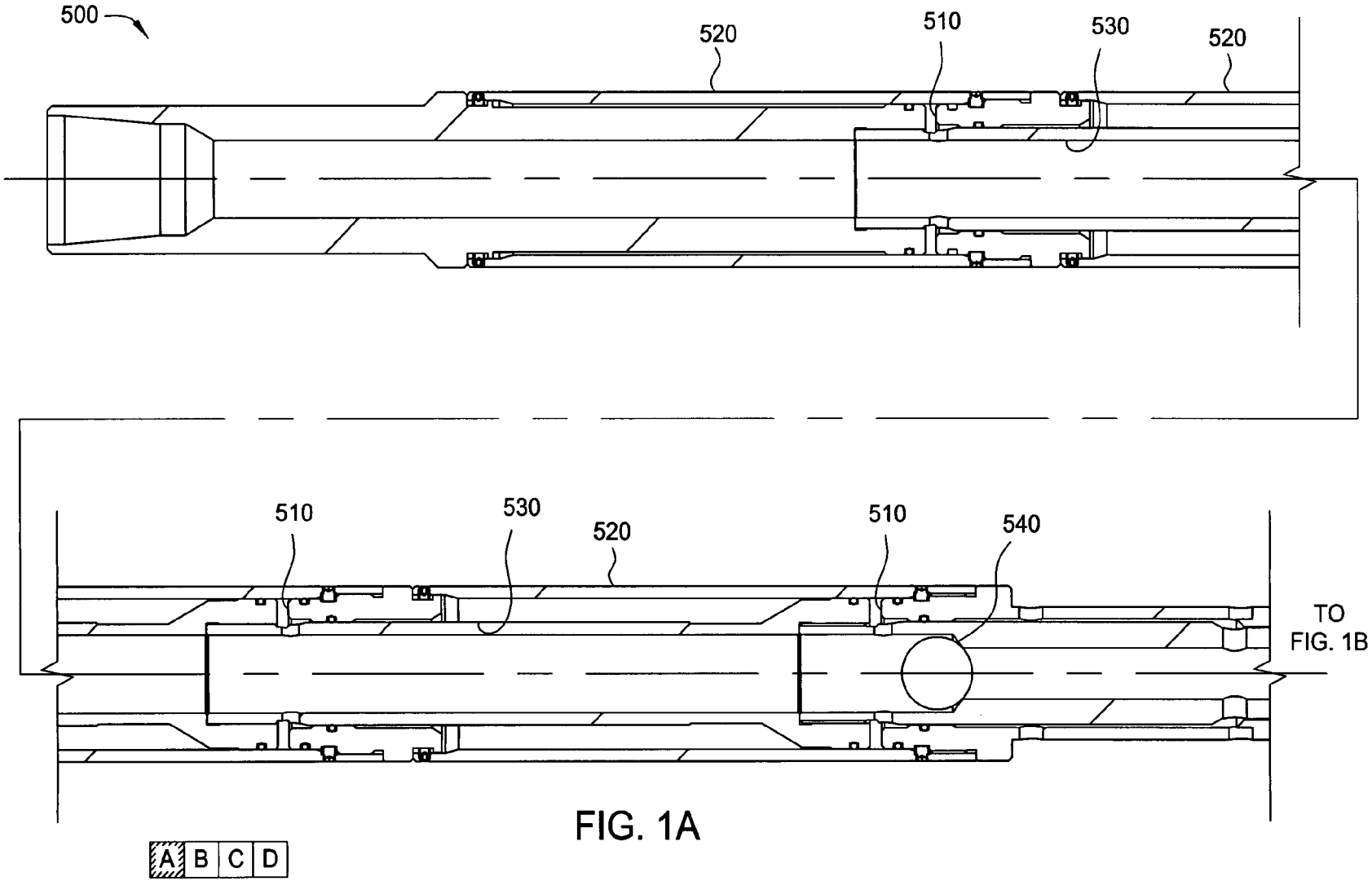
FIGS. 1A-D is a cross-sectional view of a packer assembly in a run-in position according to one embodiment of the invention.
Figure 1B:
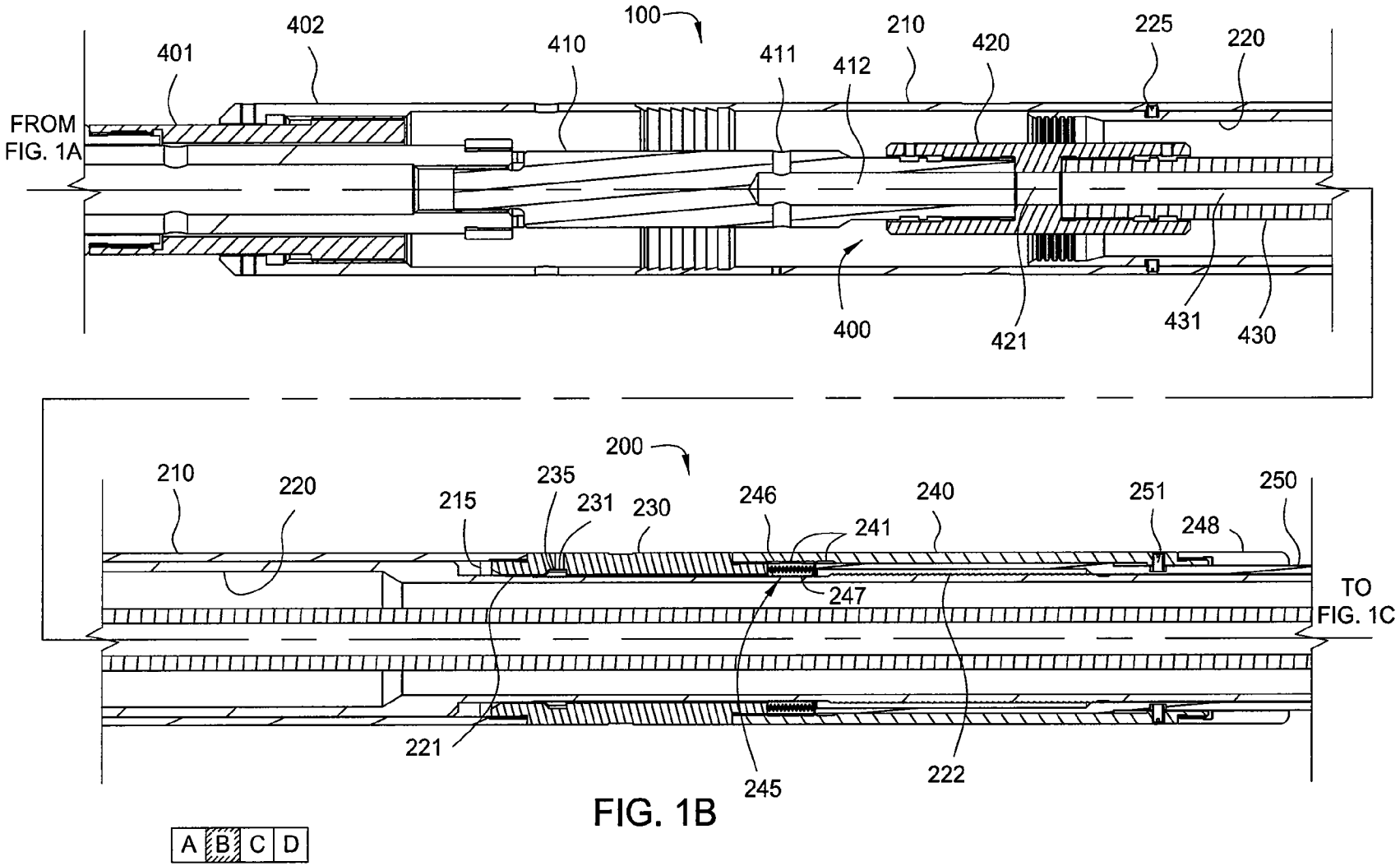
Figure 1C:
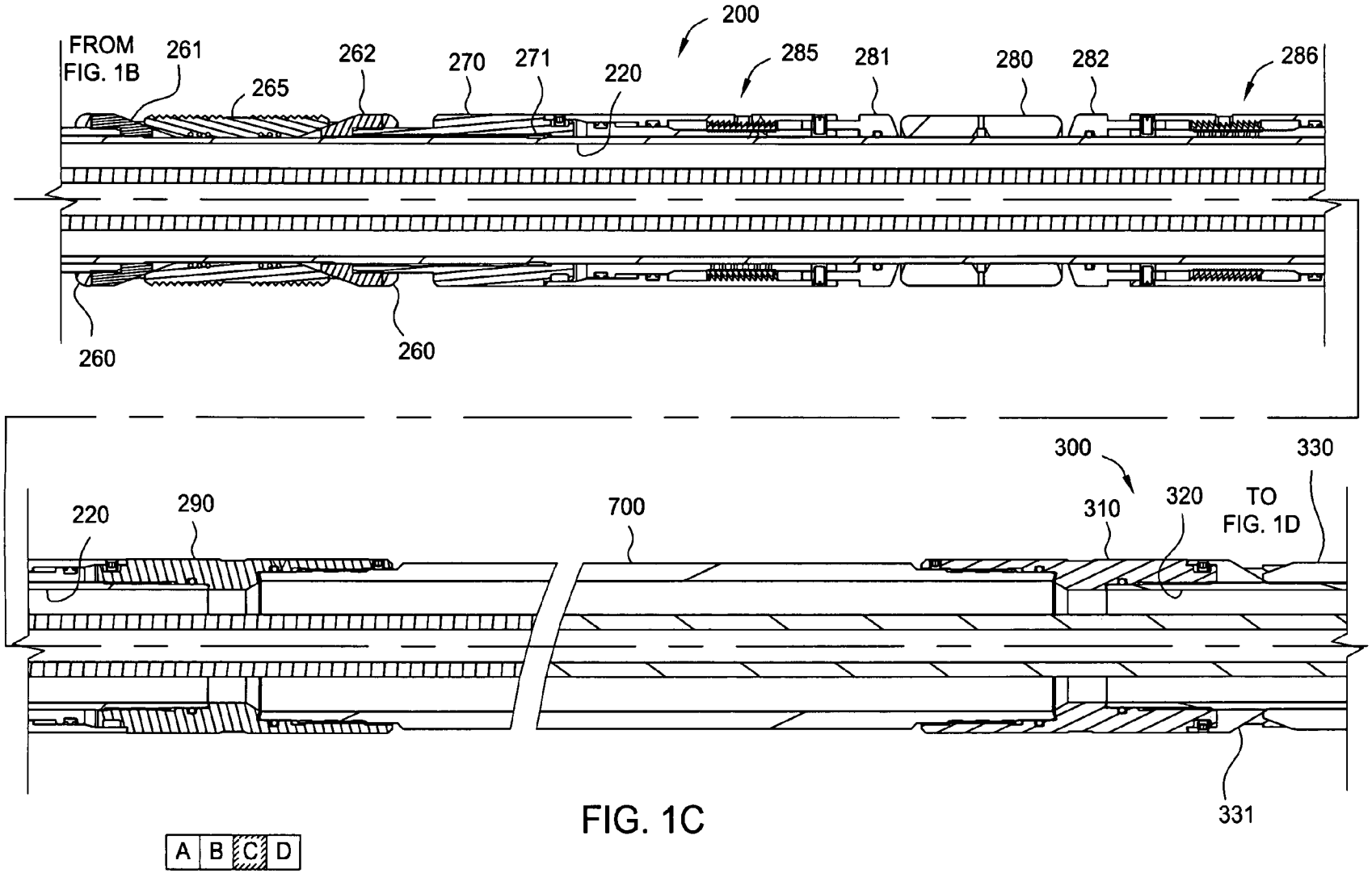
Figure 1D:
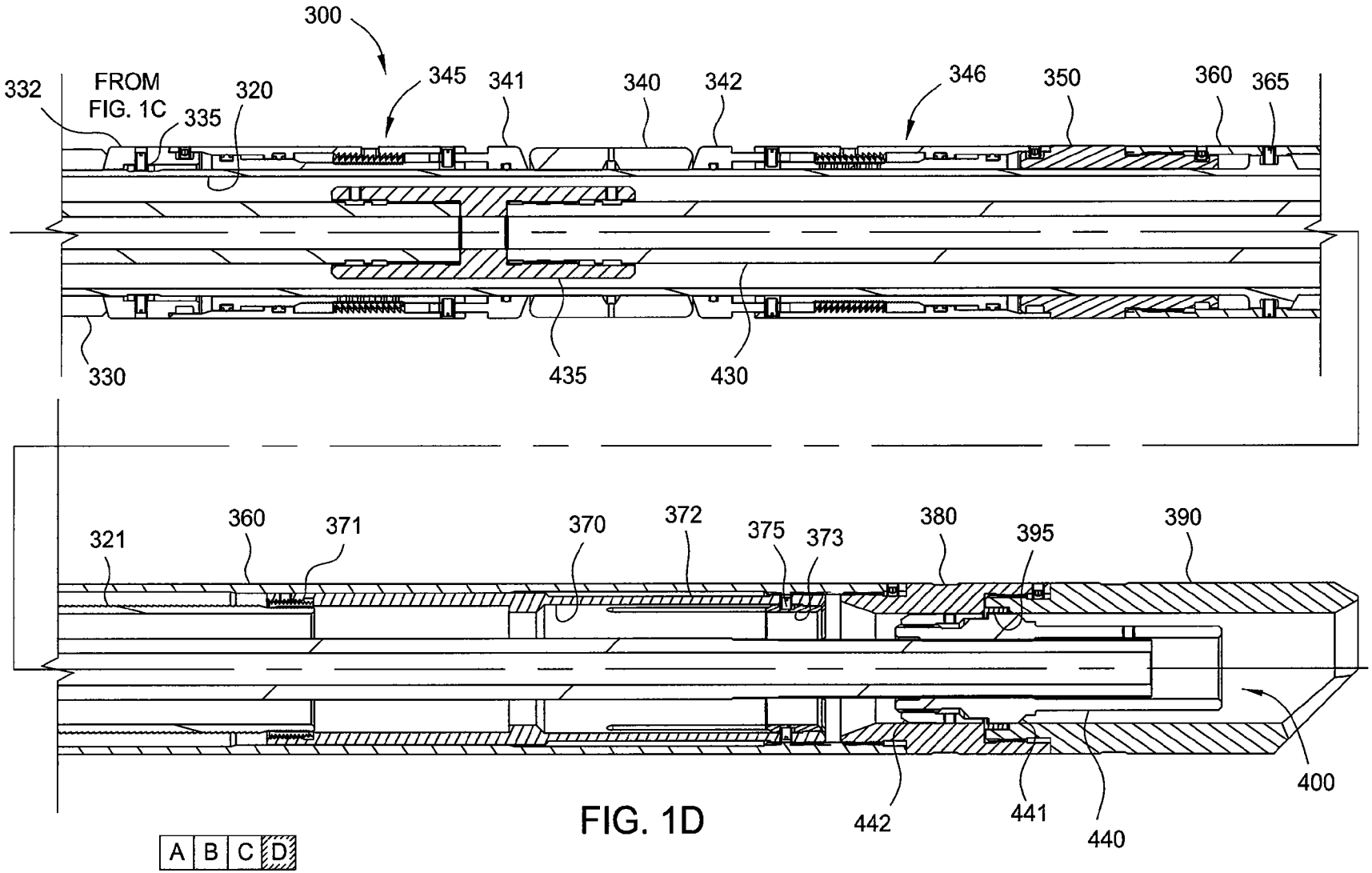
Figure 2A:
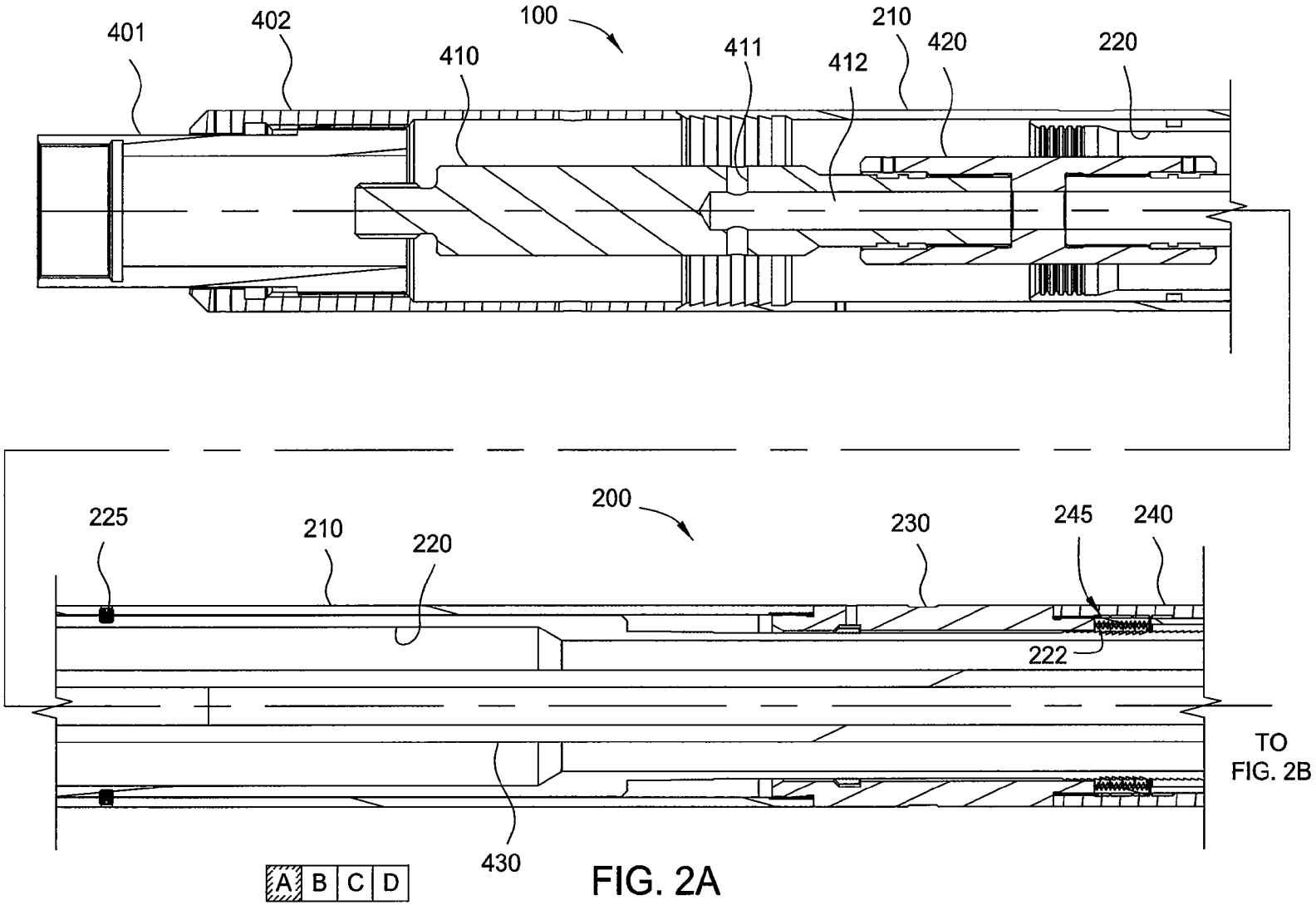
FIGS. 2A-D is a cross-sectional view of the packer assembly in a first setting position according to one embodiment of the invention.
Figure 2B:
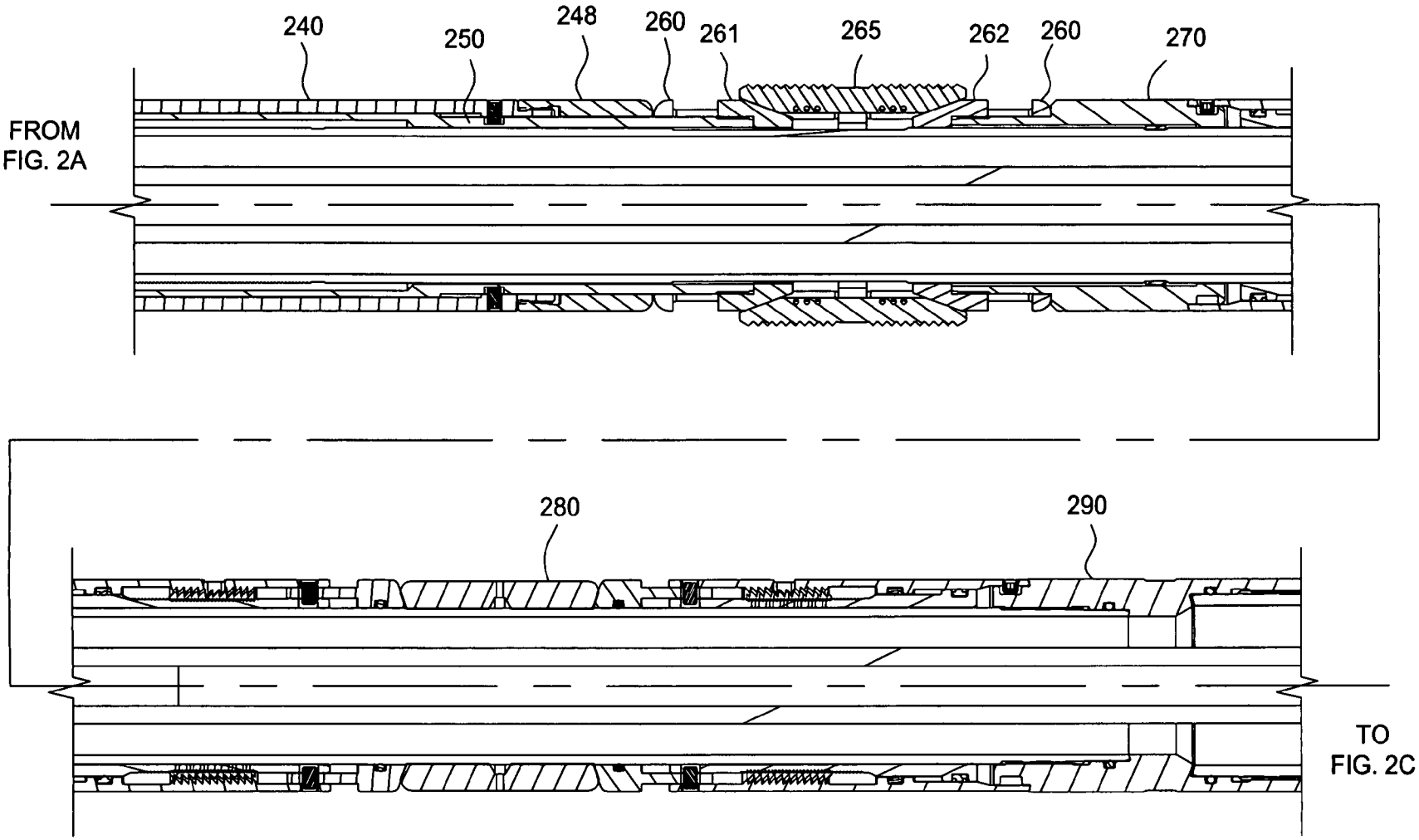
Figure 2C:
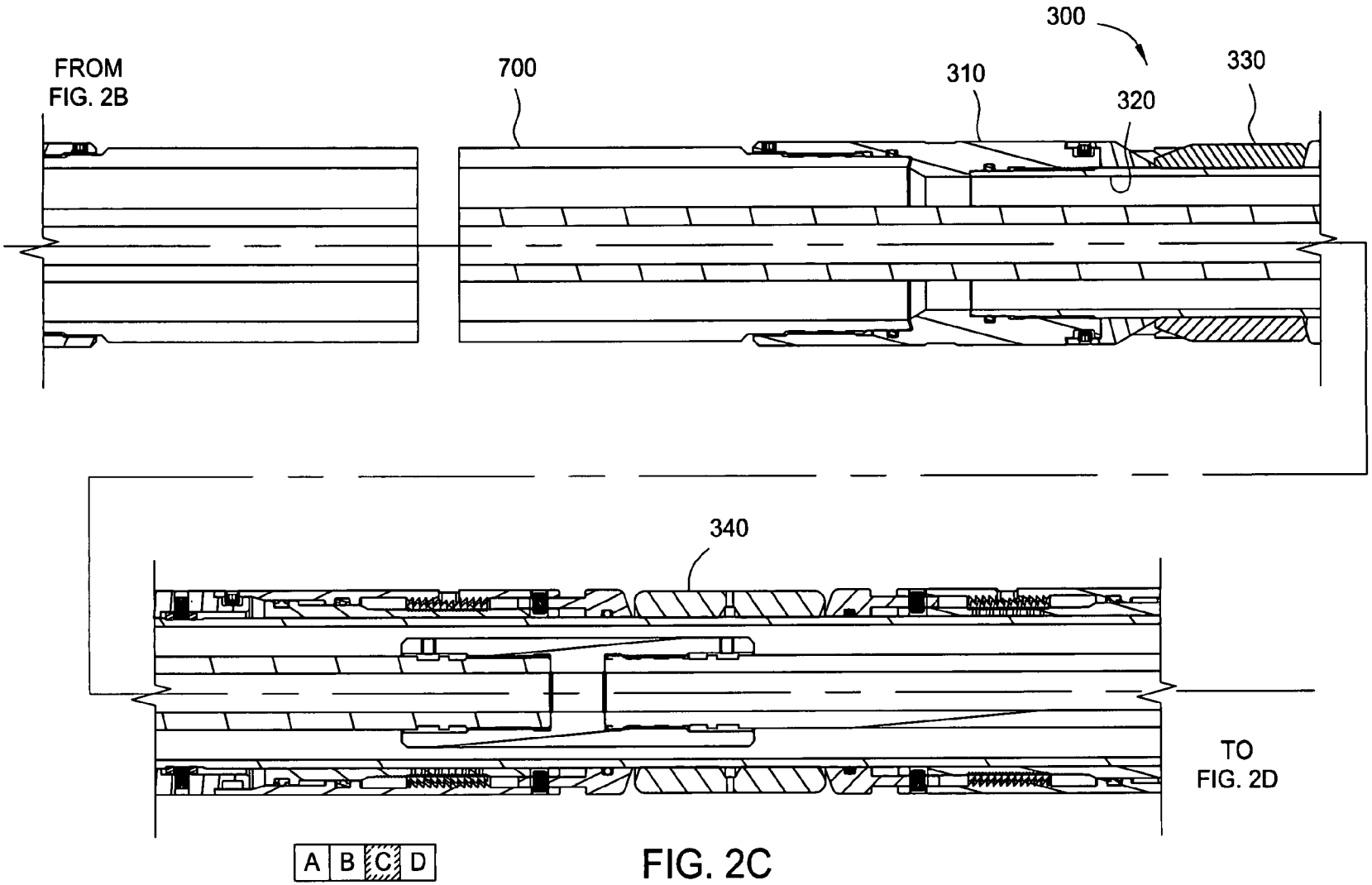
Figure 2D:
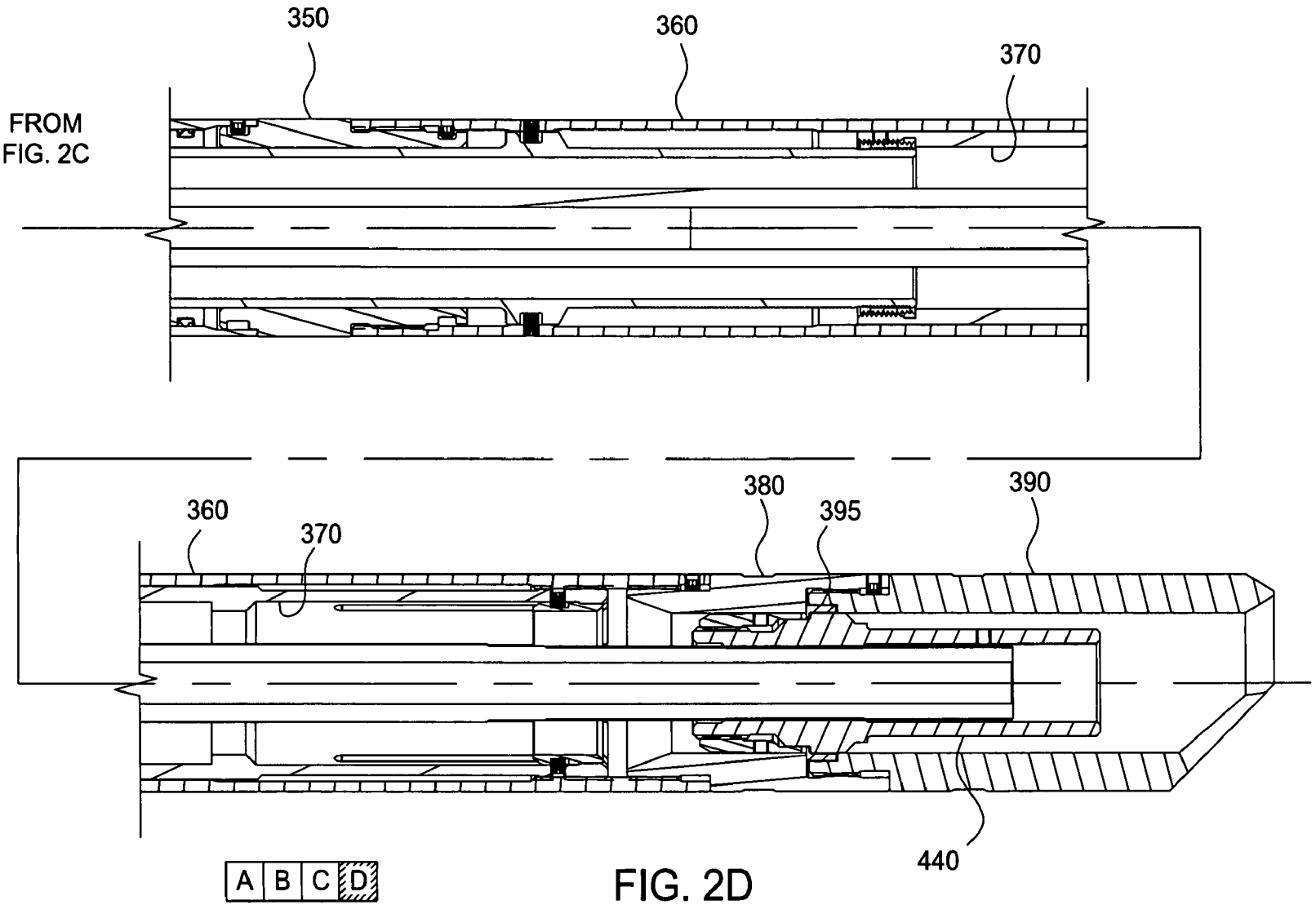
Figure 3A:
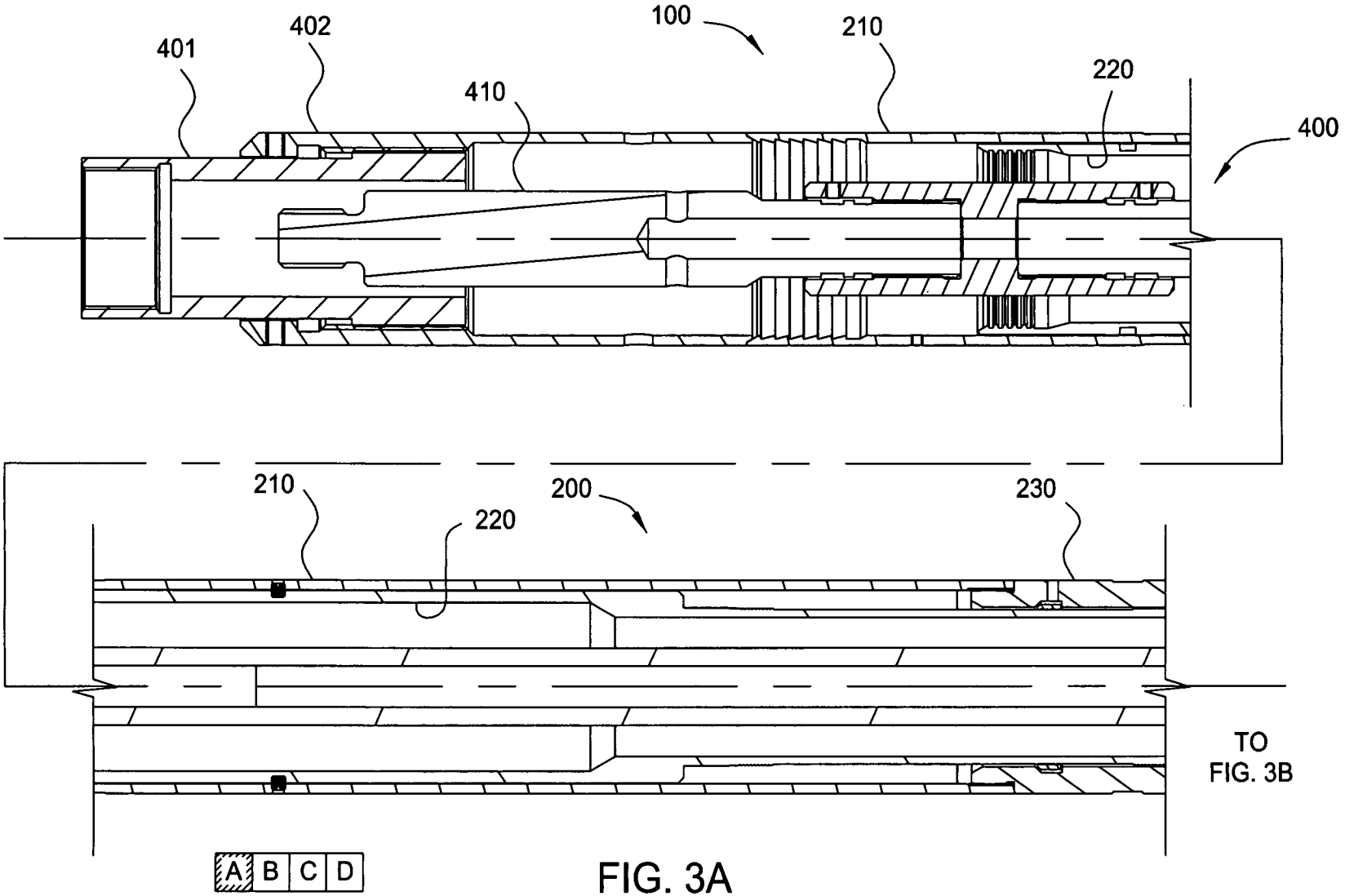
FIGS. 3A-D is a cross-sectional view of the packer assembly in a second setting position according to one embodiment of the invention.
Figure 3B:
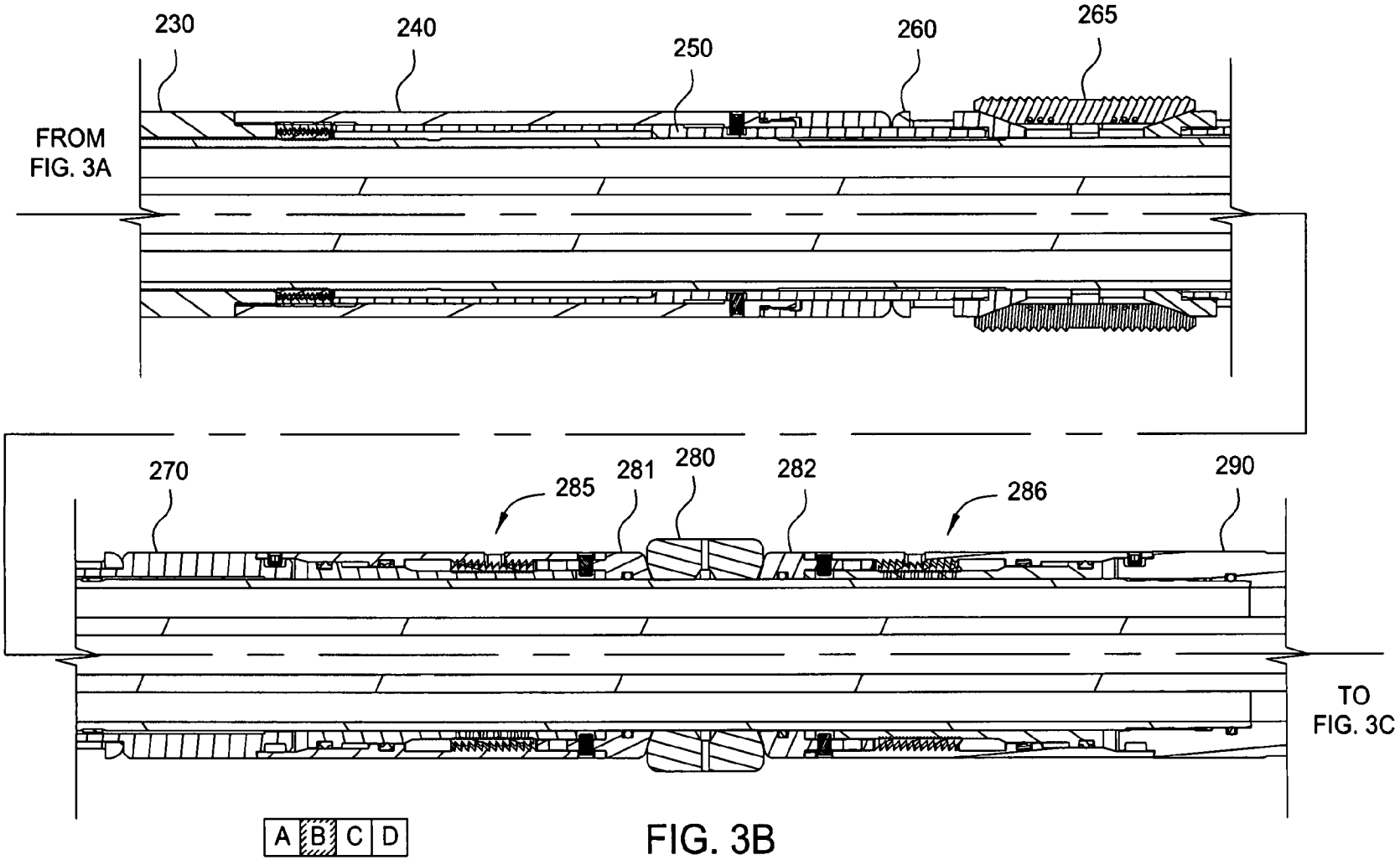
Figure 3C:
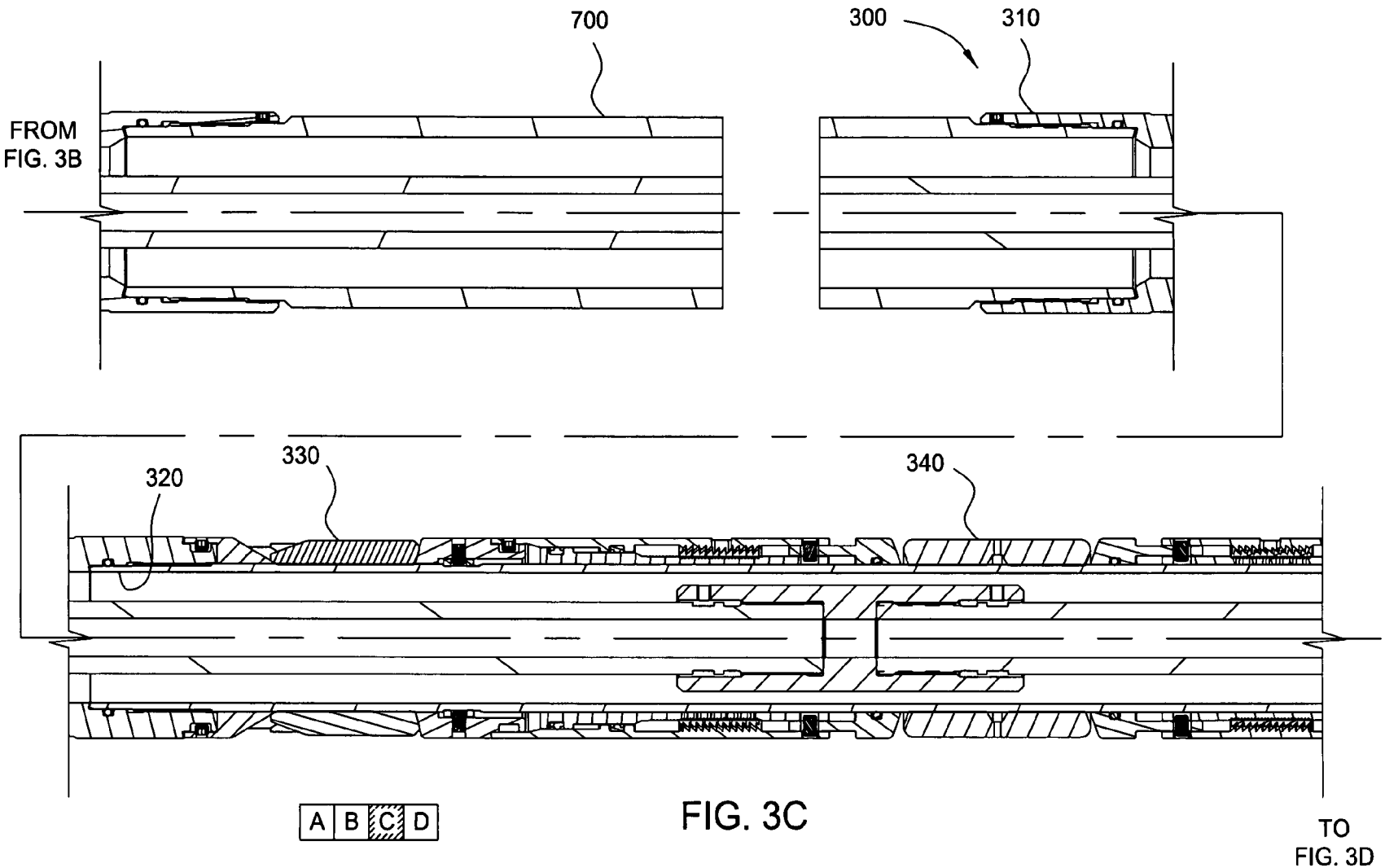
Figure 3D:
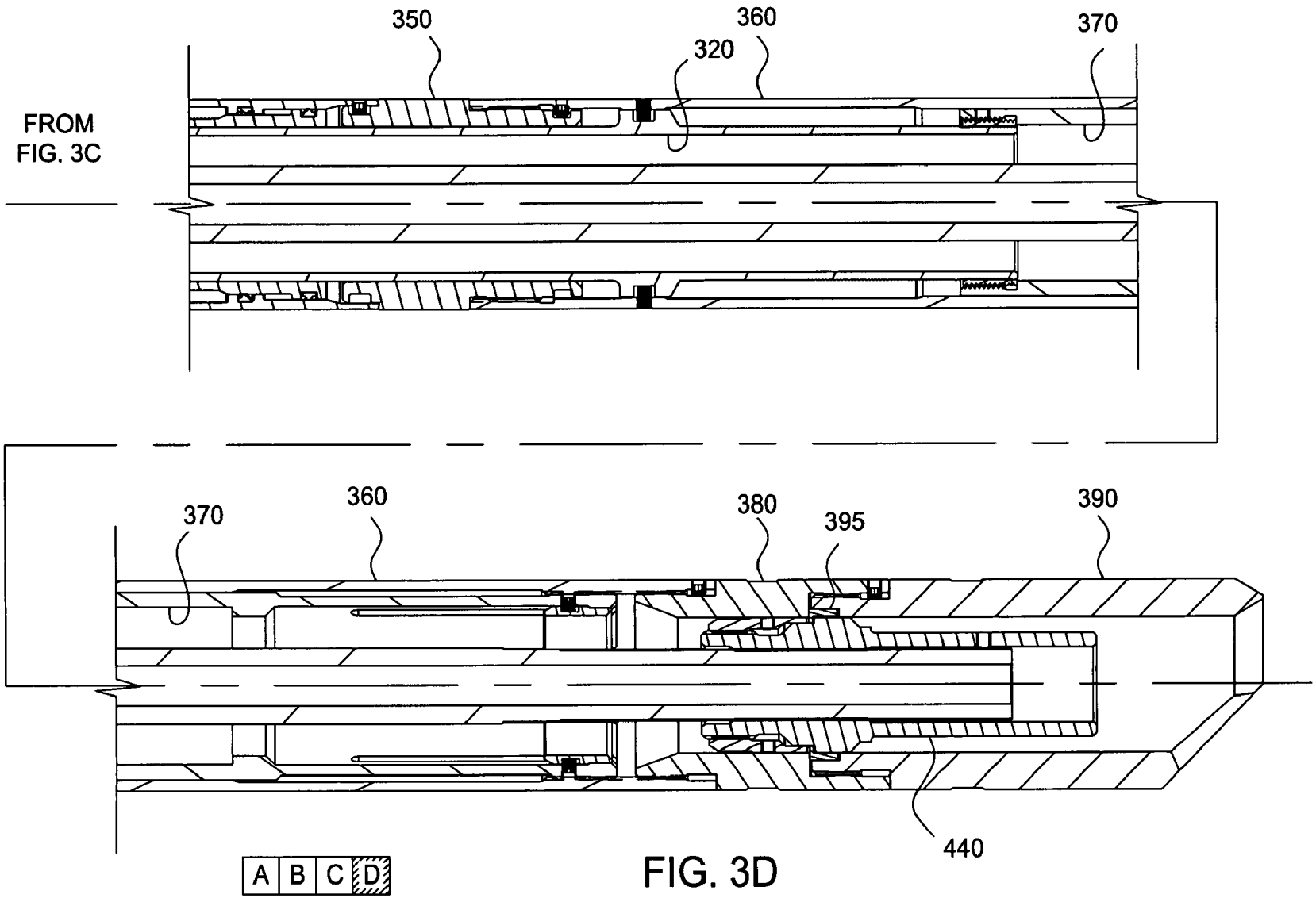
Figure 4A:
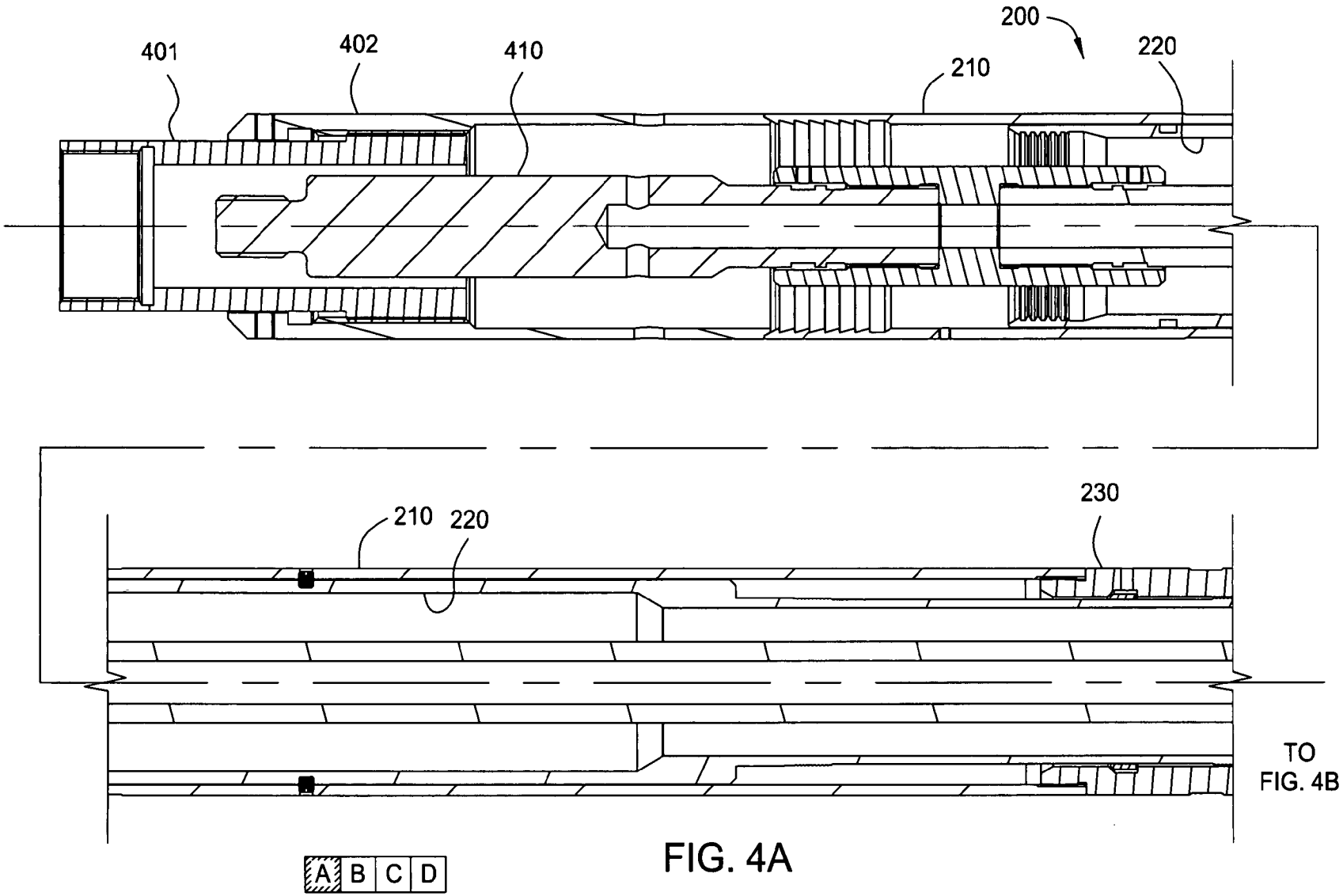
FIGS. 4A-D is a cross-sectional view of the packer assembly in a third setting position according to one embodiment of the invention.
Figure 4B:
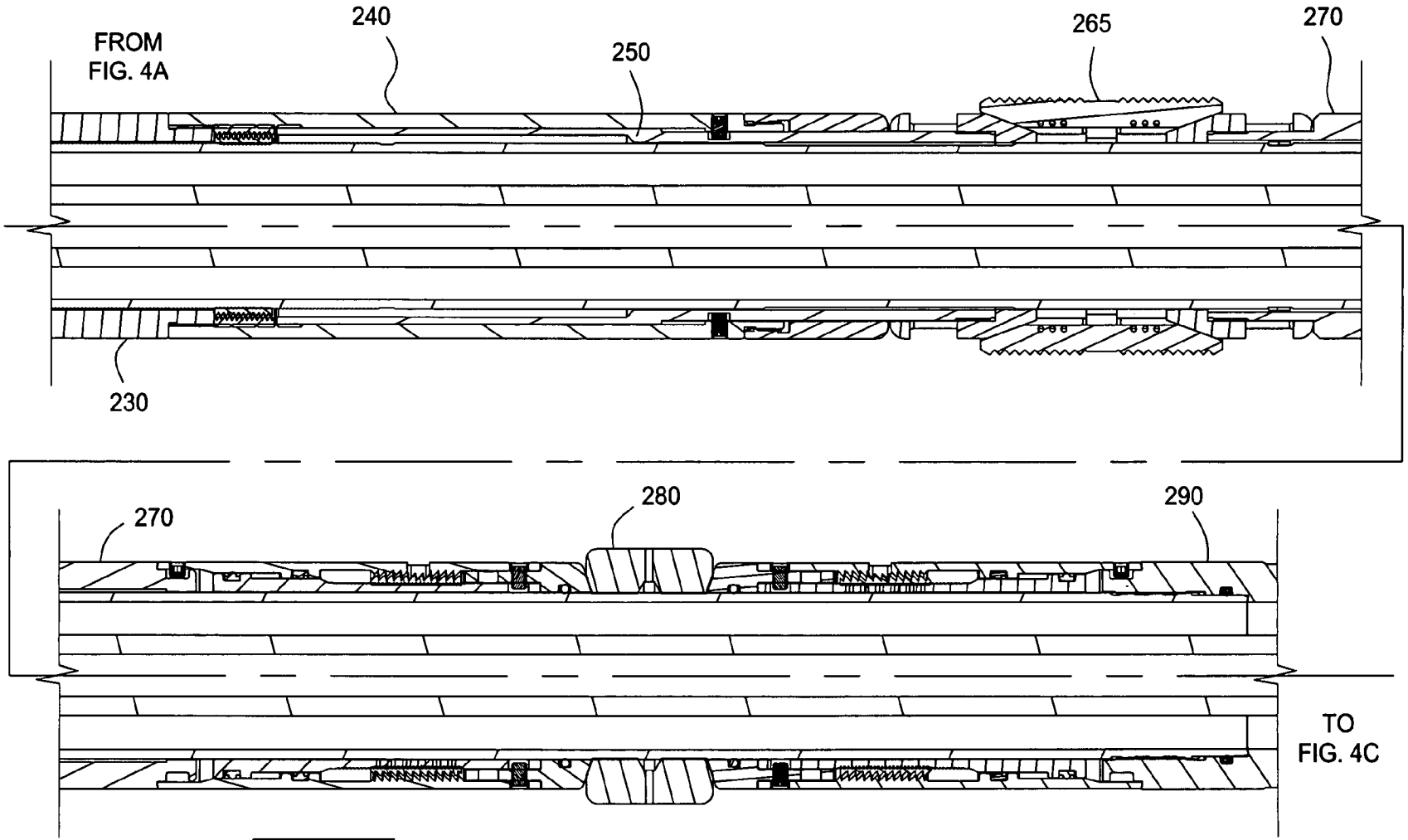
Figure 4C:
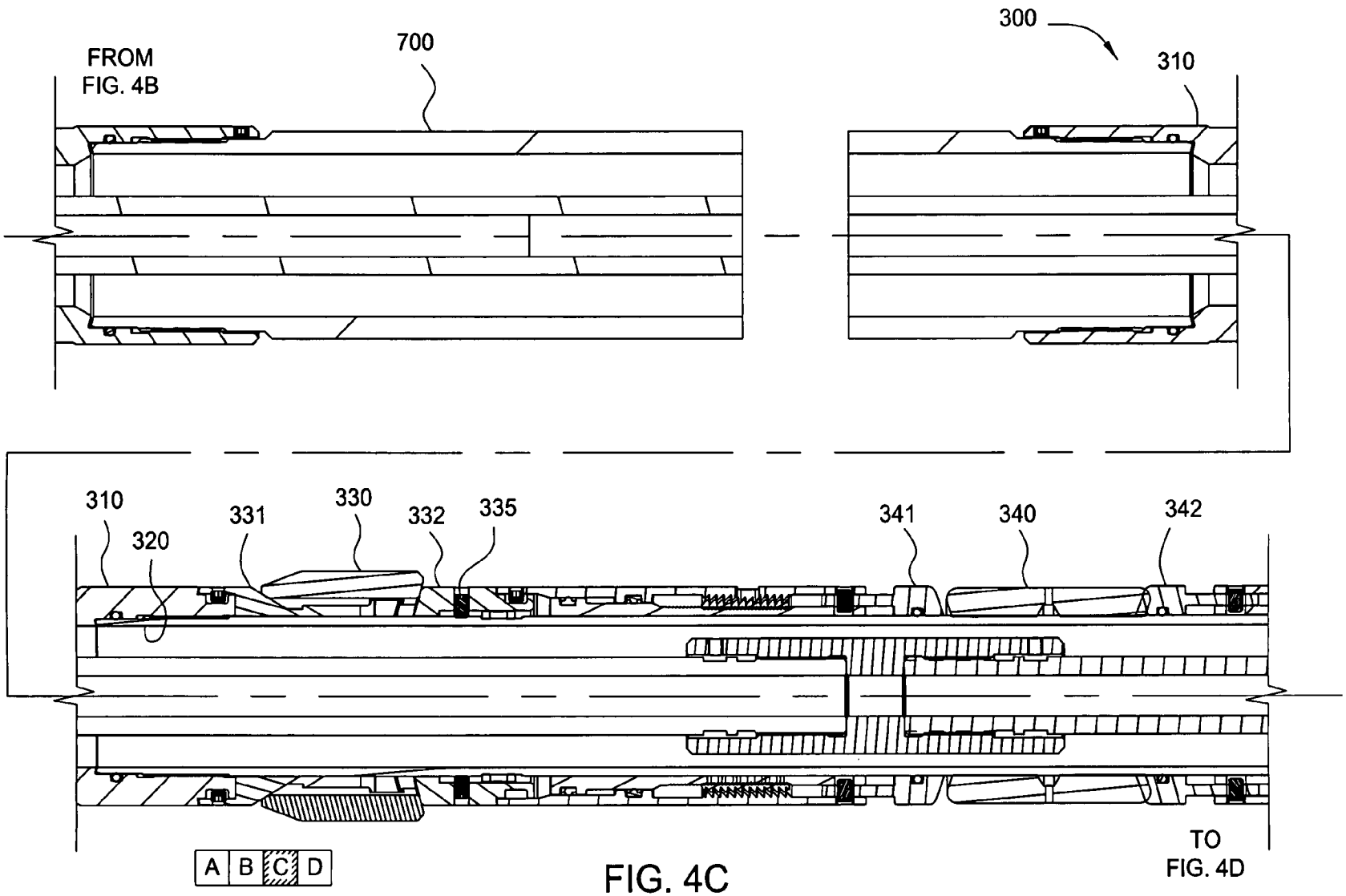
Figure 4D:
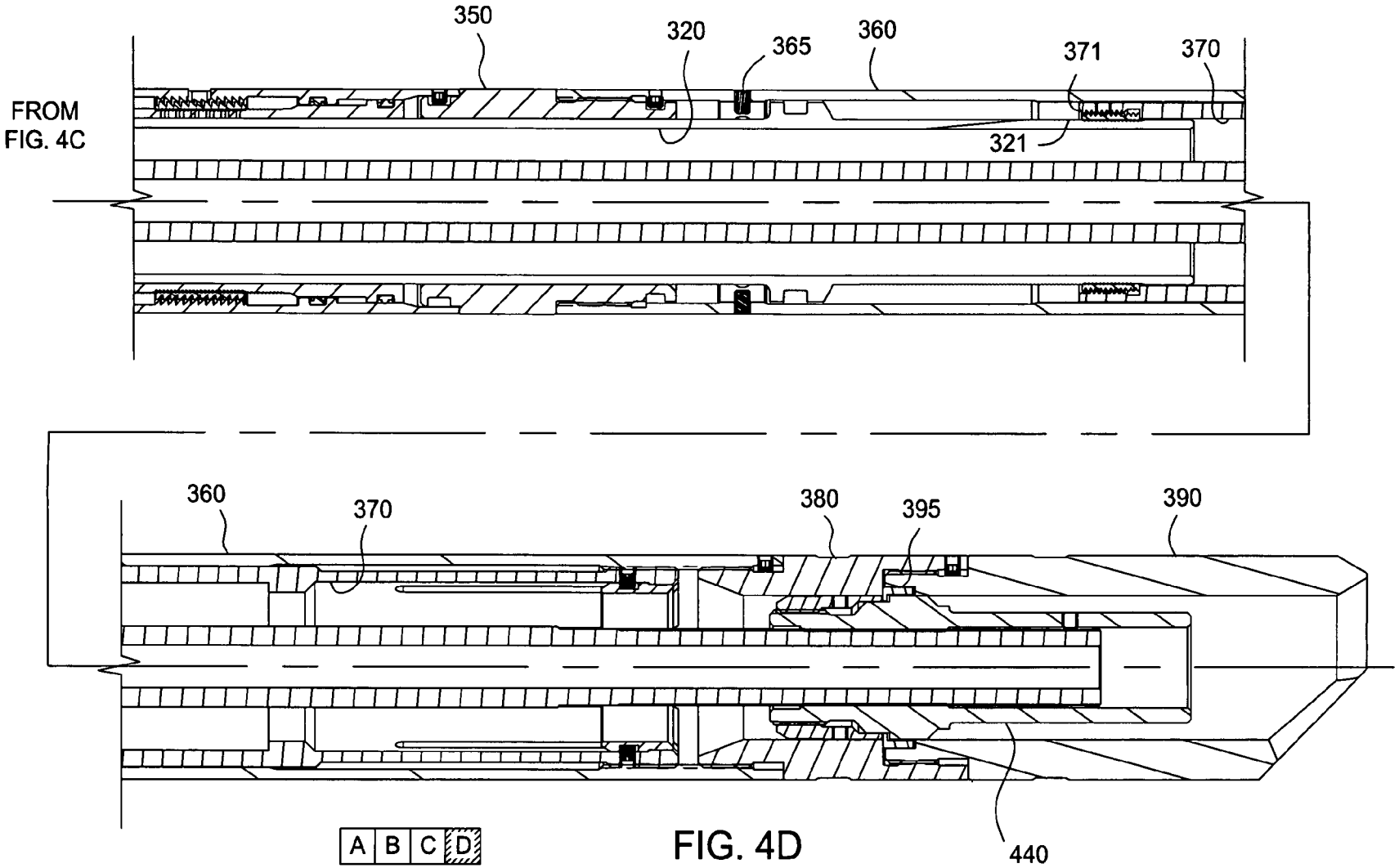
Figure 5A:
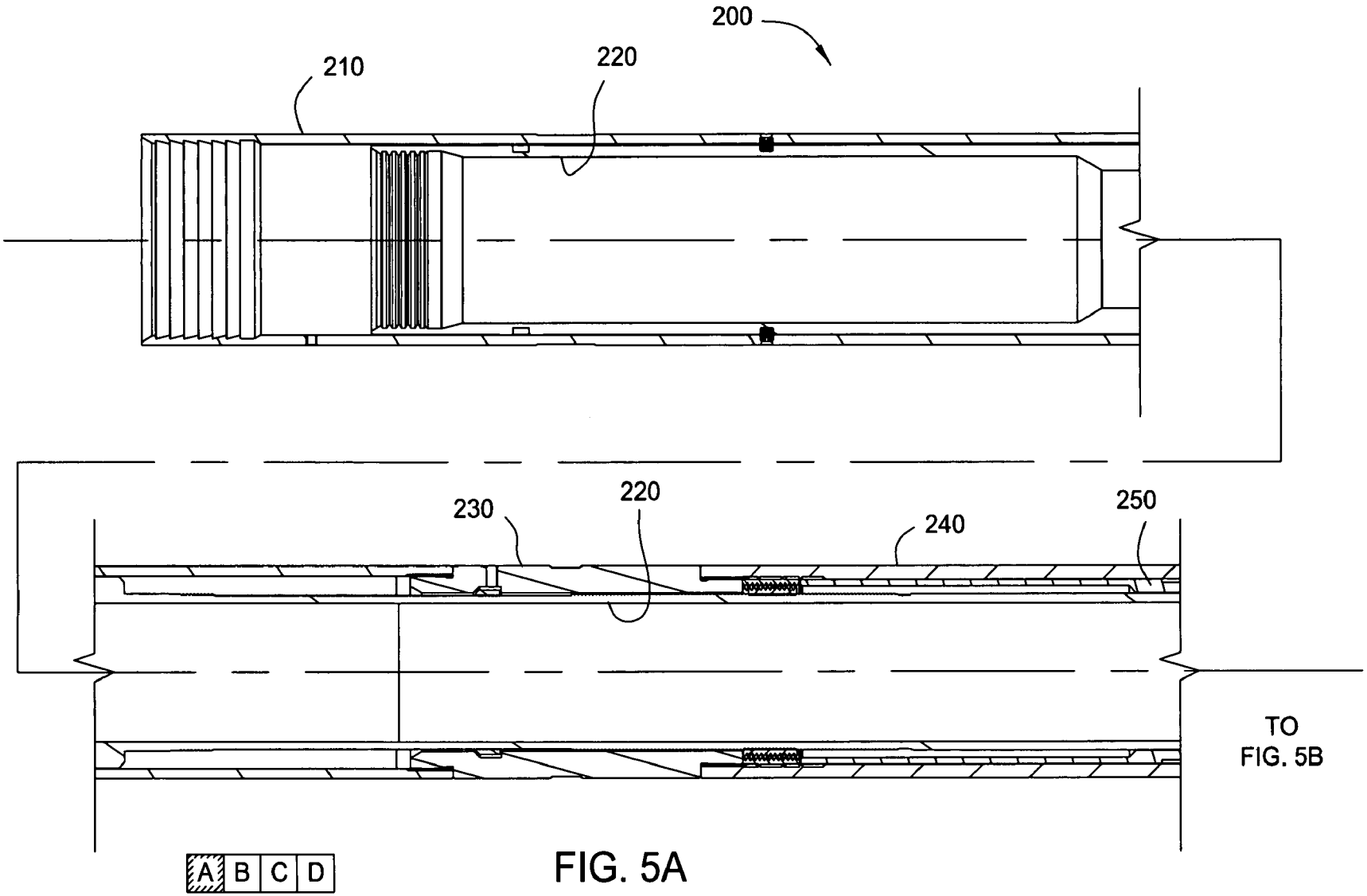
FIGS. 5A-D is a cross-sectional view of the packer assembly in a fourth setting position according to one embodiment of the invention.
Figure 5B:
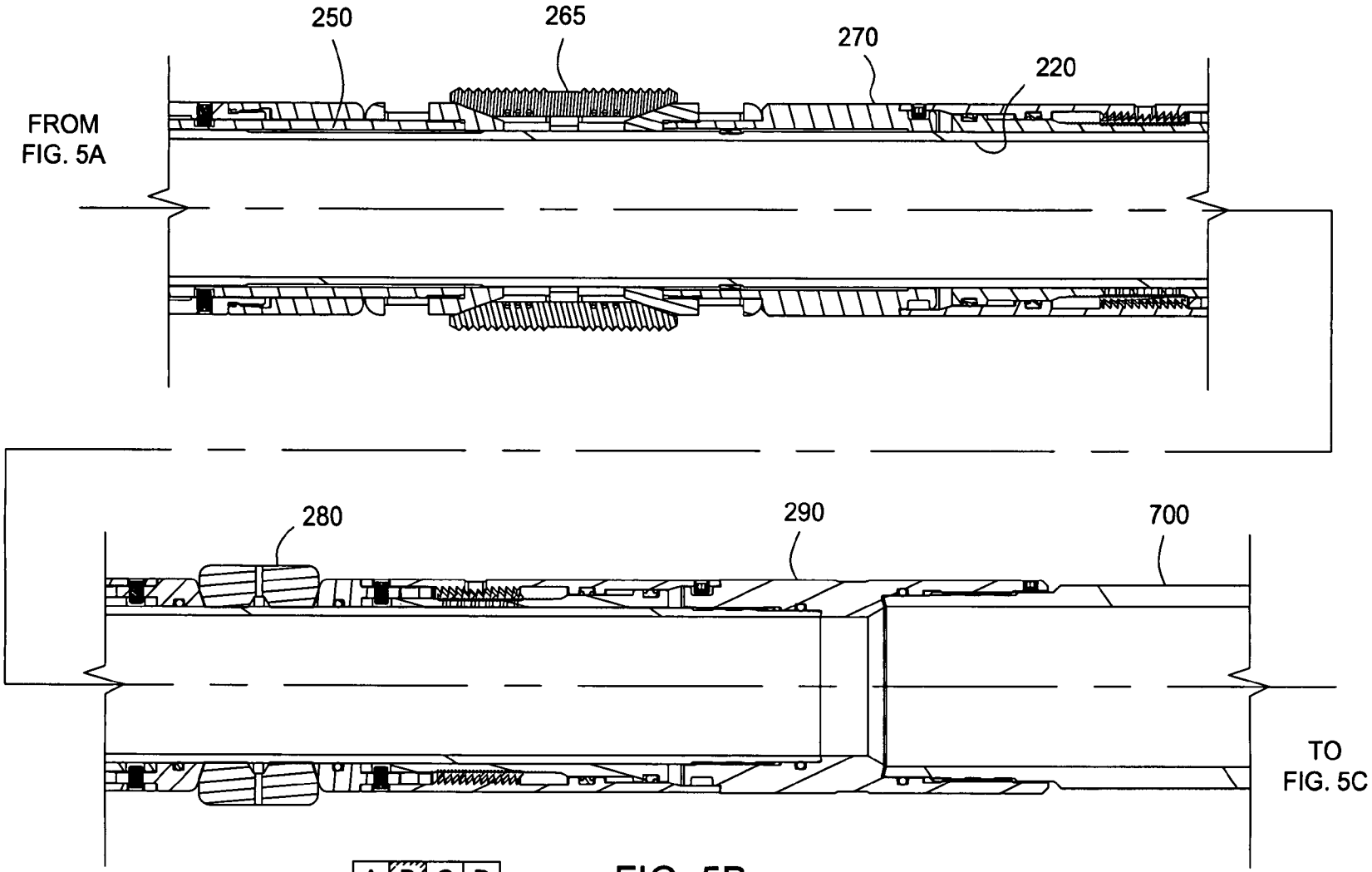
Figure 5C:
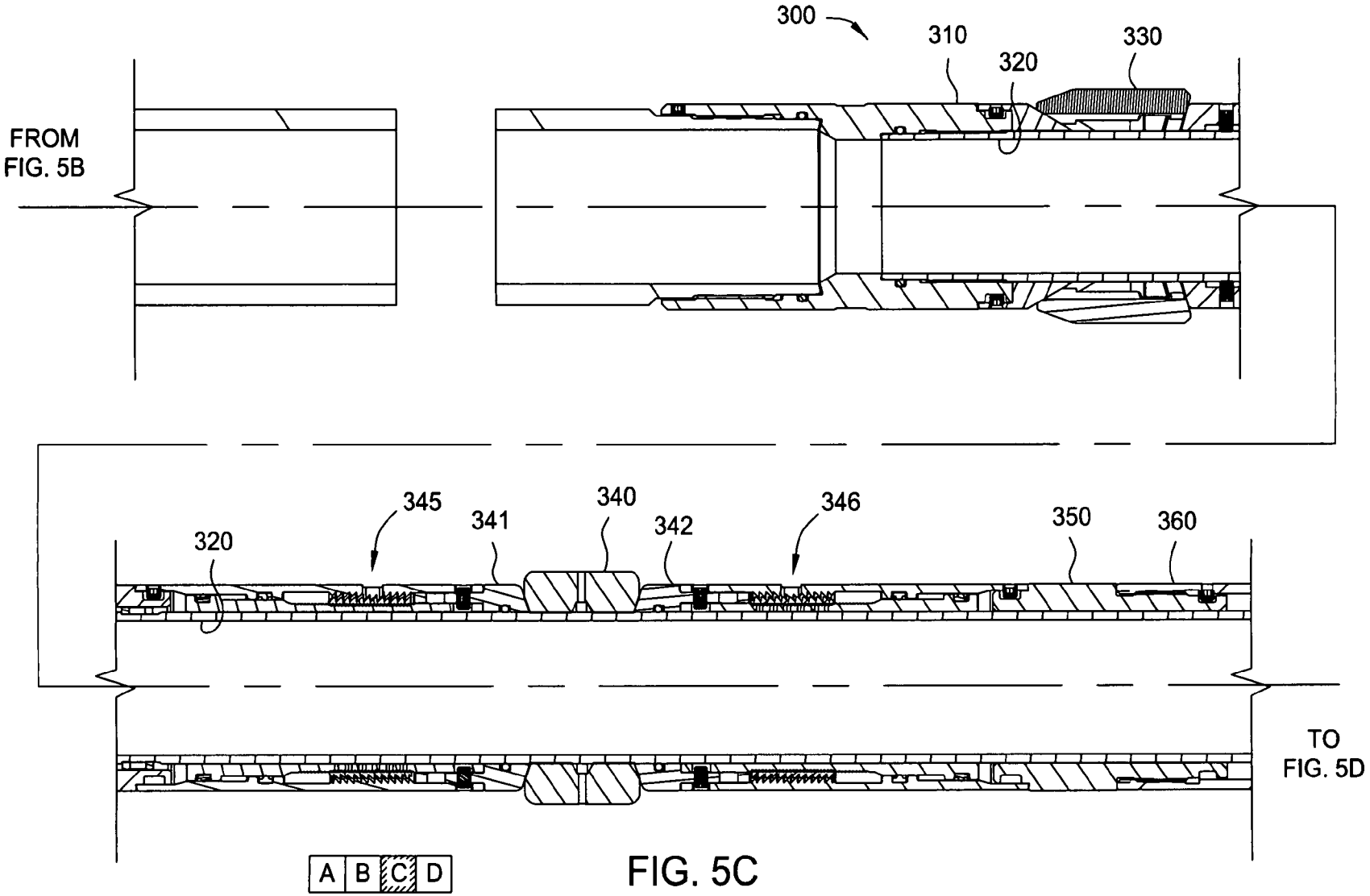
Figure 5D:
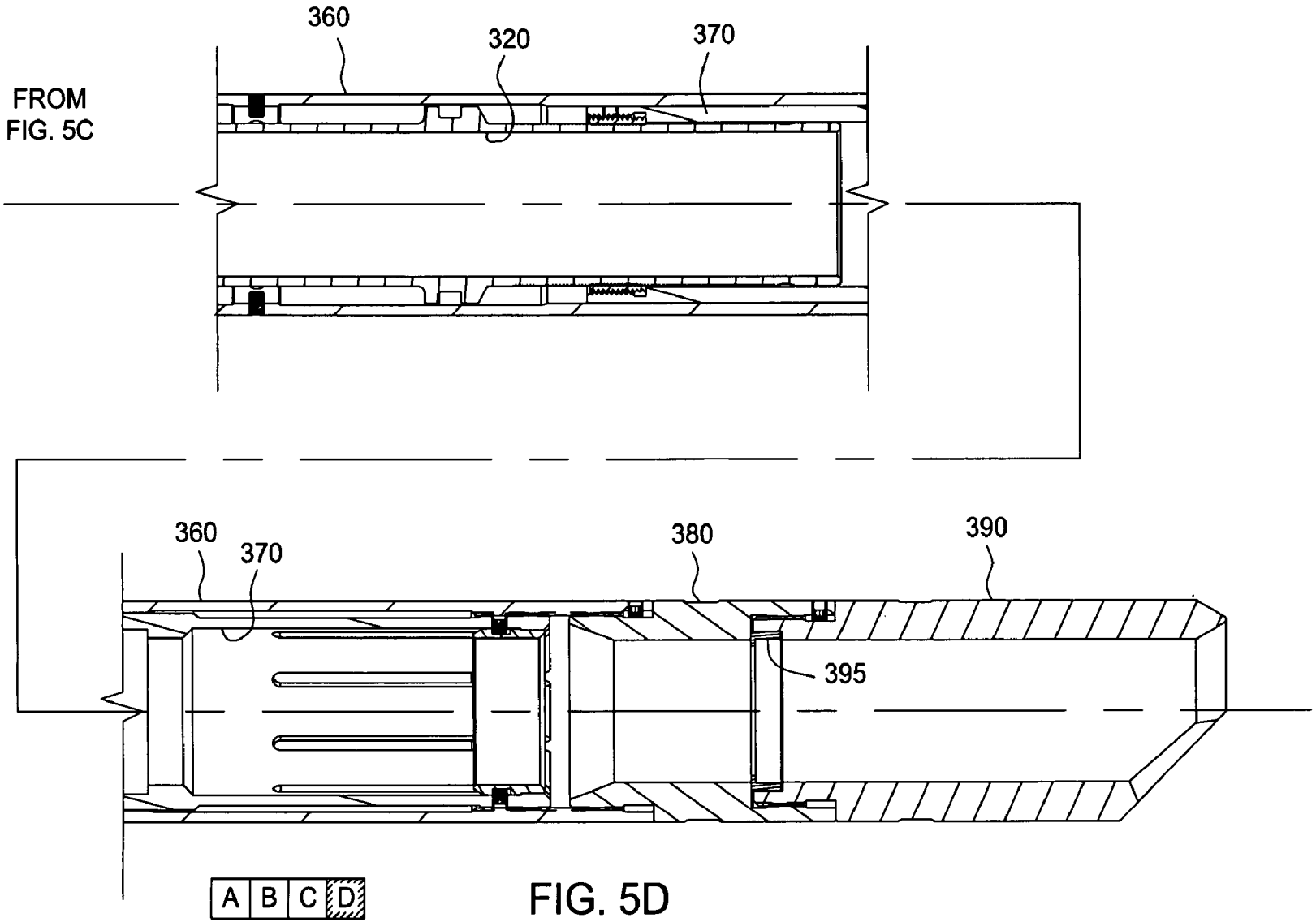
Figure 6A:
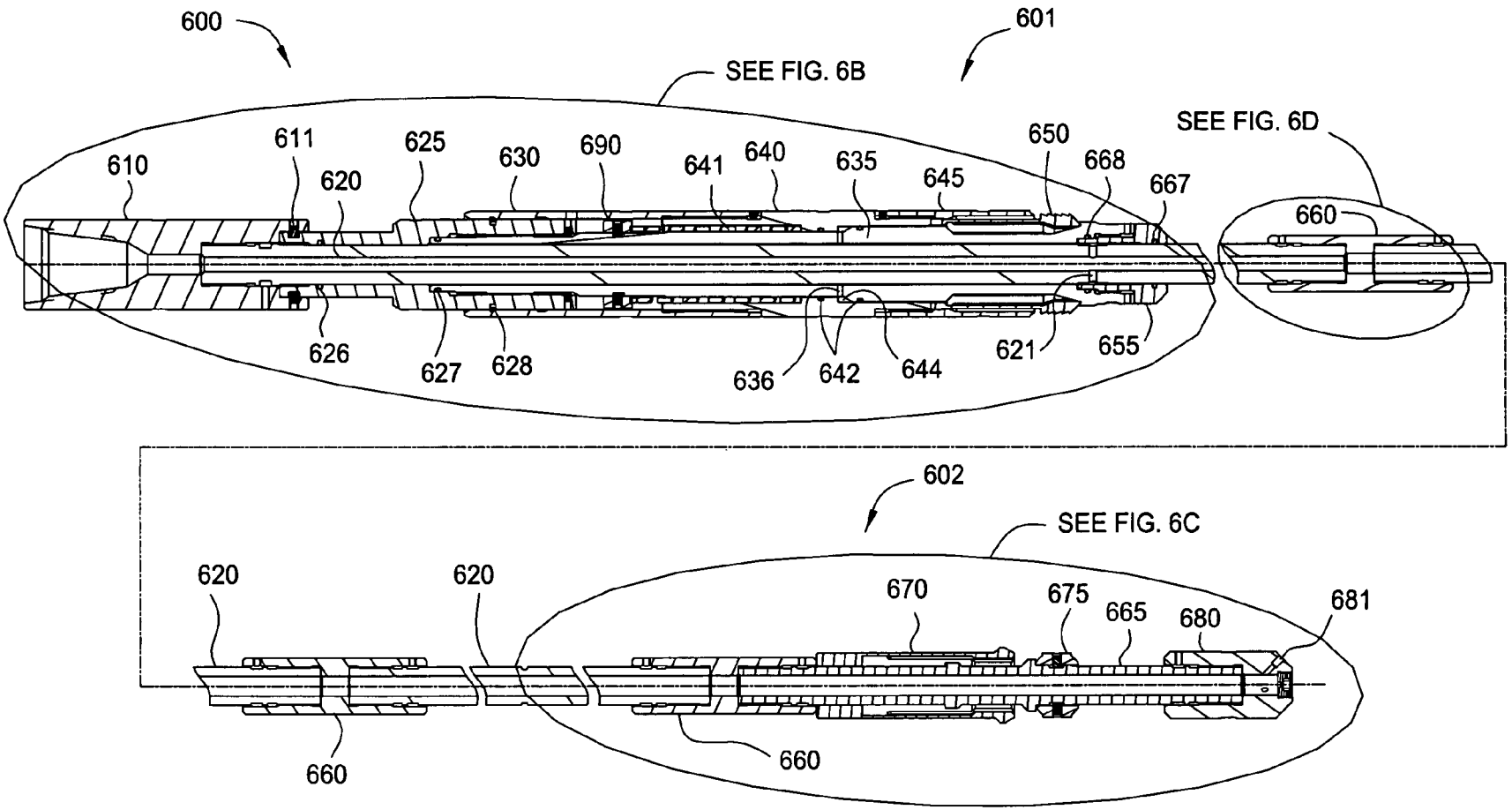
FIGS. 6A-D is a cross-sectional view of a retrieval tool according to one embodiment of the invention.
Figure 6B:
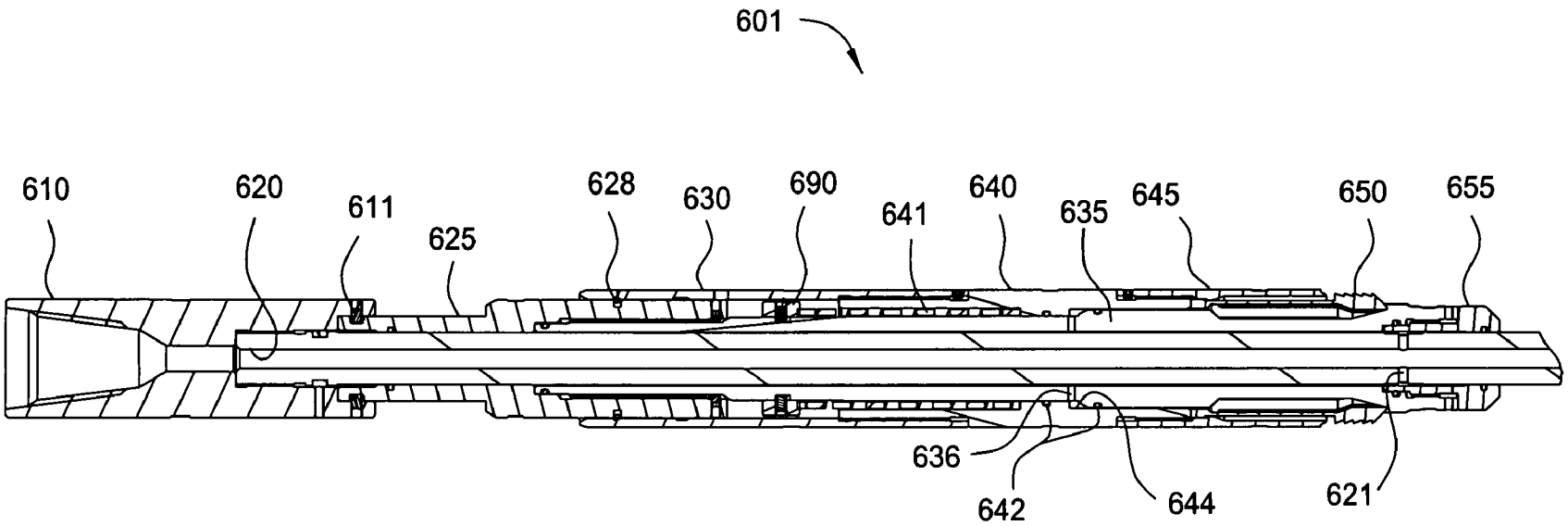
Figure 6C:
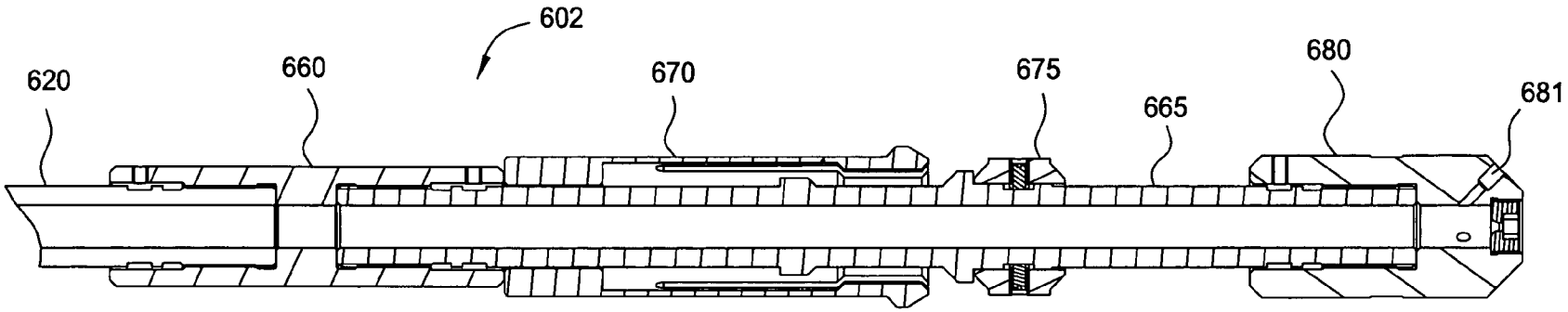
Figure 6D:
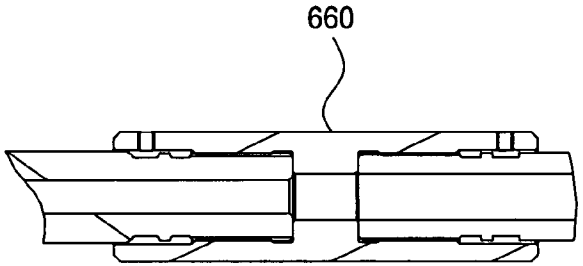
Figure 7B:
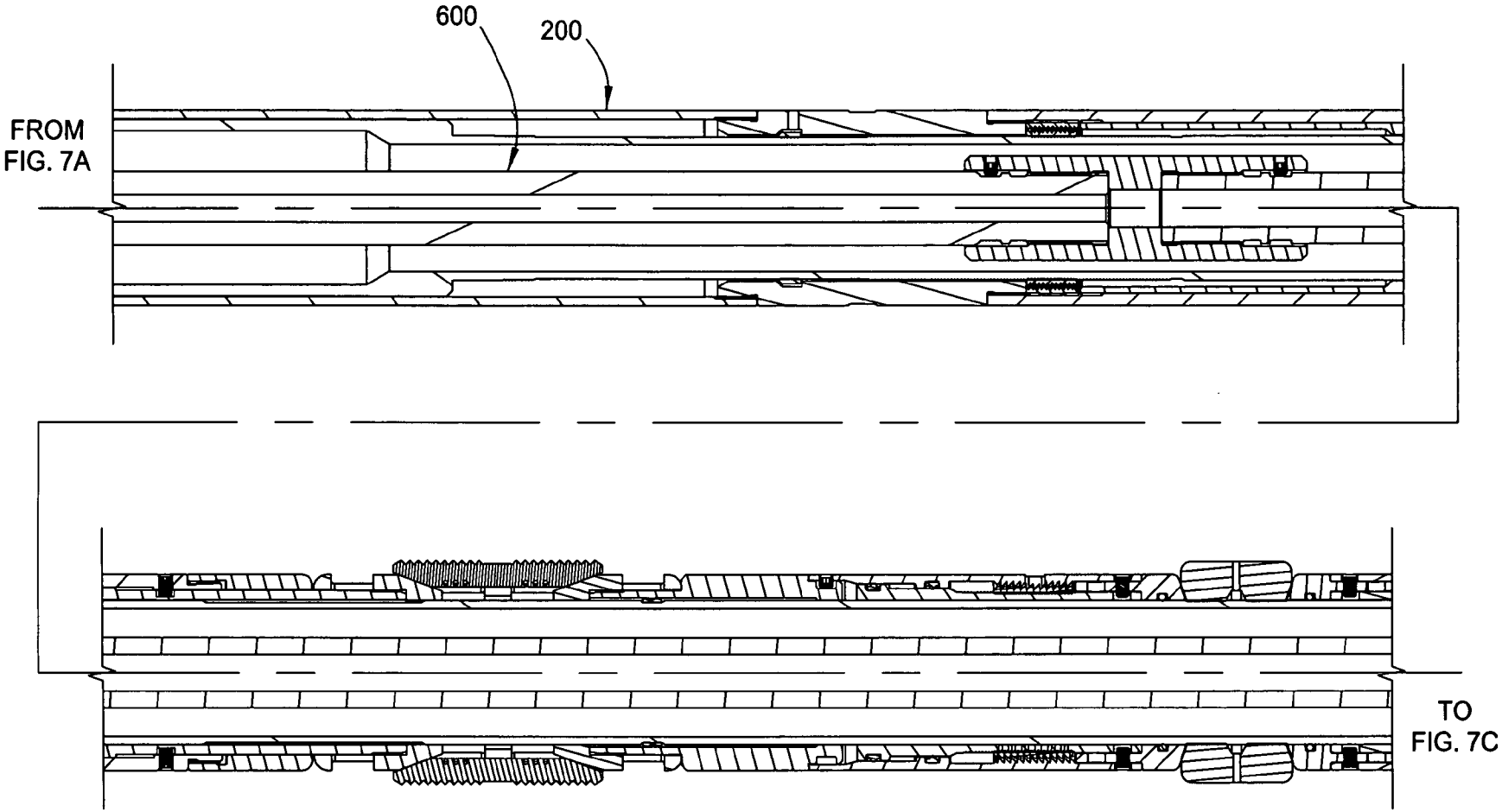
Figure 7C:
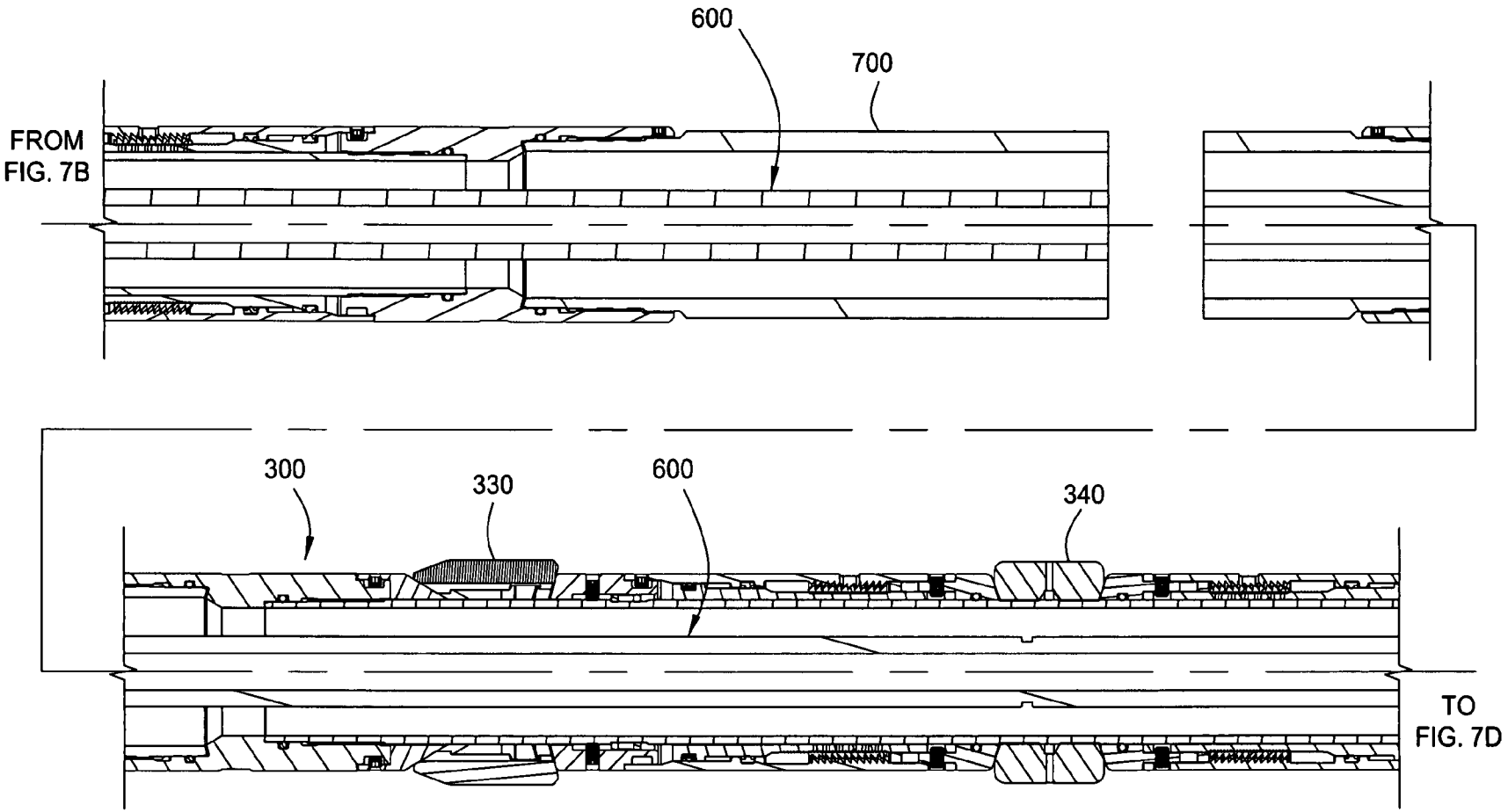
Figure 7D:
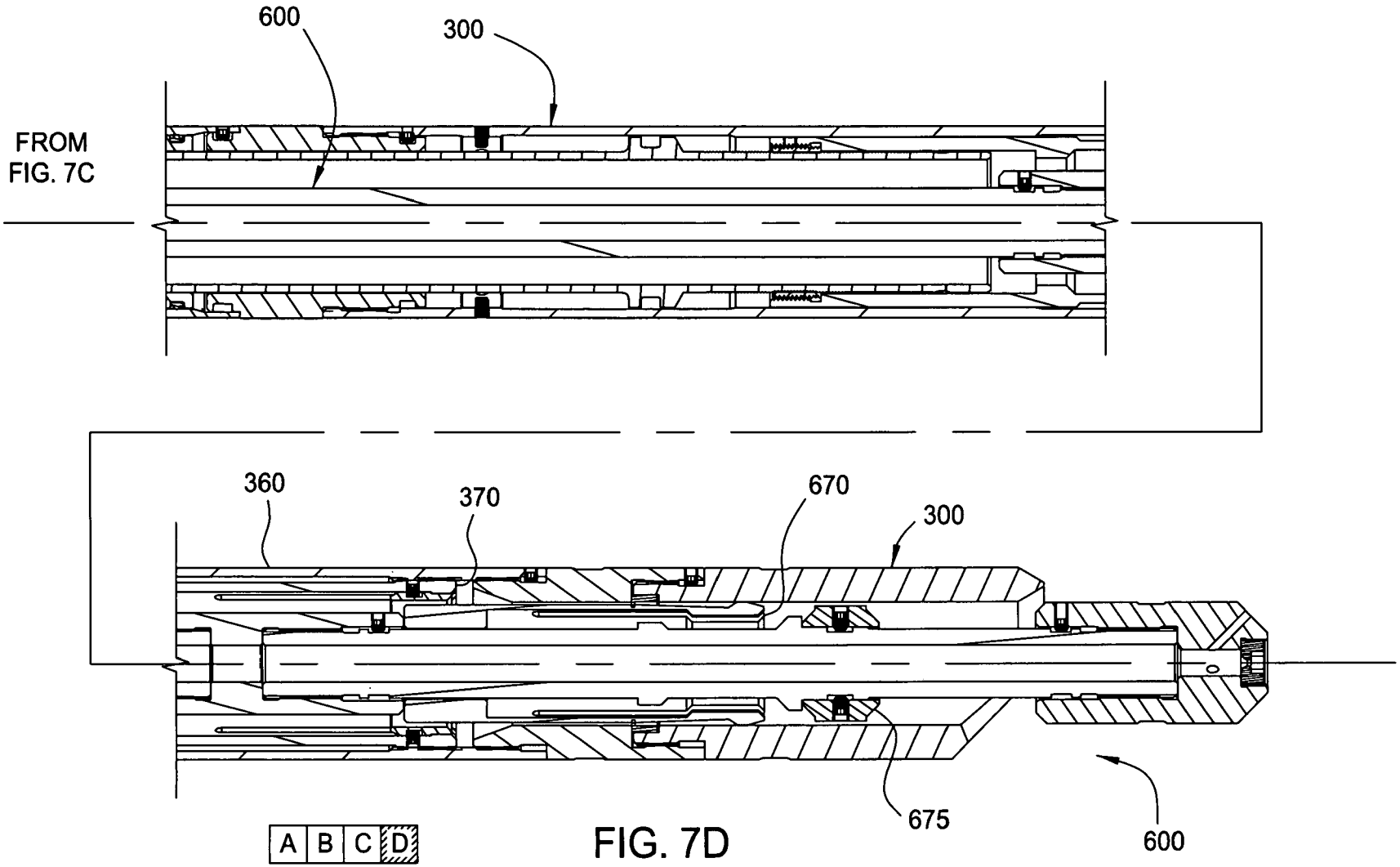
Figure 8B:
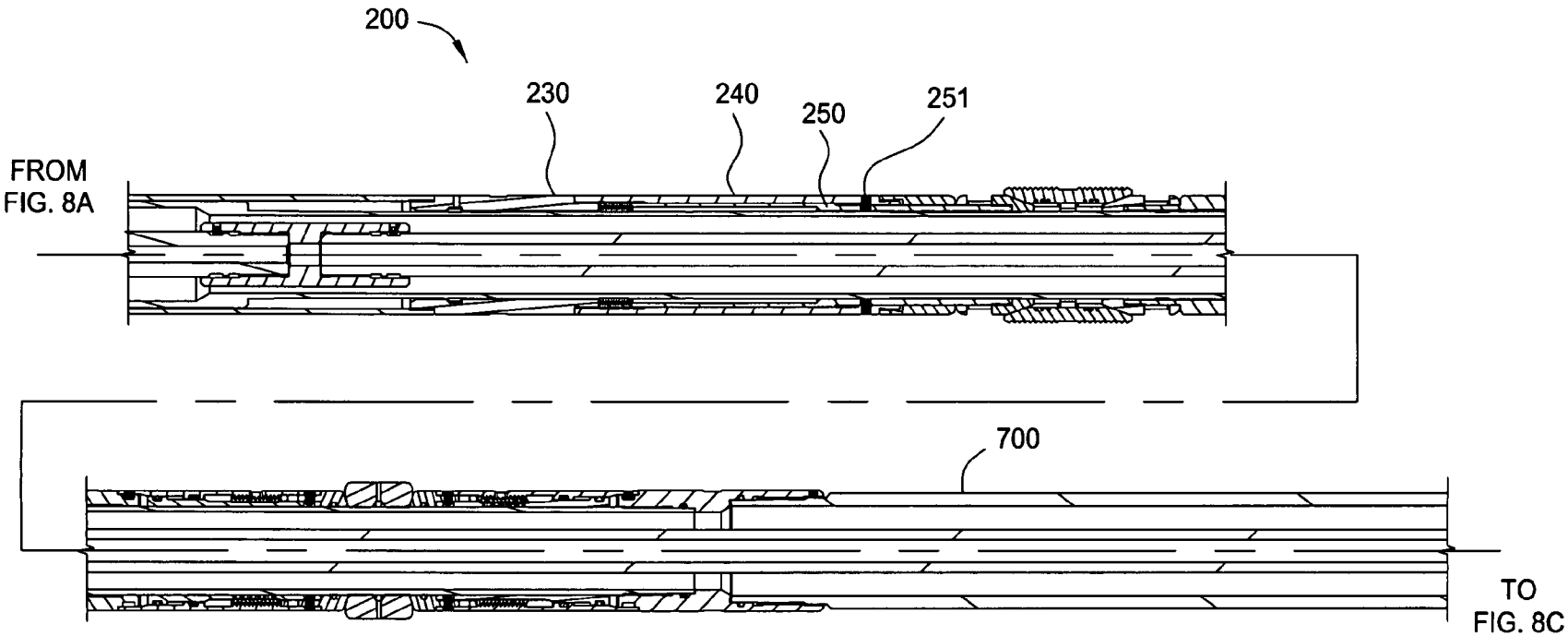
Figure 9A:
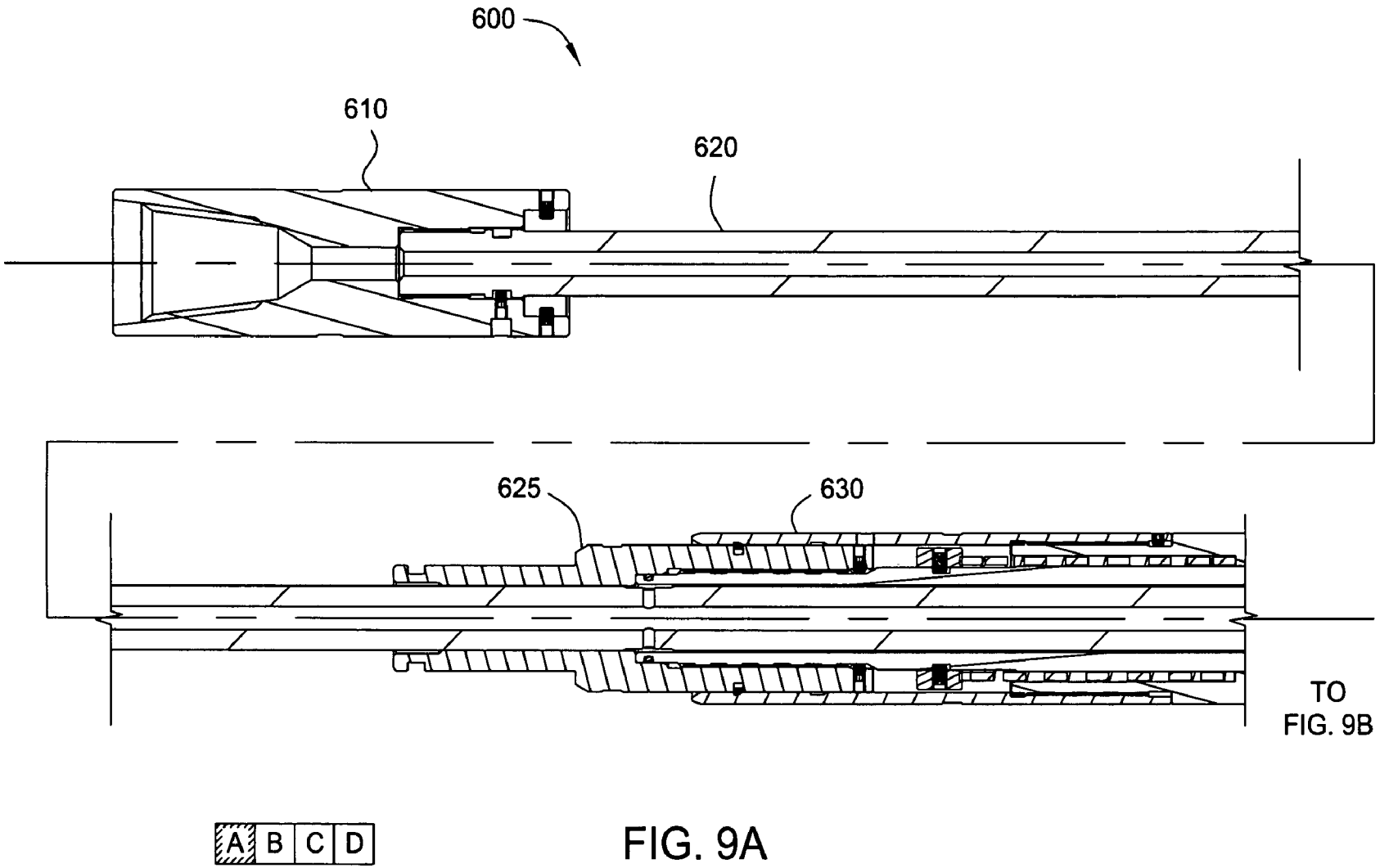
FIGS. 9A-D is a cross-sectional view of the retrieval tool and the packer assembly in a second unset position according to one embodiment of the invention.
Figure 9B:
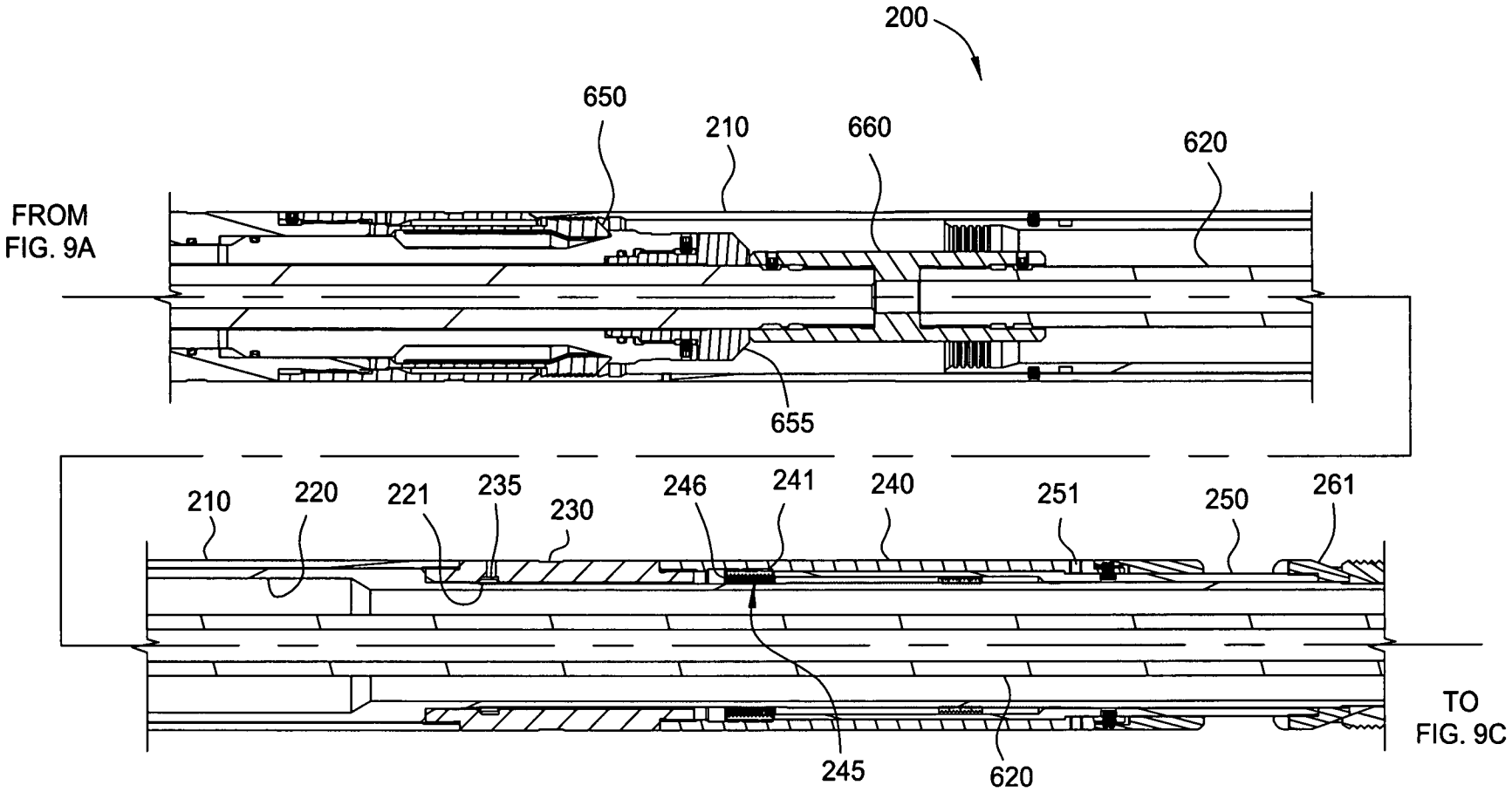
Figure 9C:
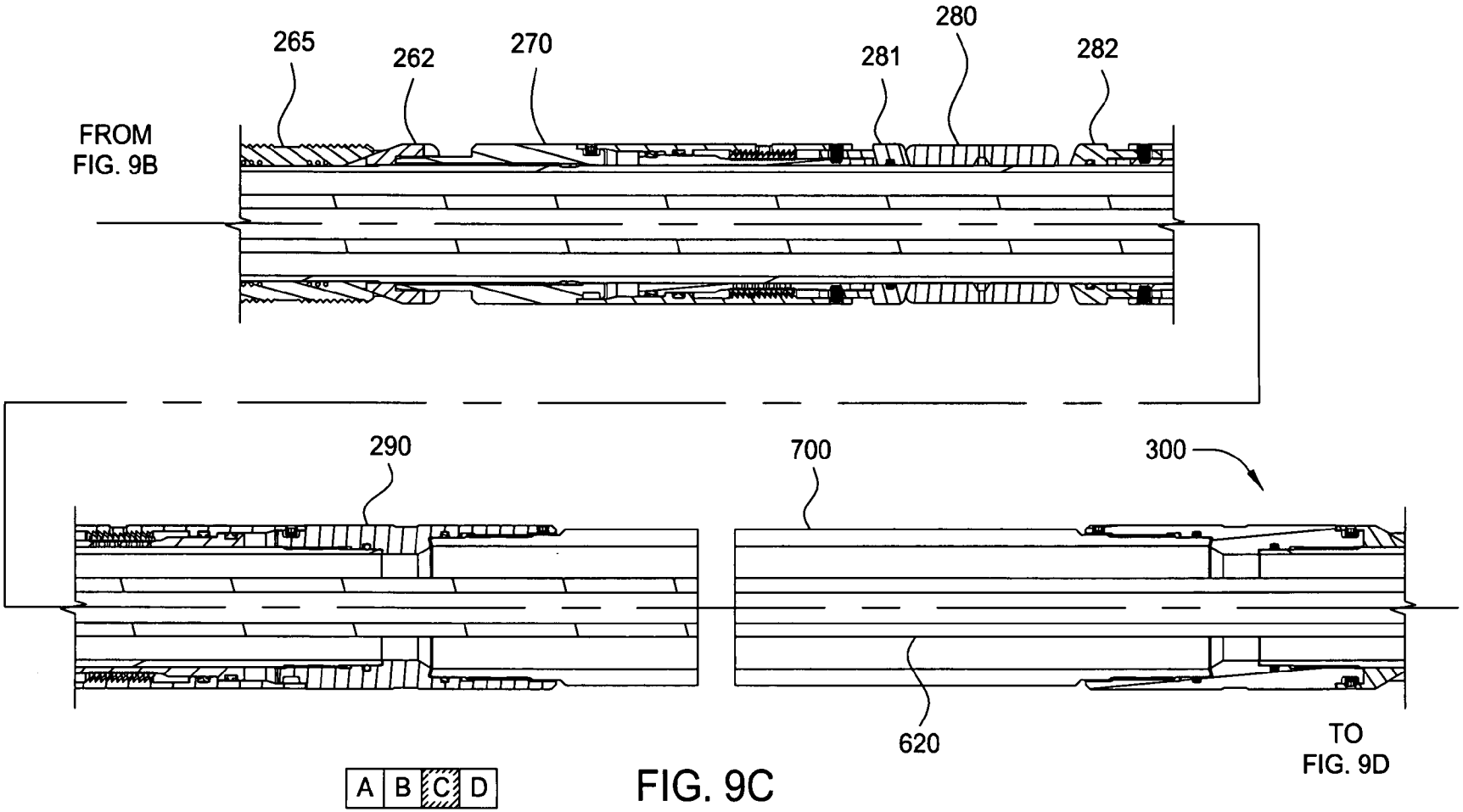
Figure 9D:
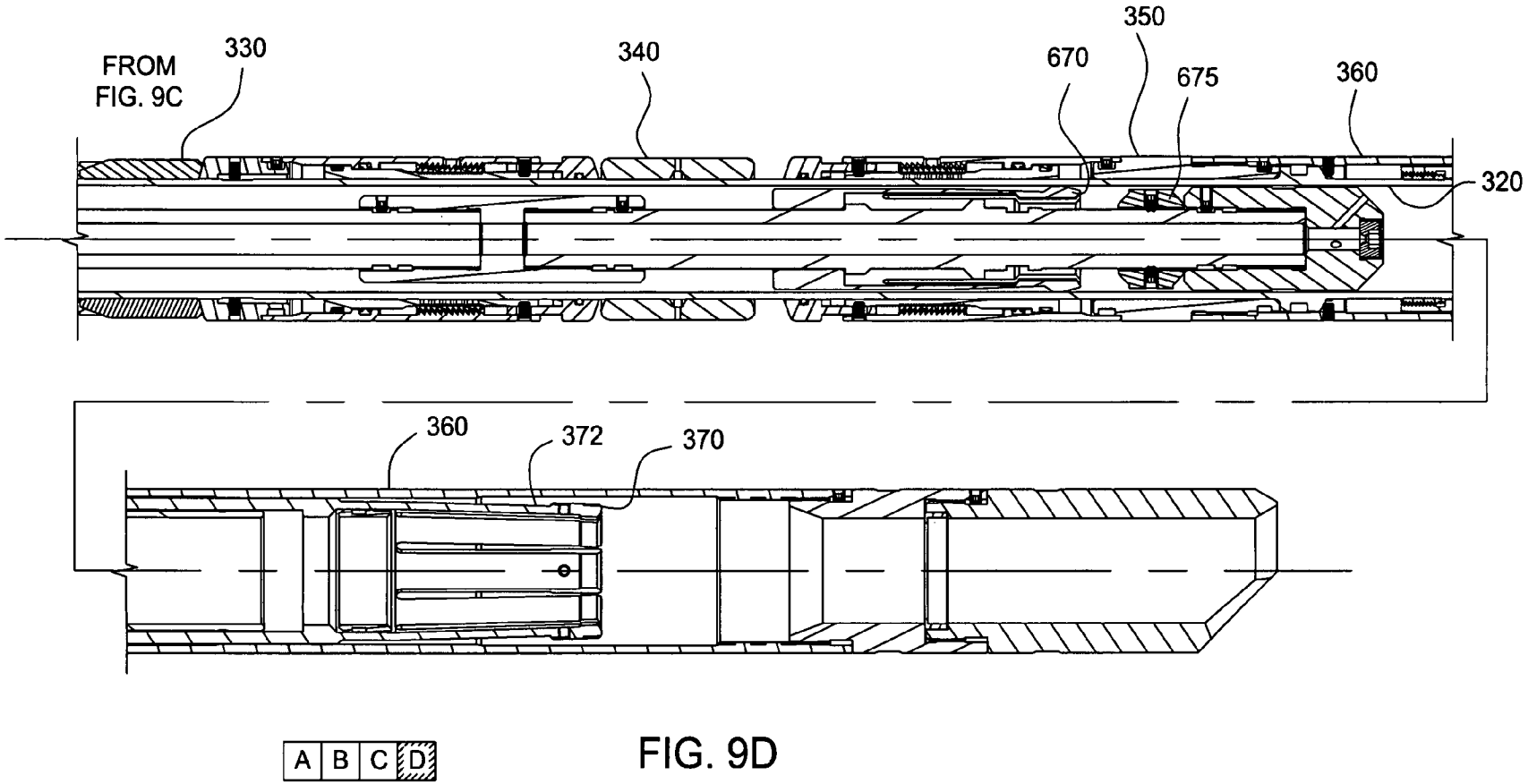
Figure 10A:
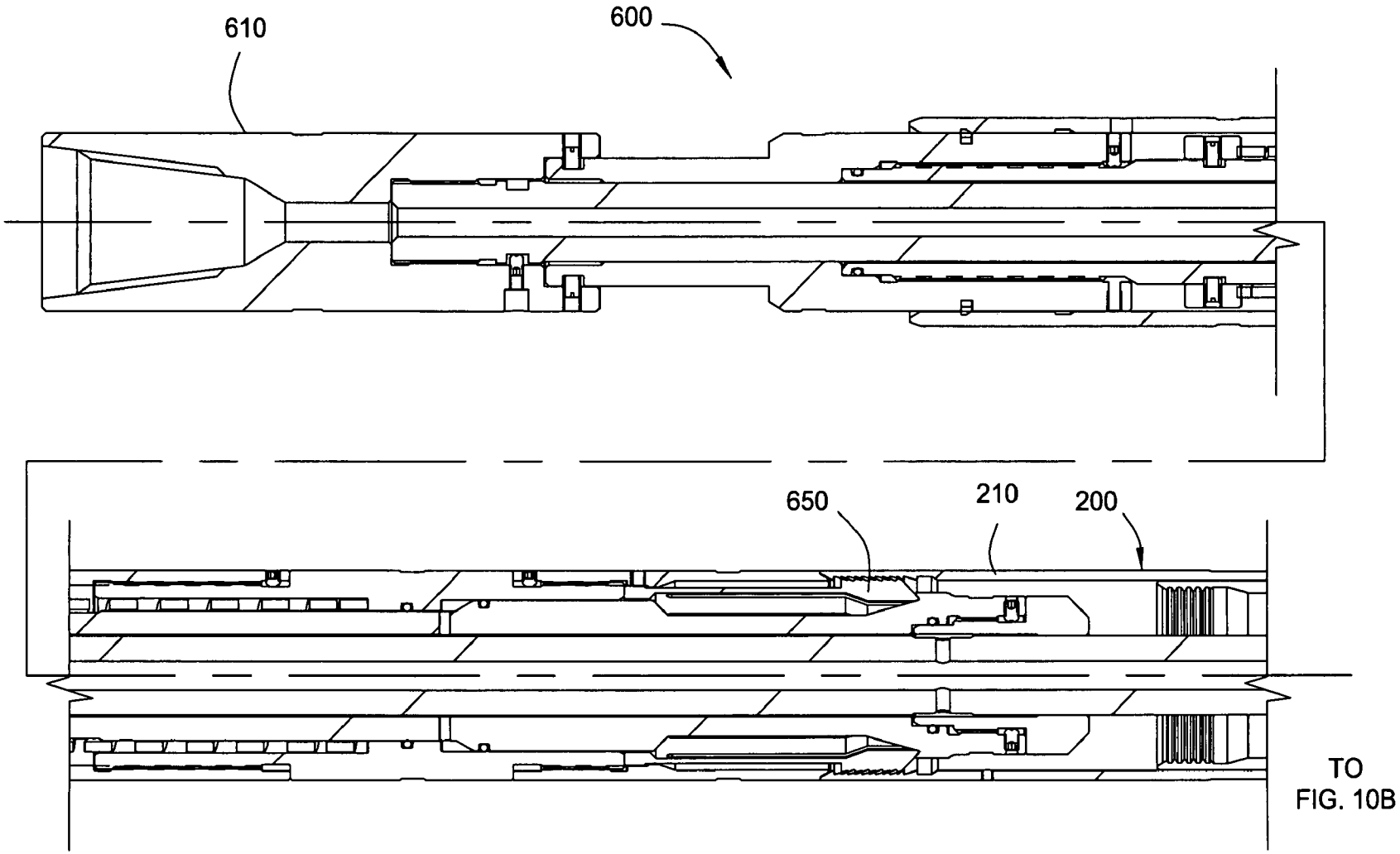
FIGS. 10A-D is a cross-sectional view of the retrieval tool engaged with the packer assembly according to one embodiment of the invention.
Figure 10B:
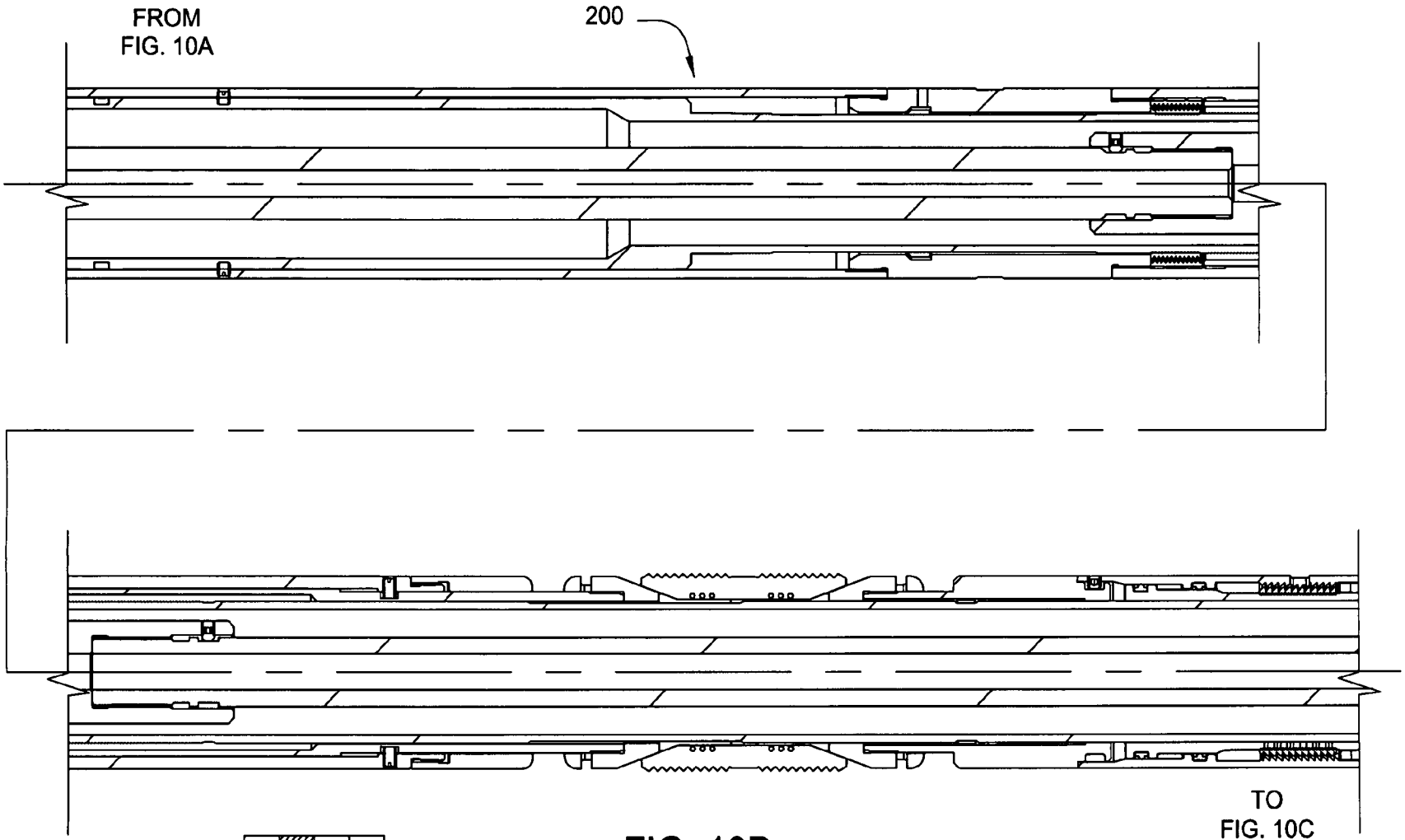
Figure 10C:
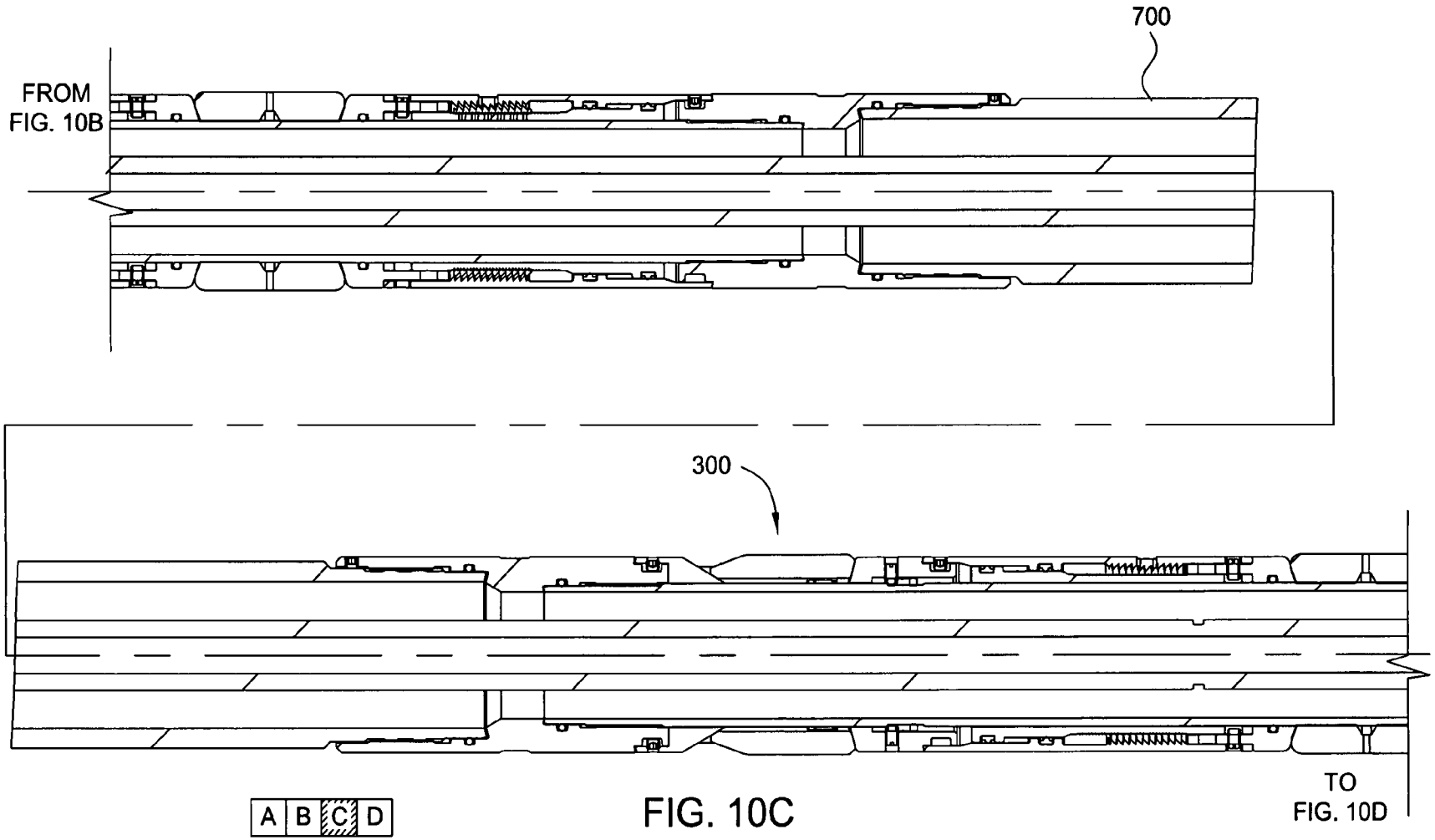
Figure 10D:
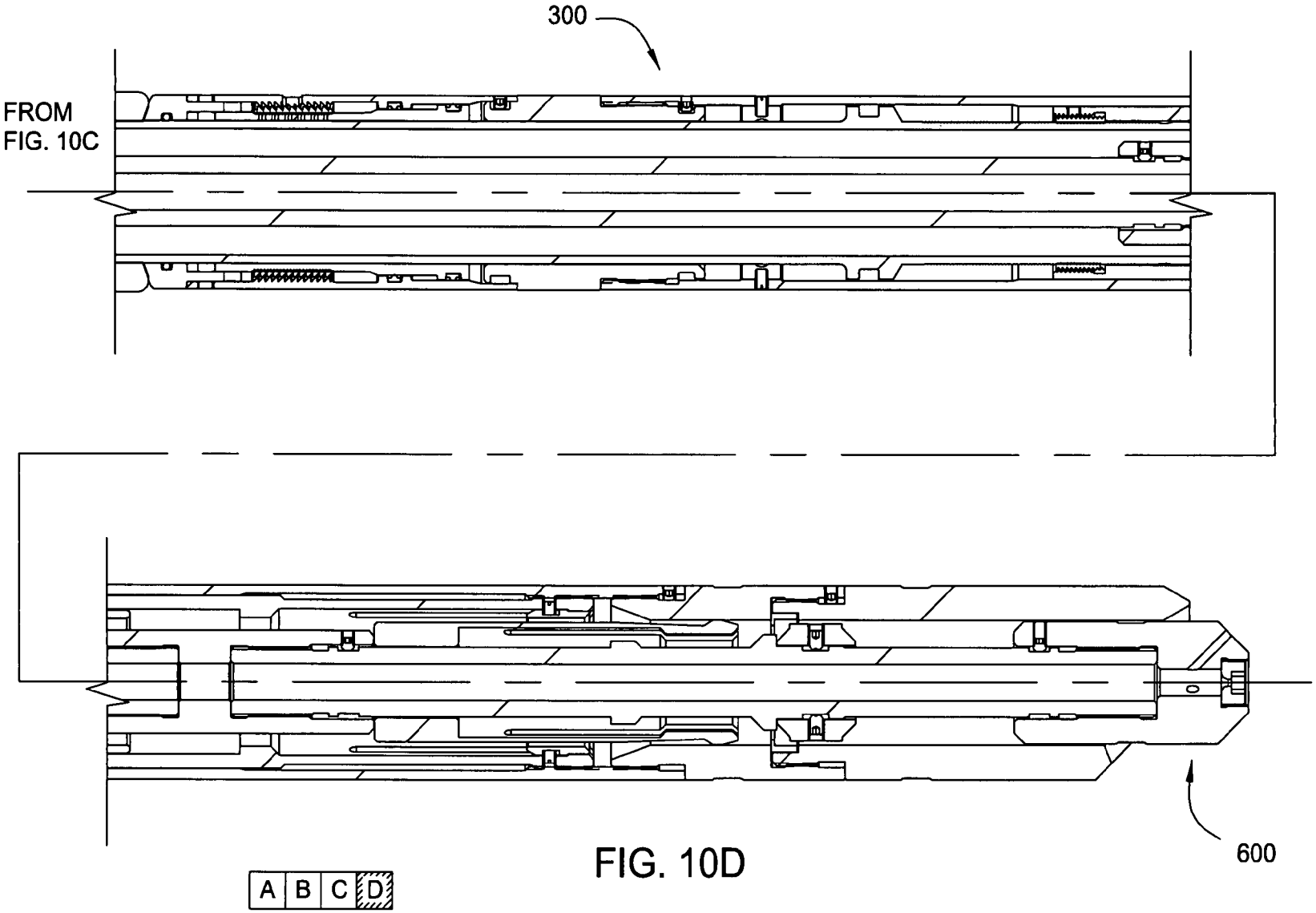
Figure 11A:
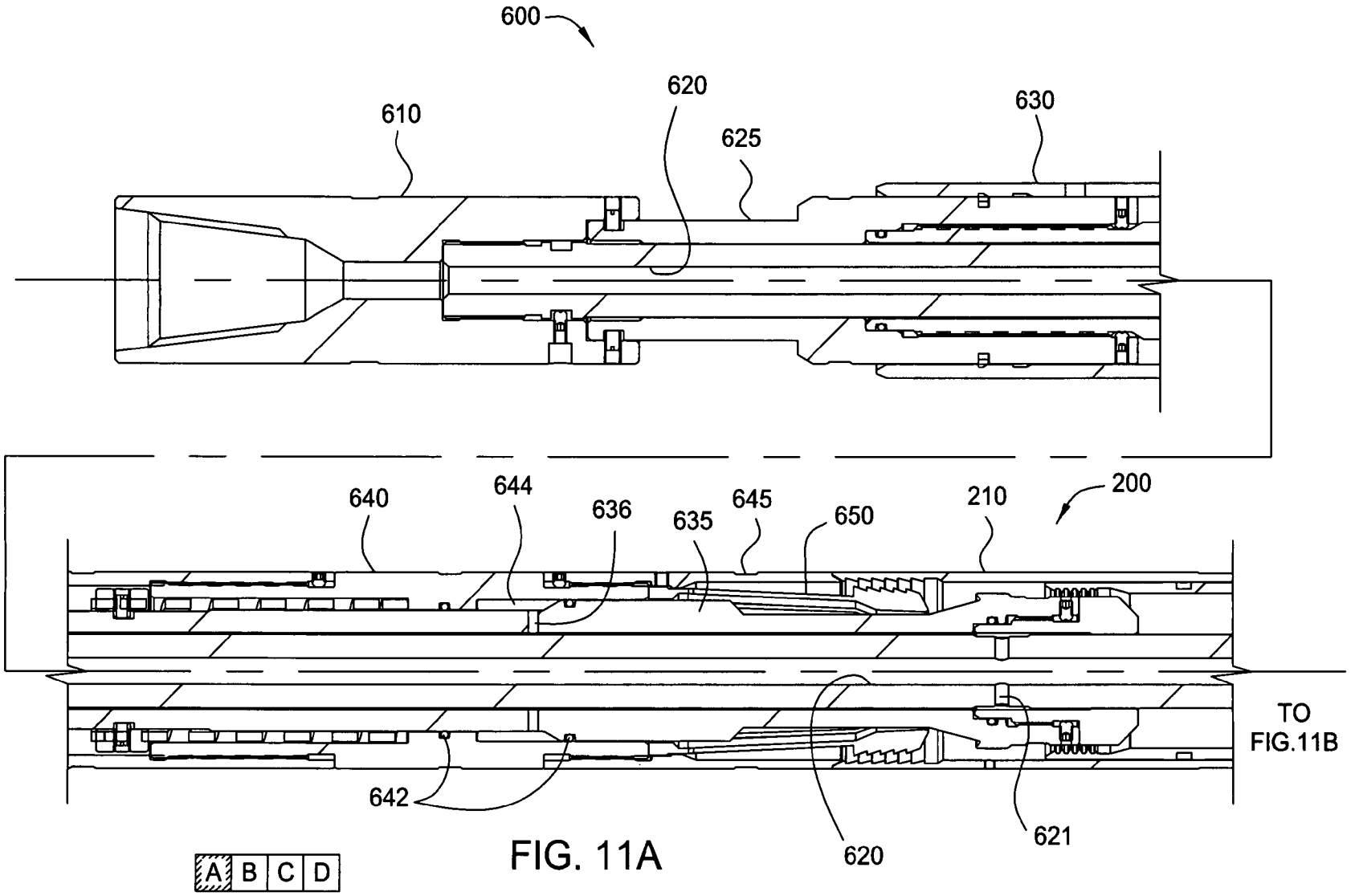
FIGS. 11A-D is a cross-sectional view of the retrieval tool and the packer assembly in a first release position according to one embodiment of the invention.
Figure 11B:
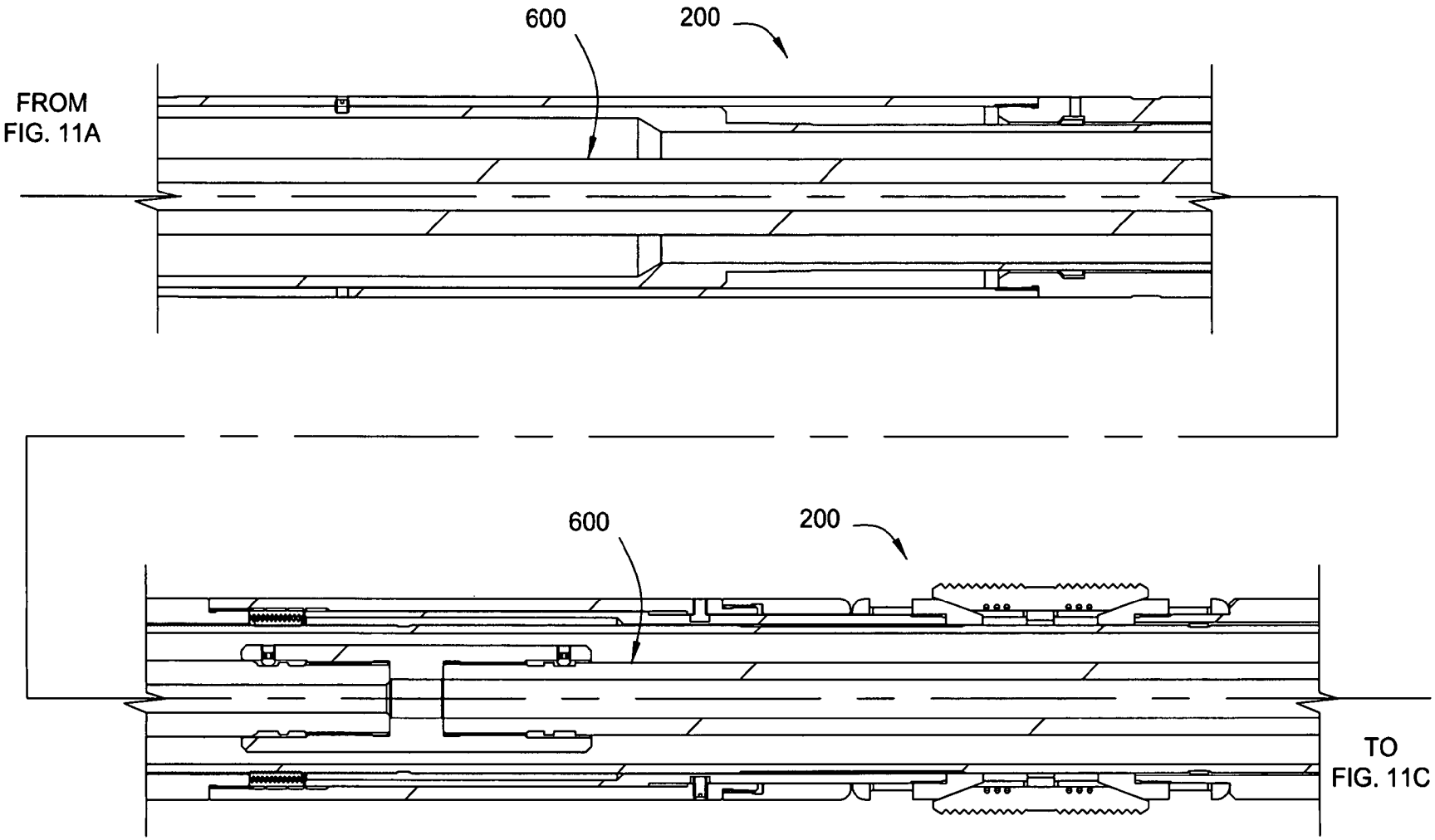
Figure 11C:
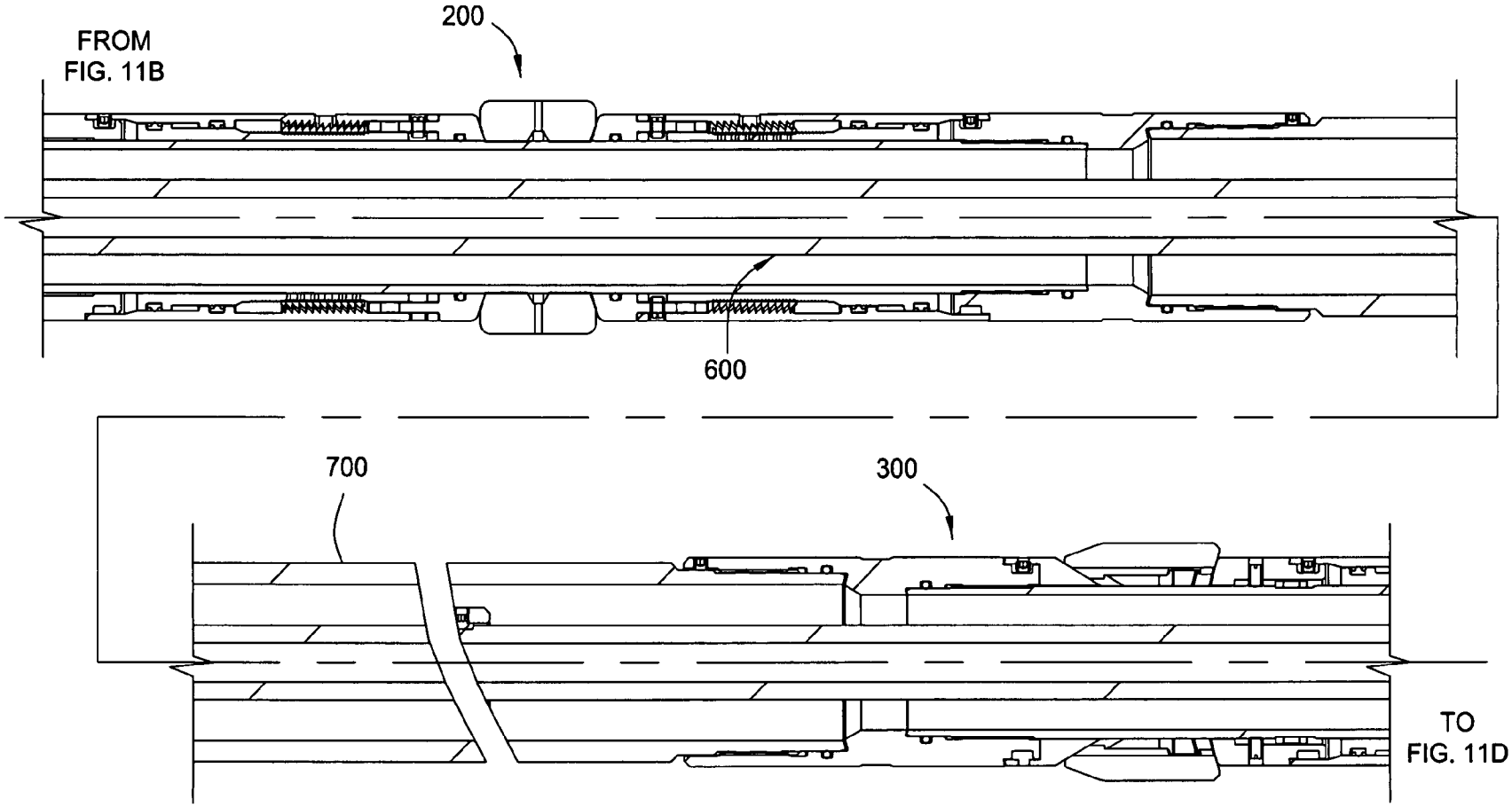
Figure 11D:
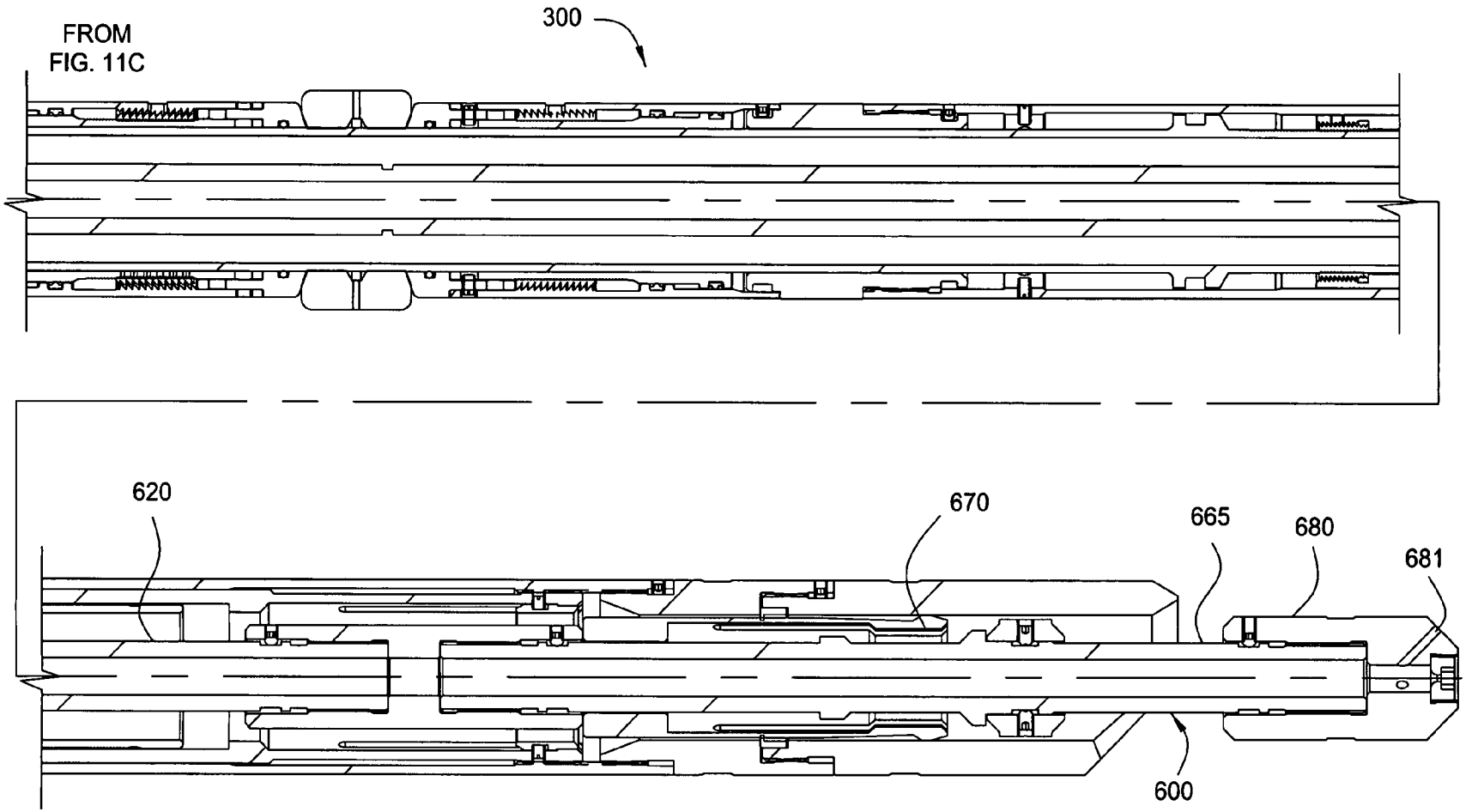
Figure 12A:
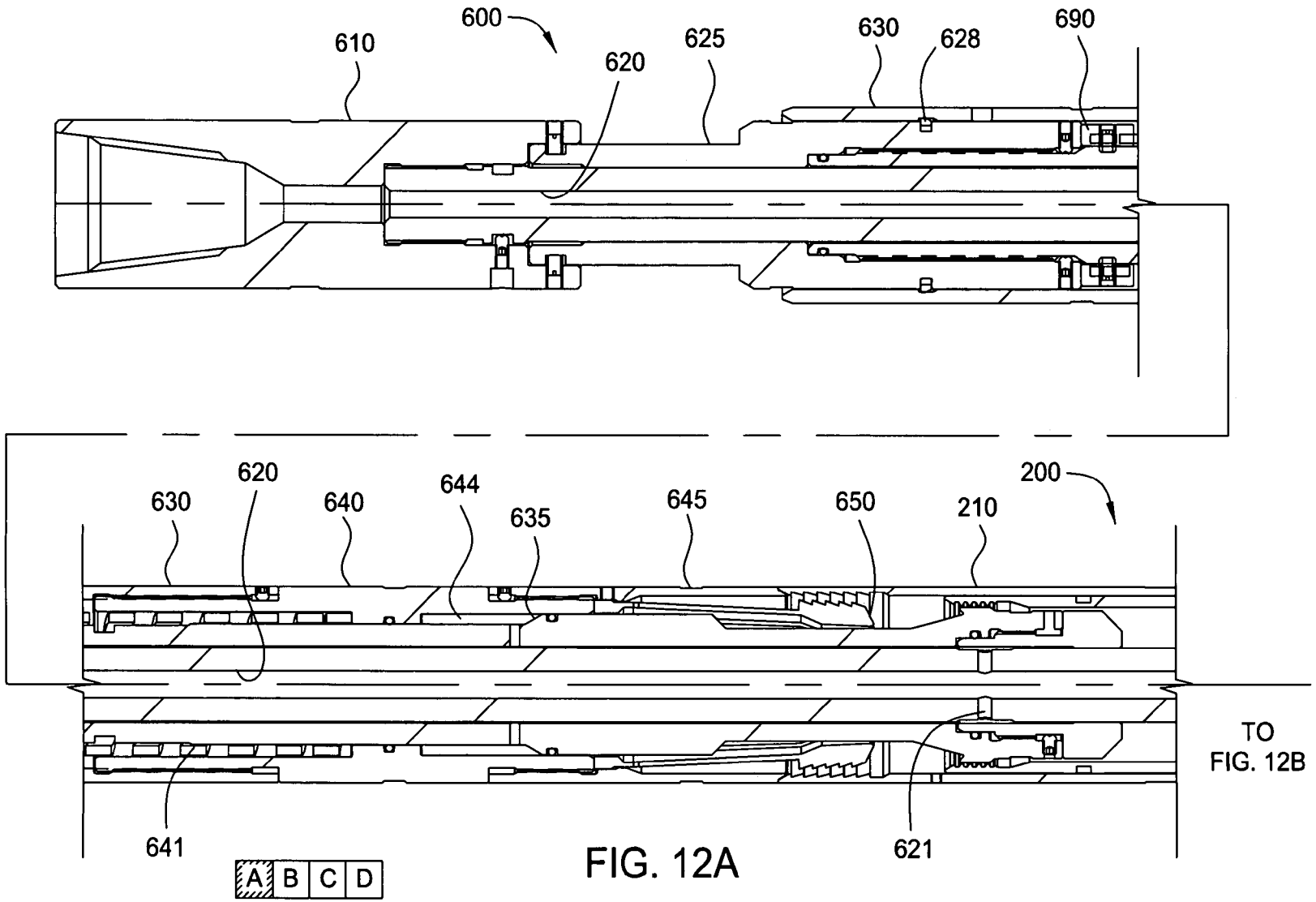
FIGS. 12A-D is a cross-sectional view of the retrieval tool and the packer assembly in a second release position according to one embodiment of the invention.
Figure 12B:
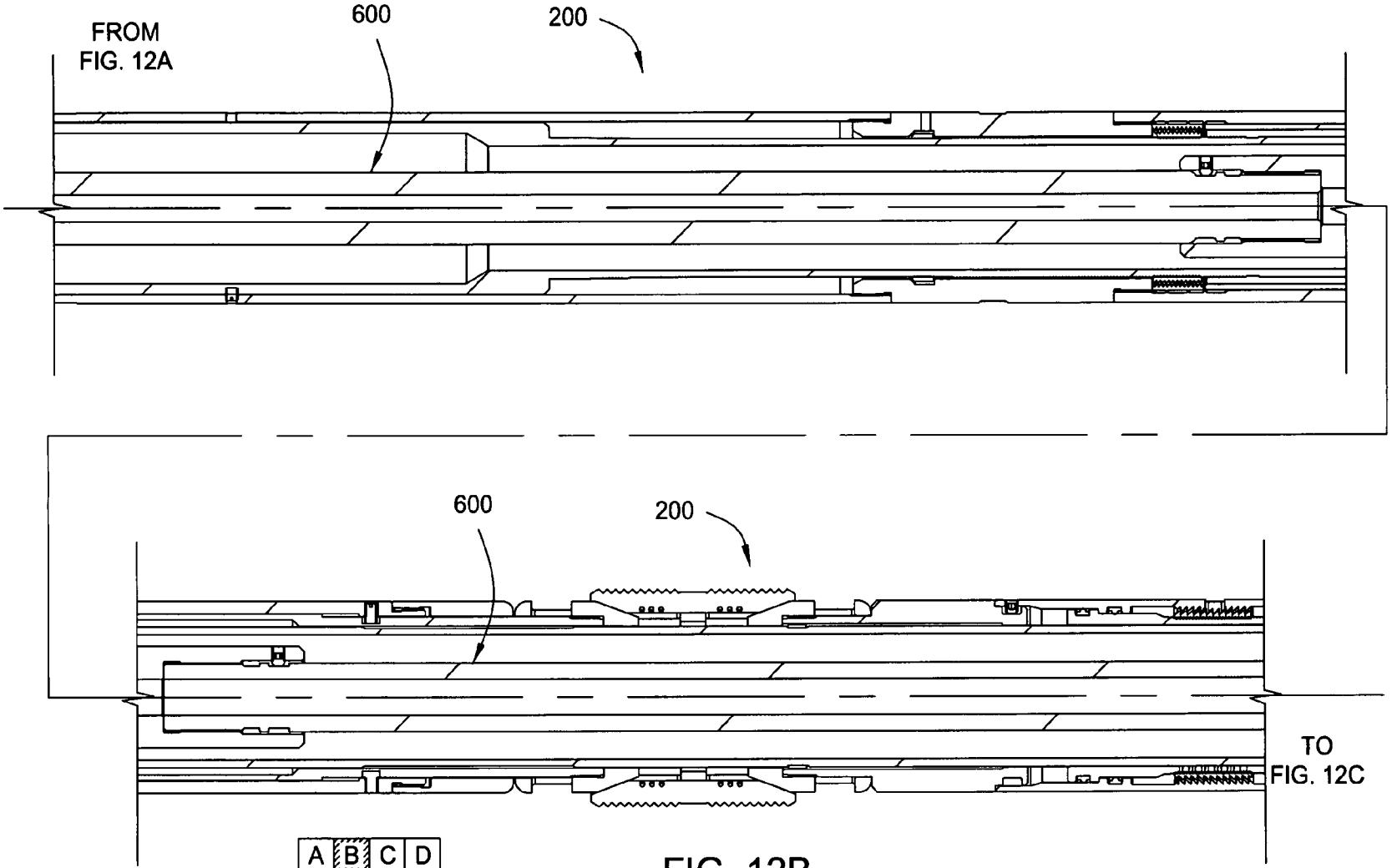
Figure 12C:
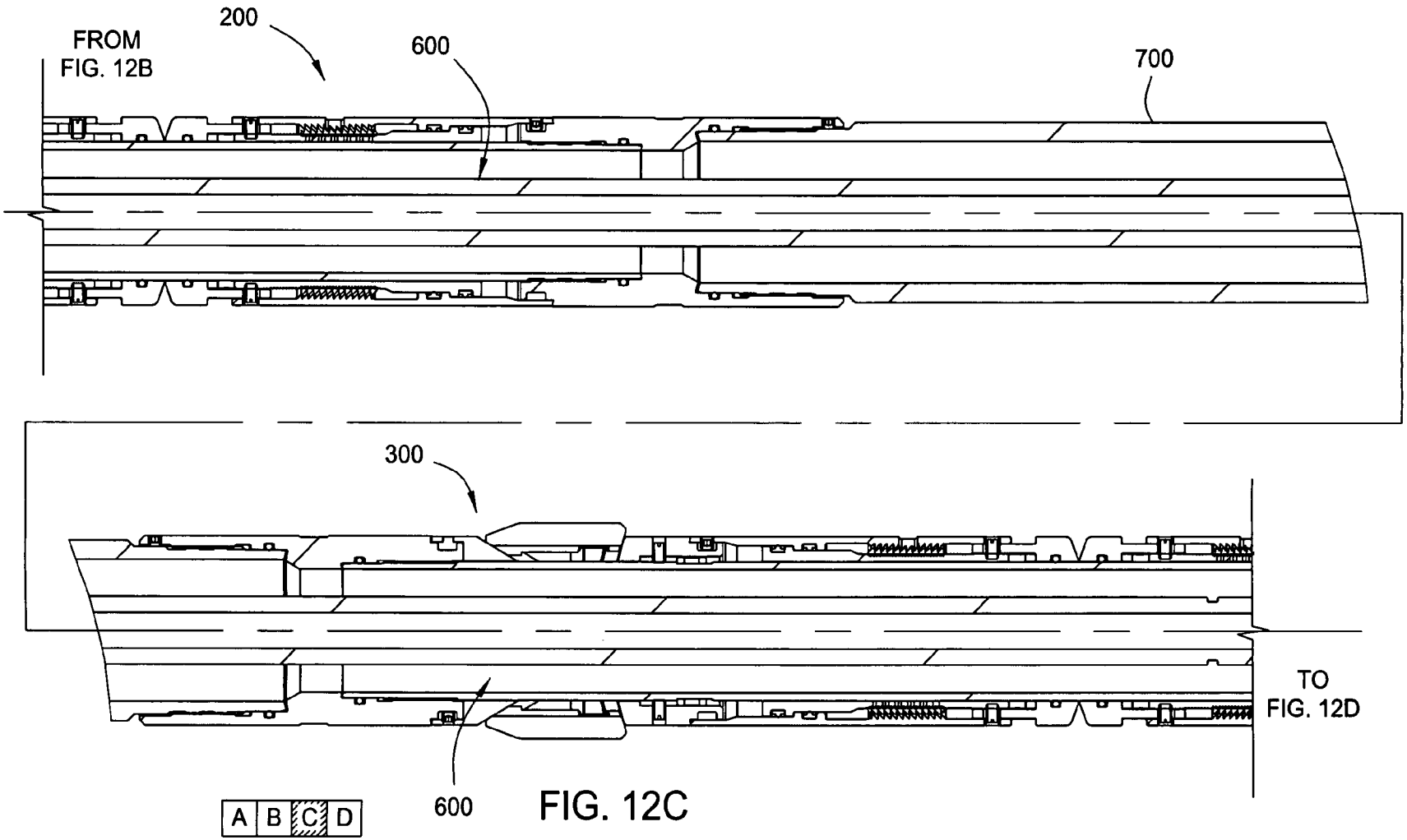
Figure 12D:
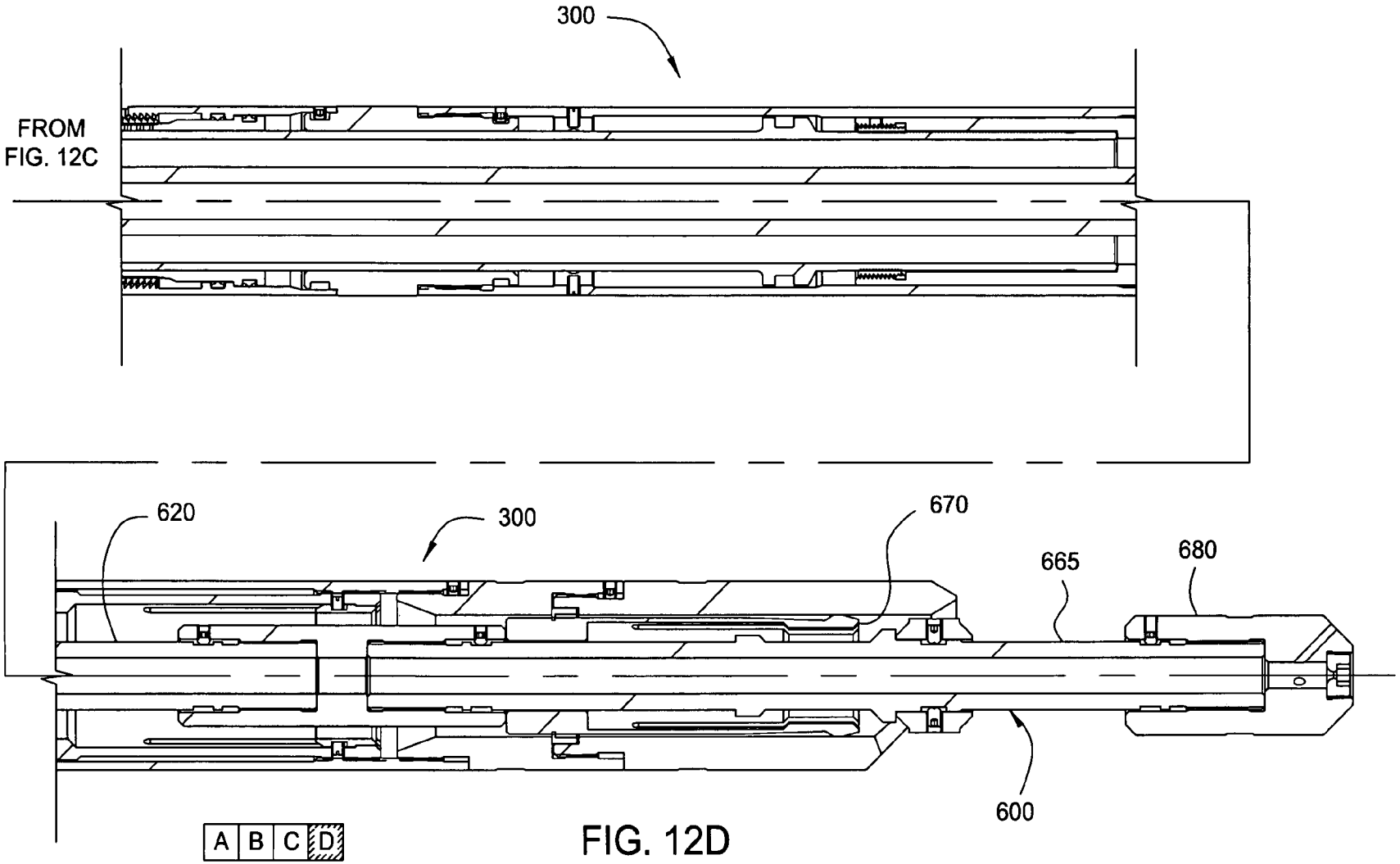
Figure 13A:
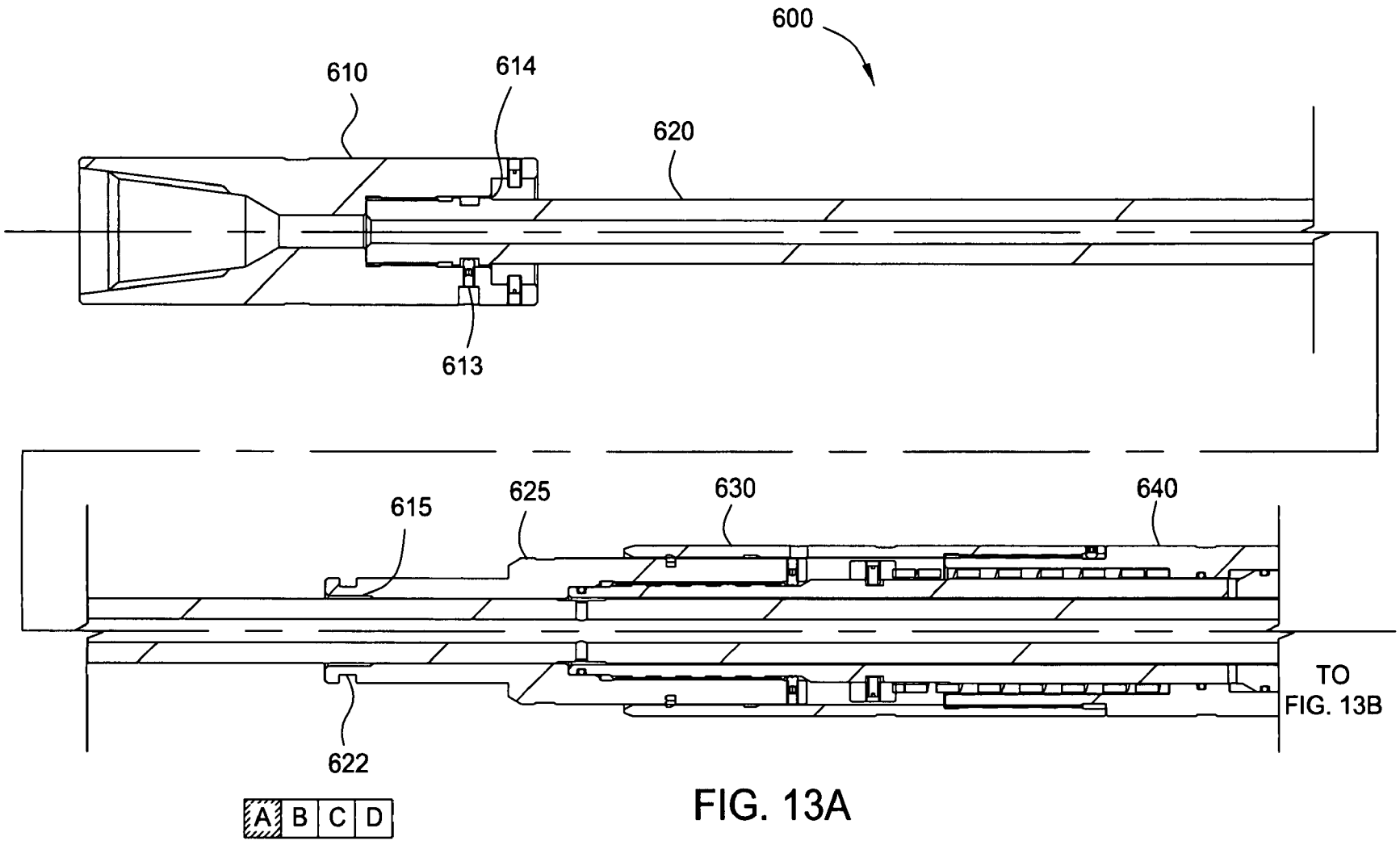
Figure 13B:
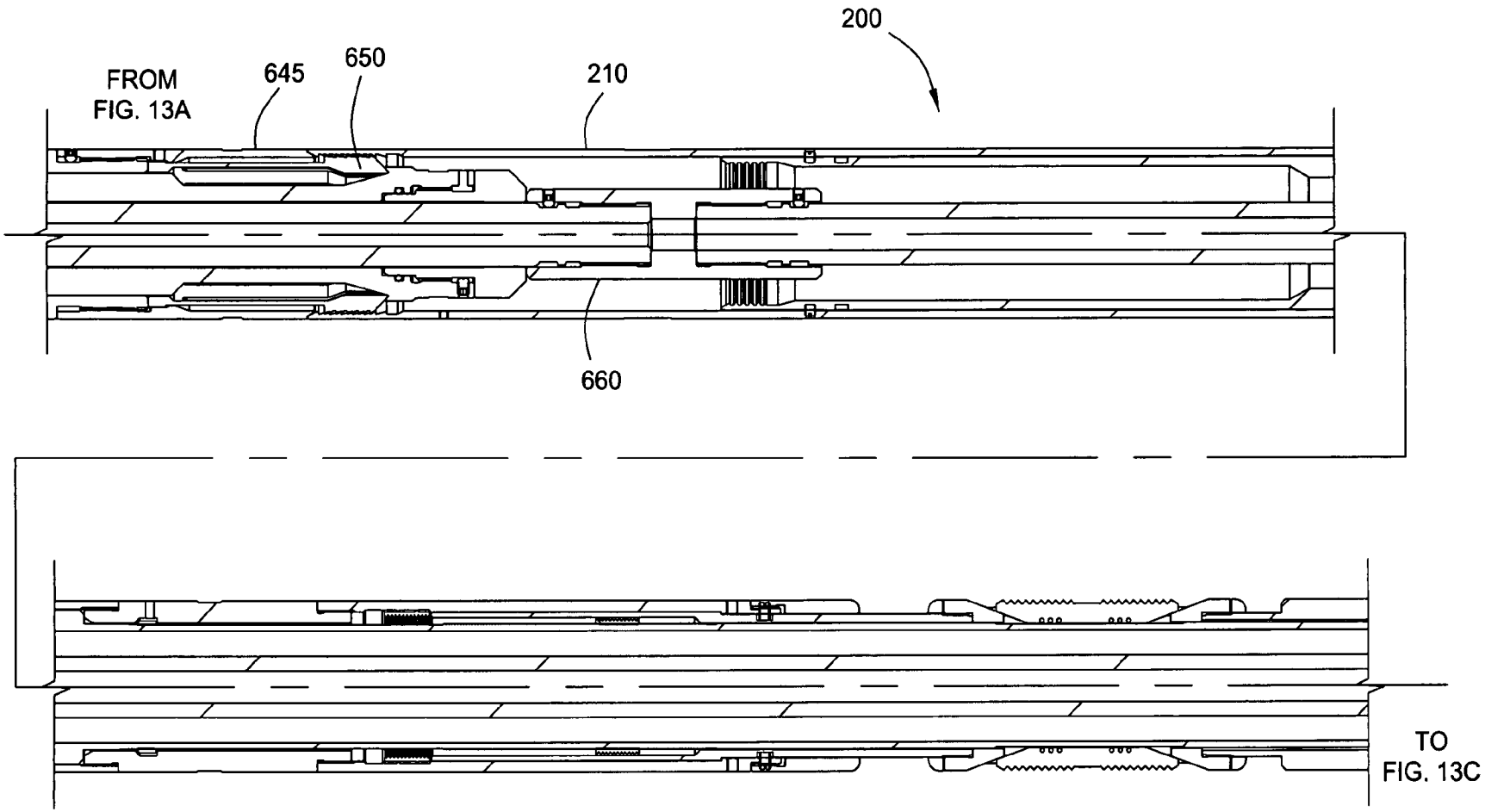
Figure 13C:
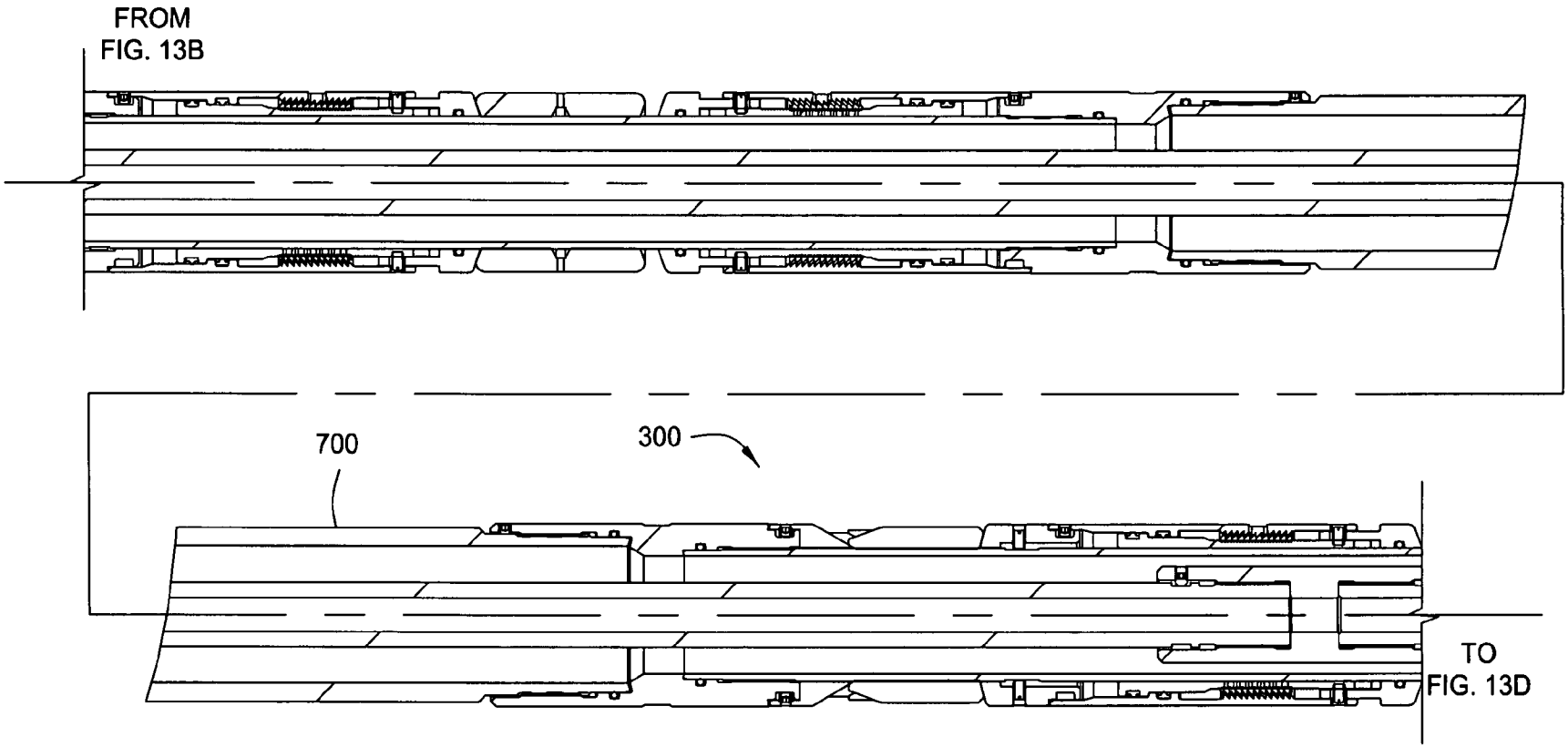
Figure 14B:
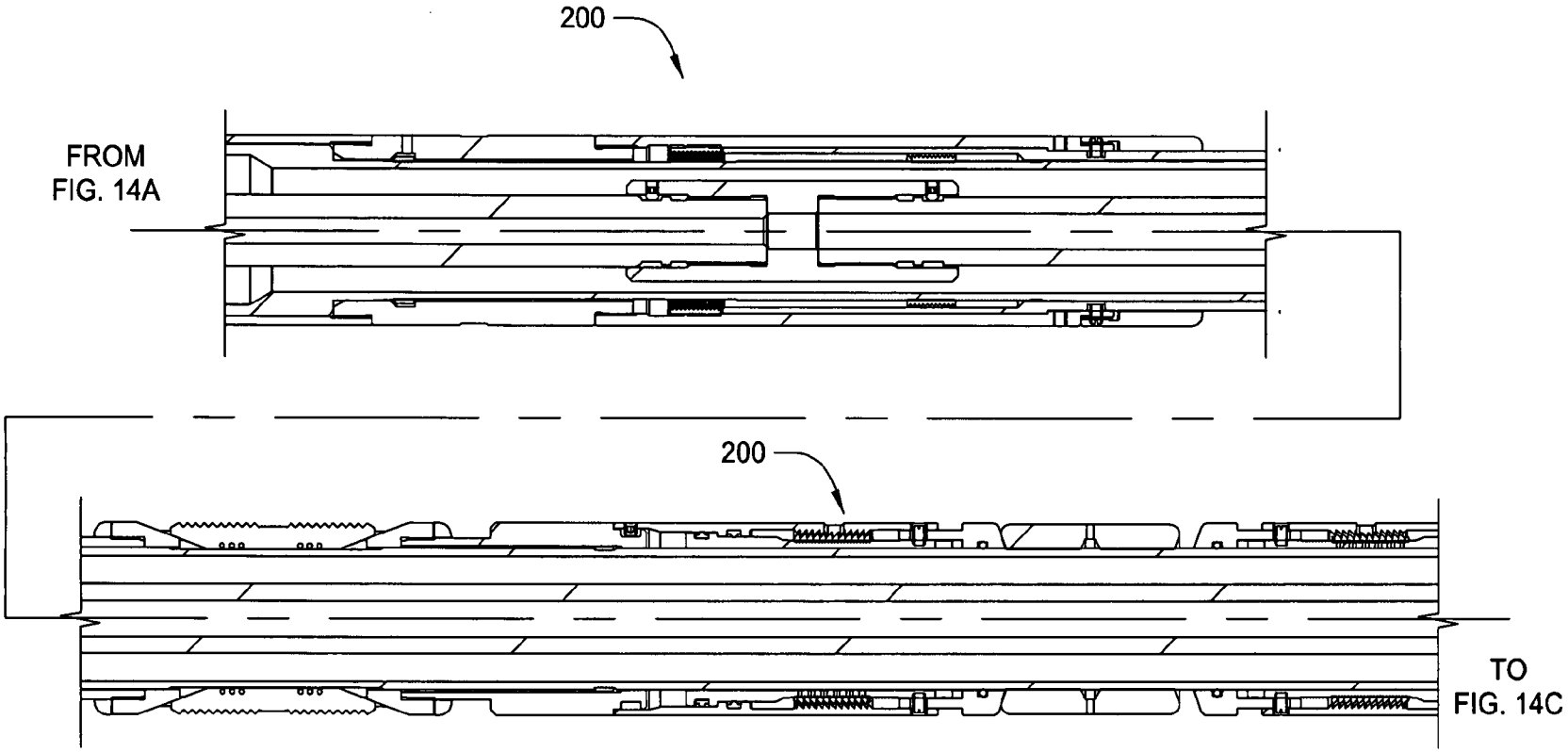
Figure 14C:
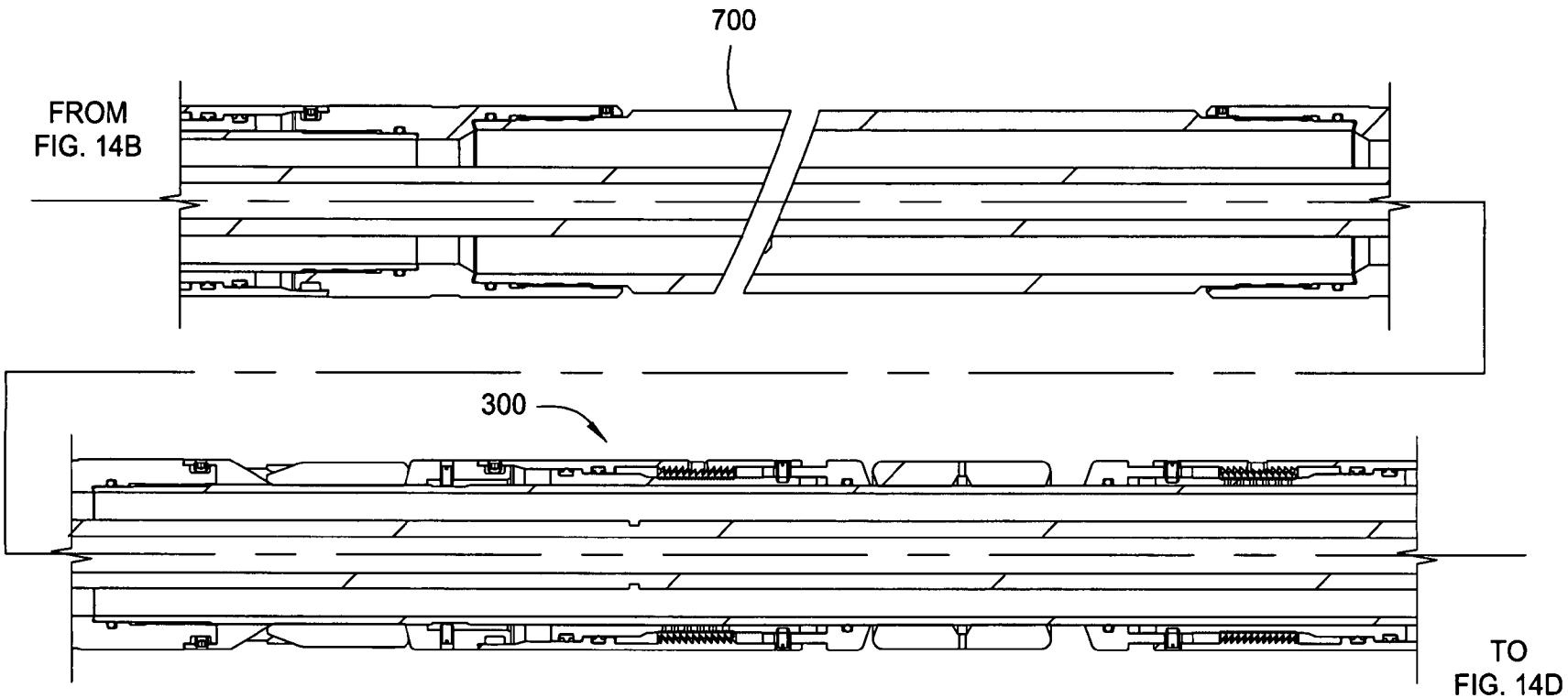
Figure 14C:
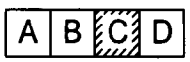

FIGS. 1A-D illustrate a cross-sectional view of a packer assembly 100 according to one embodiment of the invention. The packer assembly 100 may be located in a wellbore adjacent an area of interest in a formation using a conveyance member, such as jointed pipe, coiled tubing, Corod, slickline, or wireline. The packer assembly 100 is operable to provide selective isolation to a section of the wellbore. The packer assembly 100 may be used to isolate, seal, and repair a perforated or damaged section of the wellbore to maintain optimal production from the wellbore. A setting tool 500 may be coupled to and located in the wellbore with the packer assembly 100 to set the packer assembly 100 in the wellbore during a single trip into the wellbore. The setting tool 500 may include any setting tool known by one of ordinary skill in the art, such as a pyrotechnic setting tool or hydraulic setting tool to set the packer assembly 100 as discussed below.

The packer assembly 100 includes an upper packer assembly 200, a lower packer assembly 300, and a setting assembly 400 disposed within the upper and lower packer assemblies. The packer assembly 100 includes one or more tubular members, such as spacer subs 700, to space apart the upper and lower packer assemblies. In one embodiment, the spacer subs 700 may include jointed pipe. The distance between the upper and lower packer assemblies may be adjusted during assembly of the packer assembly 100 using the spacer subs 700. The distance may depend on the size of the area of interest in the formation that is to be isolated using the packer assembly 100.

The upper packer assembly 200 includes a retrieval sleeve 210, a setting sleeve 220, a first support member 230, a release sleeve 240, a second support member 250, a housing 260, a third support member 270, a packing element 280, and a bottom sub 290. The retrieval sleeve 210 may include a cylindrical body that surrounds part of the setting sleeve 220, and the setting sleeve 220 may also include a cylindrical body that partially surrounds the setting assembly 400. The retrieval sleeve 210 is releaseably coupled to the setting sleeve 220 by a releasable connection 225, such as a breakable connection or one or more shear pins. The retrieval sleeve 210 is slideably disposed relative to the setting sleeve 220 upon release of the releasable connection 225.

The lower end of the retrieval sleeve 210 is coupled to a first support member 230. Adjacent to the first support member 230 and surrounded by the retrieval sleeve 210 may be a spacer 215 that surrounds part of the setting sleeve 220. The spacer 215 may include a cylindrical body and may be disposed between the first support member 230 and a shoulder formed on the outer surface of the setting sleeve 220. The spacer 215 may prevent the shoulder of the setting sleeve 220 from abutting against the first support member 230 and may be used to help facilitate operation of the upper packer assembly 200.

The first support member 230 may include a cylindrical body that surrounds part of the setting sleeve 220. The first support member 230 may include a recess 231 on its inner surface in which a support ring 235 may be disposed. The support ring 235 may include a cylindrical body that surrounds part of the setting sleeve 220. As the setting sleeve 220 and the first support member 230 move relative to each other, the support ring 235 is retained within the recess 231. The inner surface of the support ring 235 may include teeth that are adapted to mate with a first set of teeth 221 disposed on the outer surface of the setting sleeve 220 to help retain the relative position between the setting sleeve 220 and the first support member 230 during retrieval of the packer assembly 100. The first set of teeth 221 may be positioned relative to the support ring 235 so that they mate with the teeth on the support ring 235 during retrieval of the upper packer assembly 200.

The lower end of the first support member 230 may be coupled to a release sleeve 240, which is releaseably coupled to a second support member 250. The release sleeve 240 may include a cylindrical body that surrounds part of the setting sleeve 220 and part of the second support member 250. Recesses 241 may be disposed along the inner surface of the release sleeve 240 to disengage a lock ring 245, which is located between the release sleeve 240, the setting sleeve 220, the first support member 230, and the second support member 250. The lock ring 245 may include an outer ring 246 with shoulders disposed along its outer surface that are adapted to engage with the recesses 241 on the inner surface of the release sleeve 250. The inner surface of the outer ring 246 may include teeth that are adapted to engage with teeth disposed on the outer surface of an inner ring 247. The inner surface of the inner ring 247 may also include teeth that are adapted to engage with a second set of teeth 222 disposed along the outer surface of the setting sleeve 220. The outer ring 246 and inner ring 247 may be adapted to lock with each other, and the teeth on the inner ring 247 may be adapted to engage with the second set of teeth 222 disposed on the setting sleeve 220, to help facilitate setting of the packer assembly 100. During retrieval of the packer assembly 100, the outer ring 246 and inner ring 247 may be adapted to unlock, when the shoulders on the outer ring 246 engage with the recesses 241 on the inner surface of the release sleeve 240, to help facilitate retrieval of the upper packer assembly 200.

The second support member 250 is releaseably coupled to the release sleeve 240 by a releasable connection 251, such as a breakable connection or one or more shear pins. The second support member 240 may include a cylindrical body that surrounds part of the setting sleeve 220. Upon release of the releasable connection 251, the release sleeve 240 may move relative to the setting sleeve 220 and second support member 250 to allow the lock ring 245 to disengage via the recesses 241 on the inner surface of the release sleeve 240 to facilitate retrieval of the packer assembly 100. The lower end of the release sleeve 240 may optionally be coupled to a protection member 248, such as a debris barrier, to prevent debris and other unwanted materials from preventing operation of the upper packer assembly 200. In one embodiment, the protection member 248 is a debris barrier that is actuated radially to protect the housing 260, the slips 265, the packing element 280, and any other components (further described below) located adjacent, such as below, the debris barrier from debris that may disrupt the operation of such components.

The lower end of the second support member 250 is coupled to a housing 260. The housing 260 includes a cylindrical body that surrounds part of the setting sleeve 220 and has openings arranged around the body of the housing 260. A first cone 261, a second cone 262, and a gripping member, such as slips 265, may be positioned in the openings of the housing 260. The cones include cylindrical bodies with tapered shoulders disposed along the outer surfaces of the cones. The cones are seated within and at the ends of the housing 260 so that the tapered shoulders project through the openings of the housing 260. The first cone 261 may be directed towards the second cone 262 relative to the housing 260. The slips 265 may include teeth disposed along the outer surfaces to engage the wellbore and secure the packer assembly 100 in the wellbore. The slips 265 may be positioned in the openings of the housing 260 and may be rotationally fixed relative to the housing 260. The inner surface of the slips 265 may include tapered surfaces to slideably engage with the tapered shoulders on the cones. As the cones are directed towards each other, the slips 265 are projected outward as the tapered surfaces of the slips 265 travel up the tapered shoulders of the cones. The slips 265 may also include springs or bands (not shown) circumferentially positioned within the body of the slips 265, such that when the slips 265 are radially expanded outward, the springs or bands provide a reaction force adapted to retract the slips 265 to a non-expanded position. The number slips 265 positioned in the housing 260 may vary.

The first cone 261 is connected to the lower end of the second support member 250 to direct the first cone 261 towards the second cone 262 to set the slips 265. The second cone 262 is connected to the upper end of a third support member 270. The third support member 270 includes a cylindrical body that surrounds part of the setting sleeve 220 to facilitate setting of the slips 265. The third support member 270 and the setting sleeve 220 may be slideable relative to each other. A support ring 271 may be positioned between the third support member 270 and the setting sleeve 220 and may be seated in a recess on the outer surface of the setting sleeve 220 so that it projects above the recess. The support ring 271 may include a cylindrical body and is adapted to engage a shoulder on the inner surface of the third support member 270. The support ring 271 may limit the relative movement between the third support member 270 and the setting sleeve 220 to facilitate retrieval of the upper packer assembly 200.

The lower end of the third support member 270 may be coupled to a packing element 280. The packing element 280 may include an elastomeric material that surrounds part of the setting sleeve 220. The packing element 280 may be surrounded on each side by an upper gage 281 and a lower gage 282 for actuating the packing element 280 into engagement with the surrounding wellbore. Optionally a first boosting assembly 285 and a second boosting assembly 286 may be coupled to the upper and lower gages respectively to enhance the actuation of the packing element 280. An exemplary boosting assembly that may be used with the embodiments described herein is disclosed in pending patent application Ser. No. 11/849,281, filed on Sep. 1, 2007, which is herein incorporated by reference in its entirety. The lower gage 282 (or optionally the second boosting assembly 286) is coupled to a bottom sub 290. The bottom sub 290 may include a cylindrical body that is also coupled to the lower end of the setting sleeve 220 and the upper end of a spacer sub 700 to facilitate connection between the upper packer assembly 200 and the lower packer assembly 300. The spacer sub 700 may include a cylindrical body having one or more sections coupled together to space apart the upper packer assembly 200 and the lower packer assembly 300. One or more seals, such as o-rings, may be used to seal the bottom sub 290, setting sleeve 220, and spacer sub 700 interfaces.

The lower packer assembly 300 includes a top sub 310, an inner mandrel 320, an optional centralizer 330, a packing element 340, a fourth support member 350, a second release sleeve 360, a latch member 370, a fifth support member 380, and a guide sub 390. The top sub 310 includes a cylindrical body that is coupled to the lower end of the spacer sub 700 and the upper end of the inner mandrel 320 to facilitate connection between the lower packer assembly 300 and the upper packer assembly 200. One or more seals, such as o-rings, may be used to seal the top sub 310, inner mandrel 320, and spacer sub 700 interfaces. The inner mandrel 320 includes a cylindrical body that is coupled at its lower end to the latch member 370 (further described below).

The top sub 310 may optionally be coupled to a centralizer 330 that is operable to facilitate setting of the lower packer assembly 300. In particular, the centralizer 330 centers the lower packer assembly 300 in the wellbore prior to actuation of the packing element 340 to allow the packing element 340 to uniformly engage and seal against the surrounding wellbore. The centralizer 330 may include a cylindrical body having tapered end surfaces that surrounds part of the inner mandrel 320. The centralizer 330 may be surrounded on each side by an upper cone 331 and a lower cone 332 for actuating the centralizer 330 into engagement with the surrounding wellbore. The upper and lower cones may each include tapered surfaces that correspond with the tapered end surfaces of the centralizer 330 to project the centralizer outwardly into engagement with the surrounding wellbore. The upper cone 331 may be coupled to the top sub 310 and the lower cone 332 may be releaseably coupled to the inner mandrel 320 by a releasable connection 335, such as a breakable connection, to facilitate actuation of the centralizer 330. One example of the releasable connection 335 may include one or more shear pins that are disposed through the body of the lower cone 332 and extends into a recess in the outer surface of the inner mandrel 320. The lower cone 332 may be coupled to an optional boosting assembly as described below.

The top sub 310 (or optionally the centralizer 330) may be coupled to the packing element 340. The packing element 340 may include an elastomeric material that surrounds part of the inner mandrel 320. The packing element 340 may be surrounded on each side by an upper gage 341 and a lower gage 342 for actuating the packing element 340 into engagement with the surrounding wellbore. Optionally a third boosting assembly 345 and a fourth boosting assembly 346 may be coupled to the upper and lower gages respectively to enhance the actuation of the packing element 340. An exemplary boosting assembly that may be used with the embodiments described herein is disclosed in pending patent application Ser. No. 11/849,281, filed on Sep. 1, 2007, which is herein incorporated by reference in its entirety. The lower gage 342 (or optionally the fourth boosting assembly 346) is coupled to the fourth support member 350.

The fourth support member 350 includes a cylindrical body that surrounds part of the inner mandrel 320 and is coupled to the second release sleeve 360 to facilitate setting of lower packer assembly 300. The second release sleeve 360 includes a cylindrical body that surrounds part of the inner mandrel 320 and the latch member 370. The second release sleeve 360 is releaseably coupled to the inner mandrel 320 by a releasable connection 365, such as a breakable connection or one or more shear pins, to facilitate setting of the of the packer assembly 100.

The lower end outer surface of the inner mandrel 320 includes a first set of teeth 321 that engage the upper end of the latch member 370. The upper end of the latch member 370 includes a lock ring configuration 371 similar to the lock ring 245 of the upper packer assembly 200. The engagement between the lower end of the inner mandrel 320 and the upper end of the latch member 370 allows movement between the inner mandrel 320 and the latch member 370 in one direction only, which movement facilitates setting of the lower packer assembly 300. The lower end of the latch member 370 includes one or more latching members 372, such as collets, that are biased radially inward. A support ring 373 holds the latching members 372 in an open (radially outward) position, and is releasably secured to the latching members 372 using connection 375, which may be breakable, such as one or more shear pins. The support ring 373 allows the latching members 372 to engage the inner surface of the second release sleeve 360. In one embodiment, the outer diameter of the support ring 373 is sufficiently sized to urge the latching members 372 against the second release sleeve 360.

The engagement between the latch member 370 and the second release sleeve 360 is configured to transmit the forces required to set and maintain the lower packer assembly 300 in the wellbore. For example, the latching members 372 may engage the second release sleeve 360 using a threaded engagement, a shoulder engagement, or other engagements suitable for transferring axial and/or torsional forces therebetween. In this respect, the engagement also prevents relative axial and/or rotational movement between the latch member 370 and the second release sleeve 360.

Release of the engagement permits the relative movement between the second release sleeve 360, the latch member 370, and the inner mandrel 320 necessary to unset the lower packer assembly 300. The support ring 373 controls the release of the engagement between the latch member 370 and the second release sleeve 360. The releasable connection 375 couples the support ring 373 to the latch member 370 only, and is therefore independent of the second release sleeve 360. In this respect, the releasable connection 375 is isolated from the load path provided by the engagement between the latch member 370 and the second release sleeve 360. The releasable connection 375 therefore does not experience any of the forces transferred through the latch member 370 and the second release sleeve 360 during the setting and normal operation of the packer assembly 100. In this manner, unintentional or premature release of the packer assembly may be avoided, and an independent control for unsetting the lower packer assembly 300 is provided.

The releasable connection 375 allows the packer assembly to be used in many applications where unintended external forces may act upon the packer assembly. The external forces may be produced by various thermal and pressure differentials exposed to the components of the lower packer assembly 300 as it is lowered and set in the wellbore. For example, a pressure differential across the packing element 340 may provide a force across the latch member 370 and second release sleeve 360 engagement. However, the releasable connection 375 is configured such that it is not subject to this force or any loads transferred between the latch member 370 and the second release sleeve 360, and therefore, retains its integrity. In this respect, the releasable connection 375 is prevented from accidental or premature release and thus unsetting of the lower packer assembly 300. The releasable connection 375 therefore allows the lower packer assembly 300 to be utilized in high temperature and pressure differential environments. Furthermore, this allows the straddle packer assembly to be configured without any additional provision to accommodate loading of the components during operation. For example, slip joints, expansion joints and the like (which incorporate telescoping sleeves and seals to compensate for changing axial tension and compression loads) are superfluous, and therefore may be omitted from the straddle assembly, thereby rendering the straddle assembly simpler, cheaper and more reliable than prior art devices.

The second release sleeve 360 is coupled to the fifth support member 380. The fifth support member 380 includes a cylindrical body that is coupled to the guide sub 390. The guide sub 390 includes a cylindrical body that is operable to direct the packer assembly 100 into the wellbore as it is lowered into the wellbore. A releasable connection 395, such as a shear ring, is located between shoulders formed on the inner surfaces of the fifth support member 380 and the guide sub 390. The releasable connection 395 is used to set the maximum force necessary to complete the setting of the packer assembly 100 in the wellbore.

The setting assembly 400 is disposed within the upper packer assembly 200, the lower packer assembly 300 and the spacer subs 700. The setting assembly 400 is operable to facilitate setting of the packer assemblies. The setting assembly 400 includes an adapter sub 401, a setting sleeve 402, a setting tool adapter 410, a coupling member 420, an inner mandrel 430, and a bottom sub 440.

The adapter sub 401, the setting sleeve 402, and the setting tool adapter 410 are operable to facilitate connection between the packer assembly 100 and the setting tool 500. The adapter sub 401 may include a cylindrical body that is coupled to the setting tool 500 at its upper end and is coupled to the setting sleeve 402 at its lower end. The setting sleeve 402 may include a cylindrical body that is coupled to the adapter sub 401 at its upper end and is releaseably coupled to the retrieval sleeve 210 of the upper packer assembly 200. In one embodiment, an end face of the setting sleeve 402 may engage, such as abut, an end face of the retrieval sleeve 210 in a manner that the setting sleeve 402 may be released from the engagement by moving, such as lifting, the setting sleeve 402 from the retrieval sleeve 210. The adapter sub 401 is adapted to transfer a push force, such as a downward force, from the setting tool 500 to the setting sleeve 402, which then transfers the force to the retrieval sleeve 210 and thus the upper packer assembly 200. The setting tool adapter 410 may be coupled to the setting tool 500 at its upper end and coupled to the coupling member 420 at its opposite end. The setting tool adapter 410 is adapted to transfer a pull force, such as an upward force, from the setting tool 500 to the remainder of the setting assembly 400 (except for the adapter sub 401 and setting sleeve 402), which then transfers the force to the lower packer assembly 300. The setting tool adapter 410 may include a cylindrical body having a threaded upper end and one or more openings 411 disposed through the body in communication with a flow path 412 partially disposed through the lower end of the body. The coupling member 420 may be utilized to couple the lower end of the setting tool adapter 410 to the upper end of the inner mandrel 420. The coupling member 420 may include a cylindrical body having a flow path 421 disposed through the body and in communication with the flow path 412 of the setting tool adapter 410. The flow path 421 of the coupling member 420 may also be in communication with a flow path 431 disposed through the inner mandrel 430. The inner mandrel 430 may include a cylindrical body having the flow path 431 extend through the longitudinal length of the body. The inner mandrel 430 may include one or more sections coupled together using one or more coupling members 435 to allow the setting assembly 400 to extend from the upper packer assembly 200 to the lower packer assembly 300. The one or more inner mandrel 430 and the one or more coupling members 435 are coupled together to allow the flow path 431 to extend from the setting tool adapter 410 to the bottom sub 440.

The bottom sub 440 is coupled to and partially surrounds the lower end of the inner mandrel 430. The bottom sub 440 may include a cylindrical body having a shoulder 441 disposed on the outer surface of the bottom sub 440. The bottom sub 440 includes a stop member 442 surrounding the upper end of the bottom sub 440 adjacent the shoulder 441. A gap is located between the stop member 442 and the shoulder 441 for engagement with the releasable connection 395 of the lower packer assembly 300. The bottom sub 400 facilitates connection between the setting assembly 400 and the lower packer assembly 300.

FIGS. 1A-D illustrate a run-in position of the packer assembly 100 according to one embodiment of the invention. In operation, the setting tool 500 is coupled to the packer assembly 100 and is positioned in a wellbore in a run-in position as shown in FIGS. 1A-D. The setting tool 500 and the packer assembly 100 may be lowered in the wellbore using a conveyance member, such as jointed pipe, coiled tubing, Corod, slickline, or wireline. The setting tool 500 may be coupled to the setting tool adapter 410 and may also abut the upper end of the retrieval sleeve 210. In a single trip into the wellbore, the setting tool 500 and the packer assembly 100 (including the setting assembly 400) may be positioned in the wellbore, the setting tool 500 may set and secure the packer assembly 100 in the wellbore, and the setting tool 500 and the setting assembly 400 may be removed from the wellbore. The setting tool 500 may be coupled to the packer assembly 100 when it is positioned in the wellbore and may be decoupled from the packer assembly 100 when it is removed from the wellbore. The packer assembly 100 may then be unset and retrieved from the wellbore in a single trip into the wellbore.

In one embodiment, the setting tool 500 may include a hydraulic setting tool that is coupled to the packer assembly 100 in a manner that provides a pull force, such as an upward force, to the setting tool adapter 410 of the setting assembly 400 and thus the lower packer assembly 300 and a push force, such as a downward force, to the adapter sub 401 and thus the upper packer assembly 200. The setting tool 500 may include one or more pistons 510 surrounded by a housing 520 that are in fluid communication with an inner mandrel 530. The inner mandrel 530 is in fluid communication with the conveyance member on which the setting tool 500 and the packer assembly 100 are connected too. The housing 520 may be coupled to adapter sub 401 and the inner mandrel 530 may be coupled to the setting tool adapter 410. A valve 540, such as a check valve (for example a ball and seat arrangement), may be provided in the inner mandrel 530 to prevent fluid from flowing through the setting tool 500 to actuate the one or more pistons 510. A fluid may be supplied to the inner mandrel 530 of the setting tool 500 and communicated to the one or more pistons 510 to actuate the pistons 510, thereby providing a pull force, such as an upward force, to the setting tool adapter 410 and thus the lower packer assembly 300 via the inner mandrel 530 and a push force, such as a downward force, to the adapter sub 401 and thus the upper packer assembly 200 via the housing 520 to secure and set the packer assembly 100 in the wellbore.

FIGS. 2A-D illustrate a first setting position of the packer assembly 100 according to one embodiment of the invention. A portion of the setting tool 500 has been removed from FIGS. 2A-D to 4A-D to focus on the operation of the packer assembly 100. The setting tool 500 may be actuated electrically, hydraulically, or mechanically for setting of the packer assembly 100 in the wellbore. The setting tool 500 is actuated to provide a pull force, such as an upward force, on the setting tool adapter 410 and thus the lower packer assembly 300, while providing a push force, such as a downward force, on the retrieval sleeve 210 via the adapter sub 401 and setting sleeve 402. The pull force is transferred from the setting assembly 400 to the lower packer assembly 300 by the releasable connection 395 and bottom sub 440 engagement. The pull force is transferred from the releasable connection 395 to the fifth support member 380 to the second release sleeve 360 to the inner mandrel 320 (via the releasable connection 365) and to the top sub 310 of the lower packer assembly 300, through the spacer subs 700, and to the setting sleeve 220 of the upper packer assembly 200. At the same time, the push force is provided on the retrieval sleeve 210 until the opposing forces release the releasable connection 225 between the retrieval sleeve 210 and the setting sleeve 220 to allow relative movement therebetween. The releasable connection 225 may be operable to control the setting force of the slips 265. In one embodiment, the releasable connection 225 may release by applying a 10,000 pound force to the releasable connection 225. The setting tool 500 continues to provide the push force to the retrieval sleeve 210, thereby moving the retrieval sleeve 210, the first support member 230, the release sleeve 240, the protection member 248, and the second support member 250, each relative to the setting sleeve 220. In one embodiment, the protection member 248 may be actuated outwardly into engagement with the wellbore by axial compression between the release sleeve 240 and the housing 260. Upon actuation, the protection member 248 may prevent unwanted materials from falling past the protection member 248 and interfering with the operation of the slips 265, the packing element 280, and any other components located below the protection member 248. The second support member 250 also directs the first cone 261 toward the second cone 262 and outwardly projects the slips 265 into engagement with the surrounding wellbore to secure the packer assembly 100 in the wellbore. The lock ring 245 is also moved into engagement with the second set of teeth 222 disposed on the setting sleeve 220 to prevent movement of the retrieval sleeve 210 in the opposite direction and unsetting of the slips 265. Once the slips 265 are actuated into engagement with the wellbore, the push force is transferred through the slips 265 to the wellbore and the pull force is then utilized to actuate the packing element 340 into engagement with the wellbore.

FIGS. 3A-D illustrate a second setting position of the packer assembly 100 according to one embodiment of the invention. The pull force is transferred from the setting assembly 400 to the lower packer assembly 300 by the releasable connection 395 and bottom sub 440 engagement. The pull force is transferred from the releasable connection 395 to the fifth support member 380 to the second release sleeve 360 to the inner mandrel 320 (via the releasable connection 365) and to the top sub 310 of the lower packer assembly 300, through the spacer subs 700, and to the bottom sub 290 and the setting sleeve 220 of the upper packer assembly 200. The pull force compresses the packing element 280 between the bottom sub 290 and the third support member 270, which is supported by the slips 265 (and the housing 260). In particular, the packing element 280 is compressed between the upper gage 281 and the lower gage 282 and actuated into sealing engagement with the wellbore. As stated above, optionally a first boosting assembly 285 and a second boosting assembly 286 may be used to enhance the actuation of the packing element 280 into sealing engagement with the wellbore. The first and second boosting assemblies may be actuated using pull force applied to the upper packer assembly 200.

FIGS. 4A-D and 5A-D illustrate third and fourth setting positions, respectively, of the packer assembly 100 according to one embodiment of the invention. After the upper packer assembly 200 is set, the pull force is transferred from the setting assembly 400 to the lower packer assembly 300 by the releasable connection 395 and bottom sub 440 engagement. The pull force is transferred from releasable connection 395 to the fifth support member 380 to the second release sleeve 360 and to the inner mandrel 320 (which is supported by the upper packer assembly 200 via the spacer subs 700 and top sub 310) by the releasable connection 365. The releasable connection 365 may be used to control the setting force of the packing element 280. In one embodiment, the releasable connection 365 may release by applying a 30,000 pound force to the releasable connection 365. The pull force is applied until the releasable connection 365 releases the engagement between the inner mandrel 320 and the second release sleeve 360 to allow relative movement therebetween. The pull force may then be directed to the second release sleeve 360, the fourth support member 350, the packing element 340, and optionally the centralizer 330 (which is supported by the top sup 310) to actuate the packing element 340 and the centralizer 330. When the second release sleeve 360 (which is coupled to the latch member 370) is moved relative to the inner mandrel 320 in an upward direction, the upper end of the latch member 370 having the lock ring configuration 371 engages the first set of teeth 321 on the lower end outer surface of the inner mandrel 320 to prevent movement in the opposite direction and unsetting of the centralizer 330 and the packing element 340 as discussed below.

In one embodiment, the pull force directed through the second release sleeve 360 and the fourth support member 350 may be used to compress the packing element 340 between the fourth support member 350 and the top sub 310. In particular, the packing element 340 may be compressed between the upper gage 341 and the lower gage 342 to actuate the packing element 340 into sealing engagement with the wellbore. The lower gage 342 may be directed towards the upper gage 342 via the pull force that is transferred through the fourth support member 350, the second release sleeve 360, the fifth support member 380, the releasable connection 395, and the setting assembly 400. As stated above, optionally a third boosting assembly 345 and a fourth boosting assembly 346 may be used to enhance the actuation of the packing element 340 into sealing engagement with the wellbore. The third and fourth boosting assemblies may be actuated using pull force applied to the upper packer assembly 200.

In one embodiment, the pull force directed through the second release sleeve 360, the fourth support member 350, and the packing element 340 may be used to actuate the centralizer 330 between the packing element 340 and the top sub 310. In particular, the lower cone 332 may be directed toward the upper cone 331, thereby projecting the centralizer 330 radially outward into engagement with the wellbore. The tapered surfaces of the centralizer 330 move up the corresponding tapered surfaces of the lower cone 332 and the upper cone 331 as the lower cone 332 is directed toward the upper cone 331. The pull force may be used to release the releasable connection 335 between lower cone 332 and the inner mandrel 320 to allow relative movement therebetween. The centralizer 330 may position the lower packer assembly 300 in the wellbore such that the longitudinal axis of the lower packer assembly 300 and the wellbore are in substantial alignment. The centralizer 330 may assist in providing a more uniform sealed engagement of the packing element 340 with the wellbore. After actuation of the centralizer 330, the pull force may then be used to actuate the packing element 340 (between the centralizer 330 and the fourth support member 350) as discussed above.

FIGS. 5A-D illustrate the fourth setting position of the packer assembly 100 according to one embodiment of the invention. The setting tool 500 will continue to apply the pull force to the packer assembly 100 until the setting assembly 400 is released from engagement with the lower packer 300. The pull force is transferred from the setting assembly 400 to the lower packer assembly 300 by the releasable connection 395. After the upper packer assembly 200 and the lower packer assembly 300 have been actuated and set in the wellbore, the pull force will release the releasable connection 395 between the lower packer assembly 300 and the setting assembly 400. The releasable connection 395 may be operable to control the setting force of the packing element 340. In one embodiment, the releasable connection 395 may release by applying a 40,000 pound force to the releasable connection 395. The setting tool 500 and the setting assembly 400 may then be retrieved and removed from the wellbore.

As shown in FIGS. 5A-D, the setting tool 500 and the setting assembly 400 have been removed from the wellbore. The upper packer assembly 200, the lower packer assembly 300, and the spacer subs 700 are secured in the wellbore and may sealingly isolate an area of interest in a formation adjacent the wellbore. One or more flow devices, such as a sliding sleeve, a safety valve, a side pocket mandrel, flow sub, etc., may be coupled between the upper packer assembly 200 and the lower packer assembly 300 to facilitate one or more downhole operations, such as a treatment operation to treat the area of interest to enhance the recovery of a fluid from the formation. The flow devices may be coupled to the spacer subs 700 to between the upper and lower packer assemblies to conduct the downhole operations.

FIGS. 6A-6D illustrate a retrieval tool 600 according to one embodiment of the invention. The retrieval tool 600 is operable to retrieve the packer assembly 100 from the wellbore in a single trip into the wellbore. The retrieval tool 600 may be lowered into the wellbore and engage the lower packer assembly 300 and the upper packer assembly 200, and then unset the lower packer assembly 300 and the upper packer assembly 200, and then remove the upper and lower packer assemblies with the spacer subs 700 from the wellbore in a single trip into the wellbore. The retrieval tool 600 is also operable to release from engagement with the upper and lower packer assemblies during a retrieval operation in the event that either of the packer assemblies (or the spacer subs and any other flow devices attached thereto) may not be released from engagement with the wellbore or are otherwise prevented from being removed from the wellbore.

The retrieval tool 600 includes an upper retrieval assembly 601 and a lower retrieval assembly 602. The upper retrieval assembly 601 includes a top sub 610, an inner mandrel 620, an adapter sub 625, an outer sleeve 630, a piston housing 635, a support member 640, a retrieval sleeve 645, a first latch member 650, and a bottom sub 655. The upper retrieval assembly 601 is operable to engage and unset the upper packer assembly 200. The inner mandrel 620 extends from the upper retrieval assembly 601 to the lower retrieval assembly 602 to provide connection therebetween. One or more coupling members 660 may be used to couple multiple sections of the inner mandrel 620 together so that the retrieval tool 600 is configured to engage both the upper and lower packer assemblies of the packer assembly 100. The lower retrieval assembly includes a second inner mandrel 665, a second latch member 670, a releasable connection 675, and a guide sub 680. The lower retrieval assembly 602 is operable to engage and unset the lower packer assembly 300.

The top sub 610 may include a cylindrical body that surrounds part of and is coupled to the each of the inner mandrel 620 and the adapter sub 625. The top sub 610 may be configured to couple the retrieval tool 600 to a conveyance member including jointed pipe, coiled tubing, Corod, slickline, or wireline for introduction into and removal from the wellbore. The top sub 610 may include a flow path in communication with a flow path of the inner mandrel 620. The inner mandrel 620 may also include a cylindrical body having an opening 621, such as a port, extending through the body to provide communication with the flow path of the inner mandrel 620. The flow path of the inner mandrel 620 is also in communication with the lower retrieval assembly 602.

The adapter sub 625 includes a cylindrical body that surrounds part of the inner mandrel 620 and is releaseably coupled to the top sub 610 by a releasable connection 611, such as one or more shear pins. A seal 626, such as an o-ring, may be provided between the adapter sub 625/inner mandrel 620 interface. The top sub 610 and the inner mandrel 620 are slideably disposed relative to the adapter sub 625 upon release of the releasable connection 611. The adapter sub 625 is coupled to the upper end of the piston housing 635 using a set screw for example. The piston housing 635 includes a cylindrical body surrounding a part of the inner mandrel 620 and coupled to the bottom sub 655 at its lower end. A seal 627, such as an o-ring, may be provided between the adapter sub 625/piston housing 635 interface. A connection member 628, such as a c-ring, is disposed in a recess in the outer surface of the adapter sub 625 and is surrounded by the outer sleeve 630, which has a corresponding recess disposed in its inner surface for engagement with the connection member 628 upon relative movement therebetween to provide a connection between the adapter sub 625 and the outer sleeve 630. The connection member 628 may retain the retrieval tool 600 in a released position upon engagement with the recess in the outer sleeve 630. The outer sleeve 630 includes a cylindrical body that is coupled to the support member 640.

The support member 640 includes a cylindrical body surrounding the piston housing 635 and supporting a biasing member 641, such as a spring. The biasing member 641 engages a shoulder disposed on the inner surface of the support member 640 at one end, and engages a releasable connection 690 at the opposite end. The releasable connection 690 is coupled to the piston housing 635 adjacent the adapter sub 625 and is operable to limit relative movement between the adapter sub 625 and the outer sleeve 630. The releasable connection 690 may include a cylindrical body surrounding the piston housing 635 and having a shearable member disposed through the body of the releasable connection 690 and partially disposed through the piston housing 635. One or more seals 642, such as o-rings, may be provided between the support member 640/piston housing 635 interface. The seals 642 are located on opposite sides of a chamber 644 formed between a shoulder disposed on the inner surface of the support member 640 and a shoulder disposed on the outer surface of the piston housing 635. The piston housing 635 includes an opening 636 disposed through its body in communication with the chamber 644 and the opening 621 and thus the flow path of the inner mandrel 620.

The support member 640 is also coupled to the retrieval sleeve 645 and abuts the latch member 650. The retrieval sleeve 645 includes a cylindrical body surrounding and supporting the lower end of the latch member 650. The latch member 650 may include one or more latching members, such as collets, that are biased radially inward. The latch member 650 is projected radially outward by a tapered shoulder on the outer surface of the piston housing 635 for engagement with the packer assembly 100.

The lower end of the piston housing 635 is coupled to the bottom sub 655. The bottom sub 655 includes a cylindrical body surrounding a part of the inner mandrel 620. A seal 667, such as an o-ring, may be provided between the bottom sub 655/inner mandrel 620 interface. A seal 668, such as an o-ring, may be provided between the bottom sub 655/piston housing 635 interface.

As stated above, one or more coupling members 660 may be provided to couple one or more sections of the inner mandrel 620 together. A coupling member 660 may include a cylindrical body having a flow path disposed through the body in communication with the inner mandrel 620. A coupling member 660 may also be used to couple the inner mandrel 620 to a second inner mandrel 665 of the lower retrieval assembly 602 such that the flow path of the inner mandrel 620 is in communication with a flow path of the second inner mandrel 665. One or more seals, such as o-rings, may be provided between the coupling member 660/inner mandrel 620/second inner mandrel 665 interfaces.

The second inner mandrel 665 may include a cylindrical body that is coupled at its lower end to the guide sub 680. The second latch member 670 is coupled to and surrounds the second inner mandrel 665 and abuts a coupling member 660. The second latch member 670 is slideably disposed on the second inner mandrel 665. The second latch member 670 includes a cylindrical body having one or more latching members, such as collets, for engagement with the lower packer assembly 300. A releasable connection 675 is coupled to the second inner mandrel 665 adjacent the second latch member 670. The releasable connection 675 is configured to facilitate engagement of the second latch member with the lower packer assembly 300. The releasable connection 675 may include a cylindrical body surrounding the second inner mandrel 665 and having a shearable member disposed through the body of the releasable connection 675 and partially disposed through the second inner mandrel 665. The second inner mandrel 665 may also include a shoulder disposed on its outer surface adjacent the releasable connection 675 to prevent interference with the second latch member 670 upon release of the releasable connection 675.

The guide sub 680 may include a cylindrical body having a flow path disposed through the body in communication with the flow path of the second inner mandrel 665. The guide sub 680 may be used to guide the retrieval tool 600 into the wellbore and the packer assembly 100. The guide sub 680 may also include one or more openings 681, such as ports or orifices, to allow fluid passage therethrough. The openings 681 of the guide sub 680 may also be used to generate a back pressure within the retrieval tool 600 (upon the flow of fluid through the retrieval tool 600) to actuate the retrieval tool 600 as described below.

FIGS. 7A-D illustrate the retrieval tool 600 disposed within and engaged with the packer assembly 100. The packer assembly 100 is shown in a set position. As illustrated, the retrieval tool 600 is inserted into the packer assembly 100 until the first latch member 650 engages the retrieval sleeve 210 of the upper packer assembly 200. The latch member 650 is supported in the normal and true position by the tapered shoulder of the piston housing 635. Once engaged, a pull force applied to the retrieval tool 600 will also be applied to the packer assembly 100. In one embodiment, the latching members of the first latch member 650 may attach to a threaded arrangement disposed on the inner surface of the retrieval sleeve 210. Also, an end face of the retrieval sleeve 645 (of the retrieval tool 600) may also engage an end face of the retrieval sleeve 210 (of the upper packer assembly 200) to prevent complete insertion of the retrieval tool 600 into the packer assembly 100. Upon engagement, the second latch member 670 of the lower retrieval assembly 602 extends beyond the latch member 370 of the lower packer assembly.

FIGS. 8A-D illustrate the lower packer assembly 300 in an unset position. Upon engagement with the packer assembly 100, a pull force, such as an upward force may be applied to the retrieval tool 600. The pull force is transferred from the top sub 610 to the adapter sub 625 (via the releasable connection 611) to the piston housing 635 to the first latch member 650 and then to the retrieval sleeve 210 of the upper packer assembly 200. A reaction force is provided by engagement with packer assembly 100. The opposing forces are applied until the releasable connection 611 releases the connection between the top sub 610 and the adapter sub 625, thereby allowing relative movement between the top sub 610, the inner mandrel 620, and the remaining components of the upper retrieval assembly 601.

The pull force applied to the top sub 610 is transferred through the inner mandrel 620 to the lower retrieval assembly 602 such that the second latch member 670 of the lower retrieval assembly 602 is biased into engagement with the support ring 373 of the lower packer assembly 300 by the releasable connection 675 of the lower retrieval assembly 602. The pull force is then transferred from the support ring 373 to the latching members 372 of latch member 370 of the lower packer assembly 300 until the releasable connection 375 releases the support ring 373 from the latching members 372. After the support ring 373 is released from the latch member 370, the latching members 372 are permitted to bias radially inward, thereby releasing the coupled engagement between the latch member 370 and the second release sleeve 360. The second release sleeve 360 is coupled to the fourth support member 350, the packing element 340, and optionally to the boosting assemblies 345, 346 and the centralizer 330. In particular, a push force, such as a downward force supplied by gravity, may move the release sleeve 360 in a direction away from the packing element 340 and the centralizer 330, thereby allowing the packing element 340 and the centralizer 330 to unset from engagement with the wellbore. The pull force may continued to be applied to the second latch member 650, which may then move the released support ring 373 against an inner shoulder of the latch member 370. The second latch member 650 may then be positioned between the released support ring 373 and the releasable connection 675 as the force is applied to the second latch member 650, until the releasable connection 675 is released to allow the second latch member 670 to bias inward to facilitate retrieval of the packer assembly 100.

FIGS. 9A-D illustrate the upper packer assembly 200 in an unset position and the packer assembly 100 configured in a retrieved position. Once the lower packer assembly 300 is unset from engagement with the wellbore, the pull force may continue to be applied to the top sub 610 and inner mandrel 620 until one of the coupling members 660 is moved into engagement with the bottom sub 655 of the upper retrieval assembly 601. When released from the releasable connection 675 as stated above, the second latch member 670 may be directed through the lower packer assembly 300 and allow the coupling member 660 to engage the bottom sub 655. The pull force may then be transferred from the bottom sub 655 to the first latch member 650 to the retrieval sleeve 210 of the upper packer assembly 200.

The retrieval sleeve 210 is coupled to the packing element 280 and the slips 265 via the first support member 230, the release sleeve 240, the second support member 250, and the third support member 270. The pull force is transferred from the retrieval sleeve 210 to the first support member 230 to the release sleeve 240 and to the second support member 250, which is supported by the slips 265, via the releasable connection 251 until the releasable connection 251 releases the release sleeve 240 and the second support member 250 to allow relative movement therebetween. The release sleeve 240 is moved in an upward direction relative to the second support member 250, thereby allowing the outer ring 246 of the lock ring 245 to disengage into the recesses 241 on the inner surface of the release sleeve 240 and allow relative movement between the second support member 250 and the inner mandrel 220.

As the release sleeve 240 is moved further in an upward direction, a shoulder on the inner surface of the release sleeve 240 abuts a corresponding shoulder on the outer surface of the second support member 250 to move the support member 250 and thus the first cone 261 away from the second cone 262, thereby unsetting the slips 265 from engagement with the wellbore. The upward movement of the second support member 250 via the release sleeve 240, the first support member 230, and the retrieval sleeve 210 by the retrieval tool 600, also allows the packing element 280 to unset from engagement with the wellbore by moving the upper gage 281 away from the lower gage 282. The upward movement of the first support member 230 also moves the support ring 235 into engagement with the first set of teeth 221 disposed on the outer surface of the setting sleeve 220 to prevent movement of the first support member 230 in the opposite direction and resetting of the slips 265 or the packing element 280. A shoulder on the inner surface of the first support member 230 finally engages a shoulder formed on the outer surface of the setting sleeve 220 to retrieve the remainder of the upper packer assembly 200, the spacer subs 700, and the lower packer assembly 300.

In the event that any portion of the packer assembly 100 does not disengage from the wellbore or is otherwise prevented from being removed from the wellbore, such as becoming stuck in the wellbore while being removed from the wellbore, after the retrieval tool 600 has engaged with the packer assembly 100, the retrieval tool 600 is operable to disengage from the packer assembly 100 so that the retrieval tool 600 may be removed from the wellbore and a recovery operation may be conducted to remove the packer assembly 100 from the wellbore.

FIGS. 10A-D illustrate the retrieval tool 600 in an engaged position with the packer assembly 100. The retrieval tool 600 may include a hydraulic release mechanism and a mechanical release mechanism. The hydraulic release may include flowing a fluid through the retrieval tool 600 to allow the retrieval tool 600 to disengage from the packer assembly 100. The mechanical release mechanism may include a jarring release and/or a rotational release. The jarring release may include applying a push force, such as a downward force, for example setting down the weight of conveyance member and the retrieval tool 600 against the packer assembly 100, to the retrieval tool 600 to allow the retrieval tool 600 to disengage from the packer assembly 100. Another jarring release may include applying a pull force, such as an upward force, to the retrieval tool 600 to allow the retrieval tool 600 to disengage from the packer assembly 100.

As illustrated in FIGS. 10A-D, the rotational release may include rotating the retrieval tool 600 relative to the packer assembly 100 to allow the retrieval tool 600 to disengage from the packer assembly 100. After the first latch member 650 engages the retrieval sleeve 210, the retrieval tool 600 may be rotated via the top sub 610 using the tubular sting to disengage the first latch member 650 from the retrieval sleeve 210. The first latch member 650 may include a right or left hand threaded engagement with the retrieval sleeve 210. Rotation of the retrieval tool 600 and thus the first latch member 650 relative to the retrieval sleeve 210 may allow the first latch member 650 to unthread and back out from engagement with the retrieval sleeve 210. Upon disengagement, the retrieval tool 600 may be removed from the packer assembly 100 and the wellbore.

FIGS. 11A-D illustrates a first release position of the retrieval tool 600 with the packer assembly 100 after initial engagement with the packer assembly 100. A fluid is supplied through top sub 610, the inner mandrel 620, the second inner mandrel 665, and the one or more openings 681 of the guide sub 680. The fluid may be supplied through the retrieval tool 600 at a flow rate sufficient enough to increase the pressure in the inner mandrel 620. The pressure may be communicated from the flow path of the inner mandrel 620 through the opening 621 of the inner mandrel 620 and to the chamber 644 between the piston housing 635 and the support member 640 via the opening 636 of the piston housing 635. As pressure develops in the chamber 644, the support member 640 and the piston housing 635 are forced in opposite directions. The support member 640 is supported by the first latch member 650, which is initially engaged with the packer assembly 100. The piston housing 635 is moved relative to the first latch member 650 in a downward direction. As the piston housing 635 is directed in a downward direction, the radially inward biased first latch member 650 travels along the tapered shoulder of the piston housing 635, thereby releasing engagement with the retrieval sleeve 210 of the upper packer assembly 200. Upon the disengagement of the first latch member 650 and the retrieval sleeve 210, the retrieval tool 600 may then be removed from packer assembly 100 and the wellbore. The fluid may be continuously supplied through the retrieval tool 600 while a pull force, such as an upward force, is applied to the retrieval tool 600 to remove it from the packer assembly 100 and the wellbore.

FIGS. 12A-D illustrate a second release position of the retrieval tool 600 with the packer assembly 100 after initial engagement with the packer assembly 100. Similar to the first release position described above, the piston housing 635 is moved relative to the first latch member 650 to allow the first latch member 650 to bias radially inward and release from engagement with the retrieval sleeve 210 of the upper packer assembly 200. A push force, such as a downward force, is applied to the top sub 610, which is transferred to the adapter sub 625 (via a bearing shoulder therebetween) and to the piston housing 635. The piston housing 635 is moved relative to the first latch member 650, which is initially engaged with the retrieval sleeve 210, so that the first latch member 650 may bias radially inward as it travels down the tapered shoulder of the piston housing 635. The retrieval sleeve 645 of the retrieval tool 600 abuts the end face of the retrieval sleeve 210 of the upper packer assembly 200 and provides a reaction force to the support member 640 and the outer sleeve 630, thereby allowing the piston housing 635 and the adapter sub 625 to move relative to the support member 640 and the outer sleeve 630. As the adapter sub 625 and the piston housing 635 are moved relative to the support member 640, the biasing member 641 is compressed between the support member 640 and the releasable connection 690, which is coupled to the piston housing 635, until the releasable connection 690 releases and allows further relative movement between the adapter sub 625 and the outer sleeve 630. The releasable connection 690 may release as it is directed against an end face of the support member 640. Upon release of the releasable connection 690, the adapter sub 625 may move the connection member 628 into engagement with the corresponding recess in the inner surface of the outer sleeve 630 to provide a connection between the adapter sub 625 and the outer sleeve 630. The connection member 628 may retain the retrieval tool 600 in the second release position upon engagement with the recess in the outer sleeve 630 by preventing the shoulder of the piston housing 635 from biasing the first latch member 650 into engagement with the retrieval sleeve 210. Once disengaged, the retrieval tool 600 may be removed from the packer assembly 100 and the wellbore.

FIGS. 13A-D illustrate a full retrieval position of the packer assembly 100 using the retrieval tool 600, wherein the packer assembly 100 is unset from engagement with the wellbore, and FIGS. 14A-D illustrate a third release position of the retrieval tool 600 with the packer assembly 100 after initial engagement with the packer assembly 100 in the event the packer assembly 100 is prevented from being removed from the wellbore. As illustrated in FIGS. 13A-D, a pull force, such as an upward force, is applied to the top sub 610 (which has been released from engagement with the adapter sub 625 as described above with respect to FIGS. 8A-D during unsetting of the packer assembly 100) to retrieve the setting tool 600 and the packer assembly 100 via the first latch member 650/retrieval sleeve 210 engagement. As illustrated in FIGS. 14A-D, in the event that the packer assembly 100 is prevented from being removed from the wellbore, the top sub 610/inner mandrel 620 interface may include a break point 613 that will allow top sub 610 to release from the inner mandrel 620 by applying an excessive force to the break point 613. Upon release of the top sub 610 from the inner mandrel 620, a shoulder 614 disposed on the outer surface of the inner mandrel 620 may engage a shoulder 615 disposed on the inner surface of the adapter sub 625 to support the inner mandrel 620 and the remainder of the retrieval tool 600 and prevent the remainder of the retrieval tool 600 from falling through the packer assembly 100. A retrieval profile 622 may be exposed on the outer surface of the adapter sub 625 and/or the inner mandrel 620 upon release from the top sub 610 for engagement with another retrieval tool to facilitate a subsequent recovery operation.

Figure 15:
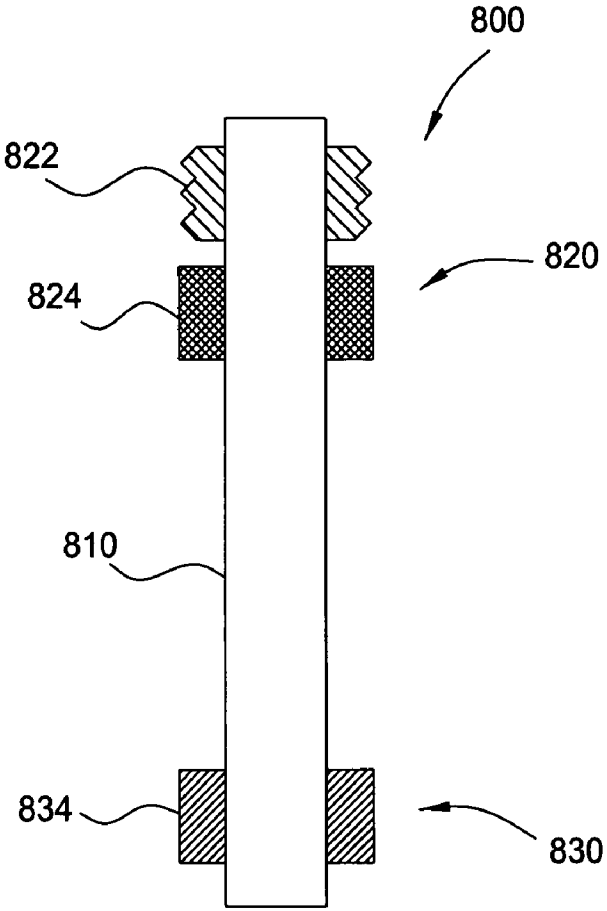
FIGS. 15-17 illustrate additional embodiments of a packer assembly.
Figure 16:
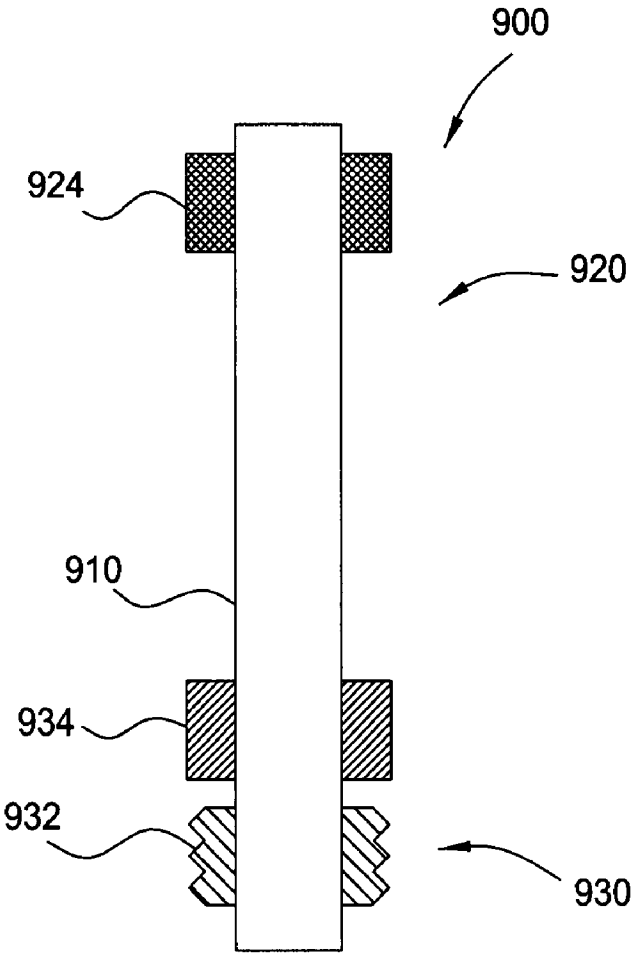
Figure 17:
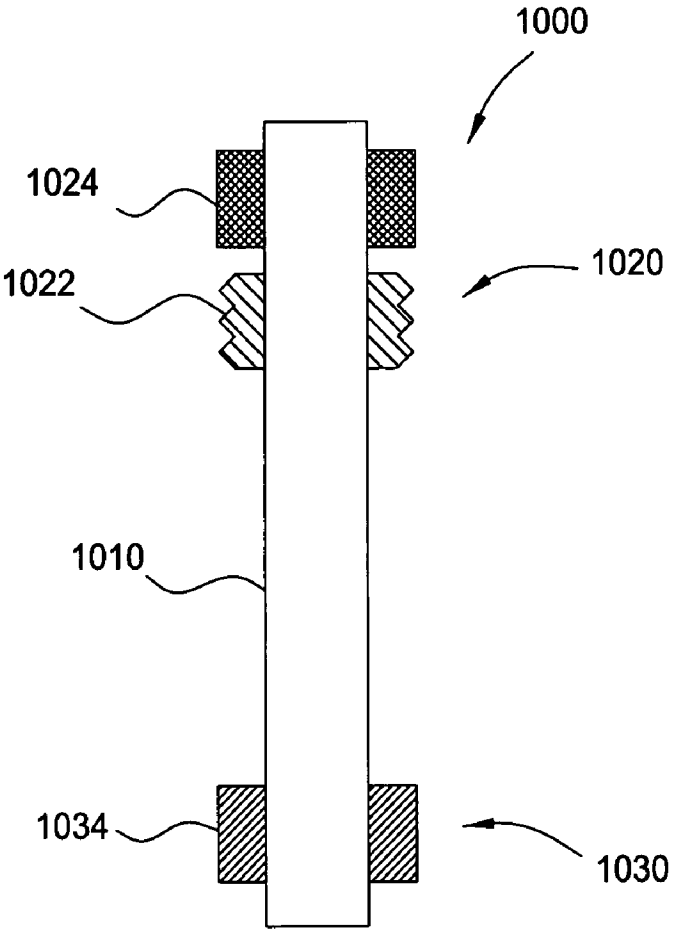

FIGS. 15, 16, and 17 illustrate embodiments of a packer assembly that are configured to be set in and retrieved from a wellbore in a single trip. In these embodiments, each packer assembly utilizes a single tubular member to transmit opposing setting forces to set the assembly in the wellbore. The tubular member is operable as a conduit through which a setting force is transmitted to actuate one or more of the components coupled to the tubular member. An opposing setting force may be directed to one or more of the other components coupled to the tubular member to actuate these components. Relative movement between the tubular member and each of the components permits the actuation of each component into engagement with the wellbore. By utilizing a single tubular member, one or more devices, such as sliding sleeves, safety valves, side pocket mandrels, gauge carriers, flow subs, flow ports (with/without sleeves), sand control screens, etc., can also be included in the packer assembly without modification to the structure of the packer assembly or the manner in which it is set and retrieved. These devices may be coupled to the tubular member between an upper packer and a lower packer without compromising the operation of the packer assembly. The addition of the one or more devices to the packer assembly provides great flexibility to the number of applications that the packer assembly may accommodate. In one embodiment, each packer assembly is also secured to the wellbore at one location, using a gripping member for example, which reduces the number of forces needed to set the packer assembly in the wellbore and allows the packer assembly to be detached more easily from the wellbore than when using two or more secured locations. In one embodiment, the gripping member may include multiple slips positioned circumferentially on the packer assembly that are capable of being set simultaneously.

FIG. 15 illustrates one embodiment of a packer assembly 800. The packer assembly 800 may be set in and retrieved from the wellbore using embodiments of the packer assembly 100 described above. The packer assembly 800 may be lowered and set during a single trip into a wellbore. The packer assembly 800 may also be unset and removed during a single trip into the wellbore. The packer assembly 800 includes a body 810, an upper packer assembly 820, and a lower packer assembly 830. The body 810 may include a tubular member having a bore disposed therethrough. The upper and lower packer assemblies 820 and 830 are coupled to and spaced apart on the body 810. The upper packer assembly 820 includes a gripping member 822 disposed above an upper packing element 824, and the lower packer assembly 830 includes a lower packing element 834. In operation, the packer assembly 800 may be lowered into the wellbore using a conveyance member, such as jointed pipe, coiled tubing, Corod, slickline, or wireline, and located adjacent an area of interest. In one embodiment, the gripping member 822 is actuated into engagement with the wellbore, followed by the upper packing element 824 and then the lower packing element 834 to set the packer assembly 800 in the wellbore. In one embodiment, the lower packing element 834 is released from engagement with the wellbore, followed by the upper packing element 824 and then the gripping member 822 to release and remove the packer assembly 800 from the wellbore using the conveyance member.

FIG. 16 illustrates one embodiment of a packer assembly 900. The packer assembly 900 may be set in and retrieved from the wellbore using embodiments described of the packer assembly 100 described above. The packer assembly 900 may be lowered and set during a single trip into a wellbore. The packer assembly 900 may also be unset and removed during a single trip into the wellbore. The packer assembly 900 includes a body 910, an upper packer assembly 920, and a lower packer assembly 930. The body 910 may include a tubular member having a bore disposed therethrough. The upper and lower packer assemblies 920 and 930 are coupled to and spaced apart on the body 910. The upper packer assembly 920 includes an upper packing element 924, and the lower packer assembly 930 includes a gripping member 932 disposed below a lower packing element 934. In operation, the packer assembly 900 may be lowered into the wellbore using a conveyance member, such as jointed pipe, coiled tubing, Corod, slickline, or wireline, and located adjacent an area of interest. In one embodiment, the gripping member 932 is actuated into engagement with the wellbore, followed by the lower packing element 934 and then the upper packing element 924 to set the packer assembly 900 in the wellbore. In one embodiment, the upper packing element 924 is released from engagement with the wellbore, followed by the lower packing element 934 and then the gripping member 932 to release and remove the packer assembly 900 from the wellbore using the conveyance member.

FIG. 17 illustrates one embodiment of a packer assembly 1000. The packer assembly 1000 may be set in and retrieved from the wellbore using embodiments of the packer assembly 100 described above. The packer assembly 1000 may be lowered and set in a single trip into a wellbore. The packer assembly 1000 may also be unset and removed in a single trip into the wellbore. The packer assembly 1000 includes a body 1010, an upper packer assembly 1020, and a lower packer assembly 1030. The body 1010 may include a tubular member having a bore disposed therethrough. The upper and lower packer assemblies 1020 and 1030 are coupled to and spaced apart on the body 1010. The upper packer assembly 1020 includes a gripping member 1022 disposed below an upper packing element 1024, and the lower packer assembly 1030 includes a lower packing element 1034. In operation, the packer assembly 1000 may be lowered into the wellbore using a conveyance member, such as jointed pipe, coiled tubing, Corod, slickline, or wireline, and located adjacent an area of interest. In one embodiment, the gripping member 1022 is actuated into engagement with the wellbore, followed by the upper packing element 1024 and then the lower packing element 1034 to set the packer assembly 1000 in the wellbore. In one embodiment, the gripping member 1022 is actuated into engagement with the wellbore, followed by the lower packing element 1034 and then the upper packing element 1024 to set the packer assembly 1000 in the wellbore. In one embodiment, the gripping member 1022 is actuated into engagement with the wellbore, followed by simultaneous actuation of the upper and lower packing elements 1024 and 1034 to set the packer assembly 1000 in the wellbore. In one embodiment, the lower packing element 1034 is released from engagement with the wellbore, followed by the upper packing element 1024 and then the gripping member 1022 to release and remove the packer assembly 1000 from the wellbore using the conveyance member. In one embodiment, the lower packing element 1034 is released from engagement with the wellbore, followed by simultaneous actuation of the upper packing element 1024 and the gripping member 1022 to release and remove the packer assembly 1000 from the wellbore using the conveyance member.

In one embodiment, an assembly for isolating an area of interest in a wellbore includes an upper packer assembly, a lower packer assembly, and a tubular member coupled to the upper and lower packer assemblies to space apart the upper and lower packer assemblies, wherein the upper packer assembly is operable to sealingly engage the wellbore using a mechanical force that is transferred from the lower packer assembly and the tubular member. In one embodiment, the apparatus includes a setting assembly that is releaseably coupled to the upper and lower packer assemblies. In one embodiment, the apparatus includes a setting tool coupled to the setting assembly, wherein the setting tool is configured to operate the setting assembly to set the upper and lower packer assemblies in the wellbore. In one embodiment, the lower packer assembly includes a non-gripping assembly for centering the lower packer assembly in the wellbore. In one embodiment, the upper packer assembly is actuated into engagement with the wellbore prior to the lower packer assembly.

In one embodiment, a method of isolating an area of interest in a wellbore during a single trip into the wellbore includes positioning a straddle assembly adjacent the area of interest using a conveyance member, wherein the straddle assembly includes an upper packer assembly, a lower packer assembly, and a setting assembly coupled to the upper and lower packer assemblies. The method may include applying a first mechanical force to the upper packer assembly using the setting assembly to actuate a gripping member of the upper packer assembly into engagement with the wellbore, applying a second mechanical force to the lower packer assembly using the setting assembly to actuate a packing element of the upper packer assembly into engagement with the wellbore, wherein the first mechanical force is applied to the upper packer assembly in a direction opposite from the second mechanical force, and applying a third mechanical force to the lower packer assembly using the setting assembly to actuate a packing element of the lower packer assembly into engagement with the wellbore. In one embodiment, the conveyance member includes jointed pipe. In one embodiment, the conveyance member includes coiled tubing. In one embodiment, the setting assembly is coupled to the upper packer assembly at a first location and coupled to the lower packer assembly at a second location. In one embodiment, the method may include actuating the gripping member into engagement prior to actuating the packing elements. In one embodiment, the lower packer assembly includes a non-gripping assembly to center the lower packer assembly in the wellbore. In one embodiment, the method may include actuating the non-gripping assembly into engagement with the wellbore prior to actuation of the packing element of the lower packer assembly. In one embodiment, the method may include controlling unsetting of the lower packer assembly by utilizing a releasable connection that is coupled to an engagement through which the third mechanical force is transferred, wherein the releasable connection releases the engagement to unset the lower packer assembly, and wherein the releasable connection is isolated from the third mechanical force.

In one embodiment, a method of retrieving a packer assembly from a wellbore in a single trip using a retrieval tool includes lowering the retrieval tool in the wellbore using a conveyance member, wherein the packer assembly comprises an upper packer and a lower packer each secured to the wellbore, engaging the upper packer with the retrieval tool, thereby forming a first connection, engaging the lower packer with the retrieval tool, thereby forming a second connection, applying a first mechanical force from the retrieval tool to the second connection to release the lower packer from engagement with the wellbore, and applying a second mechanical force from the retrieval tool to the first connection to release the upper packer from engagement with the wellbore. In one embodiment, the method may include removing the packer assembly from the wellbore in the single trip into the wellbore. In one embodiment, the conveyance member includes jointed pipe. In one embodiment, the conveyance member includes coiled tubing. In one embodiment, the method includes releasing the retrieval tool from the second connection prior to applying the second mechanical force. In one embodiment, the method includes removing the retrieval tool from the wellbore independently from the packer assembly.

In one embodiment, an apparatus for retrieving a packer assembly from a wellbore includes a body, a first latch member coupled to the body and adapted to disengage a first portion of the packer assembly from the wellbore, and a second latch member coupled to the body and adapted to disengage a second portion of the packer assembly from the wellbore, wherein the apparatus is configured to retrieve the packer assembly from the wellbore in a single trip into the wellbore. In one embodiment, a support member is coupled to the first latch member to bias the first latch member into engagement with the packer assembly. In one embodiment, the support member is movable using a hydraulic force. In one embodiment, the support member is movable using a mechanical force.

In one embodiment, an assembly for isolating an area of interest in a wellbore includes an upper packer assembly, a lower packer assembly, and a tubular member coupled to the upper and lower packer assemblies to space apart the upper and lower packer assemblies, wherein the tubular member is configured to transmit a mechanical force to the upper packer assembly to actuate the upper packer assembly into engagement the wellbore.

While the foregoing is directed to embodiments of the invention, other and further embodiments of the invention may be devised without departing from the basic scope thereof, and the scope thereof is determined by the claims that follow. For example, a variety of different types of conventional wellbore tubulars, such as coiled tubing and drill pipe, may be utilized in the embodiments discussed herein.

We claim:

1. An assembly for isolating an area of interest in a wellbore, comprising:

an upper packer assembly;

a lower packer assembly; and a tubular member coupled to the upper and lower packer assemblies to space apart the upper and lower packer assemblies, wherein the upper packer assembly is operable to sealingly engage the wellbore using a mechanical force that is transferred from the lower packer assembly and the tubular member, and wherein the upper packer assembly actuates into engagement with the wellbore prior to the lower packer assembly.

2. The assembly of claim 1, further comprising a setting assembly coupled to the upper packer assembly at a first location and coupled to the lower packer assembly at a second location.

3. The assembly of claim 2, wherein the setting assembly is configured to provide the mechanical force to set the upper packer assembly in the wellbore.

4. The assembly of claim 3, wherein the setting assembly is configured to provide a second mechanical force to set the lower packer assembly in the wellbore.

5. The assembly of claim 1, wherein the lower packer assembly includes:

a latch member;

a release sleeve in engagement with the latch member; and a first support member operable to support the latch member into engagement with the release sleeve, wherein the first support member is configured to release the latch member from engagement with the release sleeve, and wherein the first support member is releaseably coupled to the latch member independent from the release sleeve.

6. The assembly of claim 1, further comprising an anchor disposed above the upper packer assembly, wherein the anchor actuates into engagement with the wellbore prior to the upper packer assembly.

7. A method of isolating an area of interest in a wellbore, comprising:

positioning a straddle assembly adjacent the area of interest using a conveyance member in a single trip into the wellbore, wherein the straddle assembly includes an upper packer assembly, a lower packer assembly, and a setting assembly coupled to the upper and lower packer assemblies;

applying a first mechanical force to the straddle assembly using the setting assembly to actuate a gripping member into engagement with the wellbore;

applying a second mechanical force to the upper packer assembly using the setting assembly to actuate a packing element of the upper packer assembly into engagement with the wellbore, wherein the first mechanical force is applied to the upper packer assembly in a direction opposite from the second mechanical force; and applying a third mechanical force to the lower packer assembly using the setting assembly to actuate a packing element of the lower packer assembly into engagement with the wellbore.

8. The method of claim 7, wherein the conveyance member includes at least one of slickline and wireline.

9. The method of claim 7, further comprising releasing the setting assembly from the upper and lower packer assemblies and removing the setting assembly from the wellbore using the conveyance member.

10. The method of claim 9, further comprising lowering a retrieval tool to engage the upper packer assembly and the lower packer assembly, releasing the upper and lower packer assemblies and the gripping member from engagement with the wellbore using the retrieval tool, and removing the retrieval tool and the upper and lower packer assemblies from the wellbore in a single trip.

11. The method of claim 7, further comprising unsetting the upper and lower packer assemblies by using a releasable connection that is coupled to an engagement through which the third mechanical force is transferred, wherein the releasable connection releases the engagement to facilitate unsetting of the upper and lower packer assemblies, and wherein the releasable connection is isolated from the third mechanical force.

12. The method of claim 7, further comprising:

lowering a retrieval tool in the wellbore using a conveyance member;

engaging the upper packer assembly with the retrieval tool, thereby forming a first connection;

engaging the lower packer assembly with the retrieval tool, thereby forming a second connection;

applying a first mechanical force from the retrieval tool to the second connection to release the lower packer assembly from engagement with the wellbore;

applying a second mechanical force from the retrieval tool to the first connection to release the upper packer assembly and the gripping member from engagement with the wellbore; and retrieving the upper and lower packer assemblies in a single trip into the wellbore.

13. The method of claim 12, wherein the conveyance member includes at least one of slickline and wireline.

14. The method of claim 12, wherein the first connection includes a latching member of the retrieval tool that engages a retrieval sleeve of the upper packer assembly.

15. The method of claim 12, wherein the second connection includes a latching member of the retrieval tool that engages a releasable connection of the lower packer assembly.

16. The method of claim 12, further comprising releasing the retrieval tool from the first connection to release the retrieval tool from engagement with the upper packer assembly while in the wellbore.

17. The method of claim 16, wherein releasing the retrieval tool from the first connection includes flowing fluid through the retrieval tool to disengage the retrieval tool from the upper packer assembly.

18. The method of claim 16, wherein releasing the retrieval tool from the first connection includes applying a mechanical force to the retrieval tool to disengage the retrieval tool from the upper packer assembly.

19. The method of claim 16, wherein releasing the retrieval tool from the first connection includes rotating the retrieval tool to disengage the retrieval tool from the upper packer assembly.

20. The method of claim 7, further comprising:

engaging the lower packer assembly with a retrieval tool, wherein the lower packer assembly includes a connection between a first component and a second component that provides a load path for operating the lower packer assembly;

applying a force to a support member configured to maintain the connection, wherein the support member is isolated from the load path; and releasing the support member from the connection, thereby unsetting the lower packer assembly.

21. A packer assembly, comprising:

a body having a bore disposed through the body;

a latch member coupled to the outer surface of the body;

a sleeve, wherein the latch member is coupled to the inner surface of the sleeve to form an engagement for transmitting a force to operate the packer assembly; and a support member configured to couple the latch member to the inner surface of the sleeve, wherein the support member is coupled to the latch member using a releasable connection independent from the sleeve and isolated from the force, wherein release of the support member allows the latch member to disengage from the sleeve, thereby allowing unsetting of the packer assembly.

22. The assembly of claim 21, wherein the upper end of the latch member comprises a lock ring for engaging the outer surface of the body, and wherein the lower end of the latch member comprises one or more collets for engaging the inner surface of the sleeve.

* * * * *